US008628203B2

(12) United States Patent
Kukita

(10) Patent No.: US 8,628,203 B2
(45) Date of Patent: Jan. 14, 2014

(54) LIGHTING DEVICE USING LIGHT-EMITTING DIODE AND GAMING MACHINE INCLUDING THE LIGHTING DEVICE

(75) Inventor: Noritoshi Kukita, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1223 days.

(21) Appl. No.: 12/500,042

(22) Filed: Jul. 9, 2009

(65) Prior Publication Data

US 2010/0022298 A1 Jan. 28, 2010

Related U.S. Application Data

(60) Provisional application No. 61/082,606, filed on Jul. 22, 2008, provisional application No. 61/083,771, filed on Jul. 25, 2008.

(51) Int. Cl.

| | |
|---|---|
| ***F21V 9/16*** | (2006.01) |
| ***F21V 7/00*** | (2006.01) |
| ***A63F 9/24*** | (2006.01) |

(52) U.S. Cl.

USPC ..... 362/84; 362/311.02; 463/30

(58) Field of Classification Search

USPC ..... 362/84, 247, 296.01, 297, 311.02, 362/311.03, 311.04, 311.05; 463/1, 16, 30, 463/31; 257/98, 100

See application file for complete search history.

(56) References Cited

U.S. PATENT DOCUMENTS

| | | | | |
|---|---|---|---|---|
| 4,283,709 | A | 8/1981 | Lucero et al. | |
| 5,382,811 | A | 1/1995 | Takahashi | |
| 5,820,459 | A | 10/1998 | Acres et al. | |
| 5,836,676 | A * | 11/1998 | Ando et al. | 362/244 |
| 6,003,013 | A | 12/1999 | Boushy et al. | |
| 6,142,872 | A | 11/2000 | Walker et al. | |
| 6,312,332 | B1 | 11/2001 | Walker et al. | |
| 6,361,441 | B1 | 3/2002 | Walker et al. | |
| 6,733,390 | B2 | 5/2004 | Walker et al. | |
| 7,111,964 | B2 * | 9/2006 | Suehiro et al. | 362/328 |
| 7,378,686 | B2 * | 5/2008 | Beeson et al. | 257/100 |
| 7,458,701 | B2 * | 12/2008 | Chang | 362/248 |
| 2002/0042296 | A1 | 4/2002 | Walker et al. | |
| 2003/0015959 | A1 | 1/2003 | Tomoda et al. | |
| 2005/0276545 | A1 | 12/2005 | Inui et al. | |
| 2009/0219716 | A1 * | 9/2009 | Weaver et al. | 362/235 |

FOREIGN PATENT DOCUMENTS

| | | |
|---|---|---|
| JP | 8-339704 | 12/1996 |
| JP | 2001-189103 | 7/2001 |

* cited by examiner

*Primary Examiner* — David L Lewis
*Assistant Examiner* — Robert Mosser
(74) *Attorney, Agent, or Firm* — KMF Patent Services, PLLC; S. Peter Konzel; Kenneth M. Fagin

(57) ABSTRACT

A game system 1 related to the present invention includes: slot machines 3A to 3J in each of which a base game is executed with a game value being bet; a shared display 201 which displays predetermined content; and a lighting device 120. The lighting device 120 related to the present invention includes: an LED 135 which emits light; a cover 121 which is positioned so as to receive light emitted from the LED 135, and has a hemispherical shape and translucency; and an aluminum layer serving as a metal layer which is vapor-deposited onto the cover 121, and transmits a predetermined amount of light emitted from the LED 135.

24 Claims, 43 Drawing Sheets

FIG. 9

BASE GAME WINNING COMBINATION LOTTERY TABLE

160

| WINNING COMBINATION | RANDOM NUMBER VALUE |
|---|---|
| ☀×5 | 0～29 |
| ♥×5 | 30～51 |
| ☾×5 | 52～107 |
| K×5 | 108～207 |
| A×5 | 208～407 |
| Q×5 | 408～807 |
| J×5 | 808～1477 |
| 10×5 | 1478～1807 |
| LOSS | 1808～5998 |

FIG. 10

BASE GAME PAYOUT TABLE

161

| WINNING COMBINATION | PAYOUT (PAYING OUT COINS) |
|---|---|
| ☀ × 5 | 70COINS |
| ♥ × 5 | 50COINS |
| ☾ × 5 | 30COINS |
| K × 5 | 25COINS |
| A × 5 | 20COINS |
| Q × 5 | 15COINS |
| J × 5 | 10COINS |
| 10 × 5 | 5COINS |
| LOSS | 0COIN |

FIG. 11

JACKPOT POINT TABLE

162

| THE NUMBER OF SYMBOLS OF SUN (THE NUMBER OF JACKPOT POINT SYMBOLS) | THE NUMBER OF POINTS OBTAINED |
|---|---|
| 0 | 0PT |
| 1 | 1PT |
| 2 | 2PT |
| 3 | 3PT |
| 4 | 4PT |
| 5 | 5PT |
| 6 | 6PT |
| 7 | 7PT |
| 8 | 8PT |
| 9 | 9PT |

FIG. 14

| | SYMBOL LINE A | SYMBOL LINE B | SYMBOL LINE C | SYMBOL LINE D | SYMBOL LINE E |
|---|---|---|---|---|---|
| CODE NO. | SYMBOL | SYMBOL | SYMBOL | SYMBOL | SYMBOL |
| 00 | SUN | J | J | HEART | 10 |
| 01 | 10 | HEART | MOON | SUN | J |
| 02 | SUN | J | SUN | 10 | SUN |
| 03 | A | HEART | J | K | HEART |
| 04 | SUN | 10 | A | HEART | J |
| 05 | 10 | SUN | 10 | A | Q |
| 06 | SUN | A | SUN | J | SUN |
| 07 | A | MOON | K | Q | J |
| 08 | Q | HEART | A | 10 | A |
| 09 | MOON | J | K | SUN | HEART |
| 10 | SUN | HEART | SUN | HEART | Q |
| 11 | HEART | K | 10 | SUN | 10 |
| 12 | SUN | MOON | HEART | 10 | HEART |
| 13 | K | Q | Q | MOON | SUN |
| 14 | Q | HEART | SUN | J | J |
| 15 | SUN | J | HEART | K | A |
| 16 | J | HEART | MOON | MOON | MOON |
| 17 | K | K | 10 | HEART | SUN |
| 18 | SUN | 10 | SUN | 10 | HEART |
| 19 | 10 | MOON | 10 | SUN | SUN |
| 20 | Q | HEART | SUN | MOON | 10 |
| 21 | MOON | SUN | Q | A | K |

INITIAL PROCESS

FIG. 35

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE NO. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

INITIAL PROCESS

LIGHTING DEVICE USING LIGHT-EMITTING DIODE AND GAMING MACHINE INCLUDING THE LIGHTING DEVICE

CROSS REFERENCE TO RELATED APPLICATION

The present application claims priority from the following provisional applications: No. 61/082,606 filed on Jul. 22, 2008; No. 61/083,771 filed on Jul. 25, 2008, the entire disclosure of which are herein incorporated by reference.

BACKGROUND OF THE INVENTION

1. Field of the Invention

The present invention relates to a lighting device and a gaming machine including the lighting device.

2. Description of Related Art

Among existing gaming machines, there is a gaming machine including: two or more gaming terminals; terminal controllers respectively provided to the gaming terminals, each of which controllers causes associated one of the gaming terminals to run a game; and a center controller which controls the terminal controllers. Such a gaming machine is disclosed in, for example, specifications of U.S. Patent Application Publication No. 2002/0042296, U.S. Pat. No. 6,733,390, U.S. Pat. No. 6,312,332, U.S. Pat. No. 6,142,872, U.S. Pat. No. 6,361,441, U.S. Pat. No. 5,820,459, U.S. Pat. No. 4,283,709, and U.S. Pat. No. 6,003,013. A terminal controller of a gaming terminal runs a game and awards a payout based on the result of the game independently from another terminal controller of another gaming terminal. The center controller provides a bonus game, in which two or more players compete against one another for various jackpots, such as a progressive jackpot and a mystery jackpot, through the gaming terminals.

This type of gaming machine uses large-scale decorative illuminations, which requires a number of decorative illumination devices such as a traditional electric light bulb. Such a traditional electric light bulb includes an incandescent light bulb, a halogen lamp, a fluorescent lamp and the like, and is hereinafter referred to as a "light bulb".

However, using a light bulb for a decorative illumination device may cause high operational cost because the life of a light bulb is relatively short and large power consumption is needed for lighting a bulb.

To relieve the above demerit, instead of using a conventional light bulb, there has been used for various types of decorative illumination devices, a lamp of light-emitting diode (LED) whose life is relatively long and whose power consumption for emitting light is small. The LED lamp is a light source suitable for spotlight-like lighting due to its high directivity. Such lamp is disclosed, for example, in U.S. Patent Application Publication No. 2003/0015959, U.S. Patent Application Publication No. 2005/0276545, U.S. Pat. No. 5,382,811, Japanese Unexamined Patent Publication No. 189103/2001 (Tokukai 2001-189103), and Japanese Unexamined Patent Publication No. 339704/1996 (Tokukaihei 08-339704).

Although the high directivity of an LED lamp is preferable for the purpose of providing light whose lighting area is limited, the light from an LED produces excessively sharp boundaries between the lighted area and its surroundings (not-lighted area). Accordingly, there may be some applications in which an LED lamp is not preferable. For example, when it is required to provide illuminating light similar to light from a light bulb, preferable is the illuminating manner by which the lighted area has a dim outline.

Often, the players feel the glare when the light emitted by the luminescent display device is too bright. In this case, in order to provide luminescent effects at a suitable level of brightness to the players, the luminescent display device needs to be provided with a light emitting portion that is less bright, or a cover to attenuate the quantity of transmitting light.

However, adjusting the brightness of the luminescent display device can be tedious because the suitable brightness of the emitted light from the luminescent display device varies depending upon lighting conditions such as the room illumination of the place where the gaming machine is installed, or the position of the luminescent display device relative to the players, among other factors.

Further, gaming machines provided with such luminescent display devices are often adapted to display game situations, such as the progress of a game, by the illumination state of the luminescent display devices. Here, the illumination state of the luminescent display devices needs to be easily recognizable by the players, who, in this case, pay lots of attention to the illumination state of the luminescent display devices.

However, when light from one luminescent display device merges into light from other luminescent display devices, there are cases where the players cannot recognize the luminescent display device emitting light, failing to grasp the game situation. Since this requires adjustment of illumination area for each luminescent display device, it complicates the whole procedure of adjusting the illumination area of the luminescent display devices.

To solve the above-described problems, an object of the present invention is to provide a lighting device which is capable of providing illuminating light similar to a light bulb by blurring high-directivity light emitted from a light-emitting diode (LED), and a gaming machine including the lighting device.

It is also an object of the present invention to provide a gaming machine that enables easy adjustment of the brightness and illumination area of light emitted by the luminescent display devices providing luminescent effects.

SUMMARY OF THE INVENTION

The present invention provides a lighting device (lighting device 120) including: a light-emitting diode (LED 135) which emits light; a cover (cover 121) which is positioned so as to receive light emitted from the light-emitting diode, and has a hemispherical shape and translucency; and a metal layer which is vapor-deposited onto the cover, and transmits a predetermined amount of light emitted from the light-emitting diode.

In this structure, when the light emitted from the light-emitting diode passes through the cover having the metal layer vapor-deposited thereonto, the amount of light is decreased to a predetermined amount. Thus, the amount of light emitted from the light-emitting diode is decreased, so that there can be provided light whose amount is similar to that of a light bulb. Also, it is possible to set the translucency percentage freely by varying the thickness of the metal layer vapor-deposited onto the cover. This allows the amount of light from the light-emitting diode to be adjusted, so that there can be provided light whose amount is similar to that of a light bulb.

The present invention also provides the above-described lighting device, in which the metal layer is vapor-deposited so that the deposited layer is thickest at a most outward portion of the cover.

This structure provides a feature that, at least, the translucency percentage of light is lowest at the most outward portion (intersection point of an optical axis of light and the cover), and the percentage increases with the distance from the most outward portion, since the metal layer is vapor-deposited onto the cover so that the deposited layer is thickest at the most outward portion of the cover, which has a hemispherical shape. Due to this metal layer, at the most outward portion which receives a largest amount of light and has the lowest translucency percentage, the amount of light emitted from the cover to outside is decreased to a small amount; while at another portion which receives a small amount of light and has a high translucency percentage, most of the received light is transmitted to the outside. Accordingly, even if the light emitted from the light-emitting diode has high directivity, unevenness in the amount of light is smoothed as a whole and thus obtained light is emitted from the cover to outside. As a result, it is possible to provide illuminating light similar to a light bulb by blurring high-directivity light emitted from the light-emitting diode.

The present invention also provides the above-described lighting device, in which the metal layer vapor-deposited onto the cover is aluminum.

In this structure, high-reflective aluminum is adopted as a metal layer vapor-deposited onto the cover, and therefore, the cover to which light emitted from the light-emitting diode is irradiated has high reflectivity. Due to this, at the most outward portion which receives a largest amount of light, the aluminum layer has the highest reflectivity, so that the amount of light emitted from the cover to outside is decreased to a small amount. On the other hand, at another portion which receives a small amount of light and has a low reflectivity, most of the received light is transmitted to the outside. Accordingly, even if the light emitted from the LED has high directivity, unevenness in the amount of light is smoothed as a whole and thus obtained light is emitted from the cover to outside. As a result, it is possible to provide illuminating light similar to a light bulb by blurring high-directivity light emitted from the light-emitting diode.

The present invention also provides the above-described lighting device, in which the cover is made of polycarbonate.

In this structure, the cover is formed using polycarbonate. This realizes high heat resistance and reduction in weight, of the cover of the lighting device.

The present invention also provides the above-described lighting device, further including a reflector (reflector 134) which is positioned so as to receive reflected light of light emitted from the light-emitting diode, the reflector reflecting, toward the cover, light reflected by the metal layer.

In this structure, when light emitted from the light-emitting diode is irradiated to the cover having the metal layer vapor-deposited thereonto, some portion of the light passes through the cover and another portion of the light is reflected by the cover. The reflected light is reflected again by the reflector, and is irradiated to the cover. A portion of the irradiated light passes through the cover, and another portion of the light is reflected. Repeating this operation widens the directivity of light from the light-emitting diode, thereby expanding the region in the cover where light is irradiated. This allows light emitted from the light-emitting diode to be illuminating light with wider directivity similar to a light bulb.

The present invention also provides the above-described lighting device, in which the reflector curves inward to form a recess shape and a reflection face of the reflector is constituted by a plurality of areas each having a reflection angle different from one another.

In this structure, when light emitted from the light-emitting diode is irradiated to the cover having the metal layer vapor-deposited thereonto, some portion of the light passes through the cover and another portion of the light is reflected by the cover. The reflected light is reflected by the areas each having a different reflection angle, which areas formed on the reflector curving inward to form a recess shape, and the light is irradiated to the cover again. Some portion of the irradiated light passes through the cover, and another portion of the light is reflected. Repeating this operation allows the light from the light-emitting diode to be irradiated all over the cover concentratedly, and therefore the light can be collected onto the cover. Accordingly, it is possible to emit, from the cover, illuminating light like light from a light bulb.

The present invention also provides the above-described lighting device, further including: a housing (housing 123) which has an opening (opening 136), and contains therein the light-emitting diode and the reflector; and a sealing member (sealing plate 122) which seals the opening and holds the cover.

In this structure, the light-emitting diode and the reflector are contained in the housing, and the opening is sealed by the sealing member. This arrangement makes it is possible to prevent a foreign matter from entering from outside, which may cause a variation in reflectivity of the reflector and a failure of the light-emitting diode.

The present invention also provides the above-described lighting device, in which the housing has a connecting portion (T-shape connecting portions 301A, 301B, 301C, and 301D; and L-shape connecting portions 302A, 302B, 302C, and 302D) provided at a side of the housing, through which portion the housing is connected to another housing by engagement.

In this structure, more than one lighting devices can be connected to each other freely. Therefore, at a time of installation of the lighting devices, it is possible to dispose the lighting devices adjacent to each other. It is also possible to arrange the lighting devices freely, at the left, right, top and bottom of one device, so as to match their installation space.

The present invention provides a gaming machine (game system 1) including a plurality of terminal devices (slot machines 3A to 3J) in each of which a base game is executed with a game value being bet; a common display (shared display 201) which displays predetermined content, and a lighting device. The lighting device includes: a light-emitting diode (LED) which emits light; a cover which is positioned so as to receive light emitted from the light-emitting diode, and has a hemispherical shape and translucency; and a metal layer which is vapor-deposited onto the cover, and transmits a predetermined amount of light emitted from the light-emitting diode.

In this structure, it is possible to mount on the gaming machine the lighting device capable of providing light whose amount is similar to that of a light bulb by reducing the amount of light from the light-emitting diode. This allows the light from the light-emitting diode to have an amount similar to that of a light bulb, and allows the gaming machine to present an effect using that light.

The present invention also provides the above-described gaming machine, in which the metal layer is vapor-deposited onto the cover of the lighting device so that the deposited layer is thickest at a most outward portion of the cover having a hemispherical shape.

In this structure, it is possible to mount, on the gaming machine, the lighting device which emits illuminating light similar to a light bulb by blurring high-directivity light emitted from the light-emitting diode. Thus, even if using a low-cost, long-life light-emitting diode, there can be provided illuminating light similar to a light bulb as effect illumination of the gaming machine.

The present invention also provides the above-described gaming machine, in which the metal layer vapor-deposited onto the cover of the lighting device is aluminum.

In this structure, it is possible to mount, on the gaming machine, the lighting device which emits illuminating light similar to a light bulb by further blurring high-directivity light emitted from the light-emitting diode. Thus, even if using a low-cost, long-life light-emitting diode, there can be provided illuminating light similar to a light bulb as effect illumination of the gaming machine.

The present invention also provides the above-described gaming machine, in which the cover of the lighting device is made of polycarbonate.

In this structure, the cover of the lighting device of the gaming machine is made of polycarbonate. This realizes high heat resistance and reduction in weight, of the cover of the lighting device of the gaming machine.

The present invention also provides the above-described gaming machine, in which the lighting device further includes a reflector which is positioned so as to receive reflected light of light emitted from the light-emitting diode, the reflector reflecting, toward the cover, light reflected by the metal layer.

In this structure, it is possible to mount, on the gaming machine, the lighting device capable of producing, from light emitted from the light-emitting diode, illuminating light having wide directivity like a light bulb. Thus, even if using a low-cost, long-life light-emitting diode, there can be provided illuminating light having wide directivity like a light bulb, as effect illumination of the gaming machine.

The present invention also provides the above-described gaming machine, in which the reflector of the lighting device curves inward to form a recess shape and a reflection face of the reflector is constituted by a plurality of areas each having a reflection angle different from one another.

In this structure, it is possible to mount, on the gaming machine, the lighting device is capable of emitting illuminating light similar to a light bulb from the cover. Thus, using a low-cost, long-life light-emitting diode, it is possible to provide illuminating light similar to a light bulb, as a decorative light of the gaming machine.

The present invention also provides the above-described gaming machine, in which the lighting device further includes: a housing which has an opening and contains therein the light-emitting diode and the reflector; and a sealing member which seals the opening and holds the cover.

In this structure, it is possible to mount on the gaming machine the lighting device which is capable of preventing a foreign matter from entering from outside, which may cause variation in reflectivity of the reflector and a failure of the light-emitting diode. This makes it possible to reduce the incidence of failures of the lighting device of the gaming machine.

The present invention also provides the above-described gaming machine, in which the housing of the lighting device has a connecting portion provided at a side of the housing, through which portion the housing is connected to another housing by engagement.

In this structure, at a time of installation of a plurality of lighting devices to the gaming machine, it is possible to dispose the lighting devices adjacent to each other. It is also possible to arrange the lighting devices of the gaming machine freely, at the left, right, top and bottom of one device, so as to match their installation space.

A gaming machine of the present invention includes a luminescent display device to provide luminescent effects, the luminescent display device including: a light emitting portion to emit light; a housing, having an aperture formed in a predetermined portion within a path of emergent light from the light emitting portion, housing the light emitting portion; and a cover member, detachably provided to cover the aperture of the housing, to attenuate a quantity of transmitting light emitted by the light emitting portion.

With this arrangement, the light emitted by the light emitting portion enters the aperture provided in a predetermined portion of the housing within a path of emergent light from the light emitting portion. The light entering the aperture is attenuated as it passes through the cover member provided to cover the aperture. Accordingly, the brightness of the light is reduced as the light passes through the cover member. By reducing the brightness of the light through the cover member, luminescent effects can be provided at the brightness suitable to the players, even when the light emitted by the light emitting portion is too bright.

Further, the cover member is detachably provided for the housing. By providing more than one cover member having different attenuations for the transmitting light, the brightness of the emitted light from the luminescent display device can be appropriately adjusted. By the provision of the cover member covering the aperture of the housing, the players are prevented from directly touching the light emitting portion through the aperture of the housing. This reduces the risk of the light emitting portion being damaged by the players.

By the housing, the light emitted by the light emitting portion does not emerge outside except through the aperture. In this way, the light emitted by the light emitting portion emerges only through the aperture, making it possible for the players to recognize the luminescent display device emitting light.

The cover member in a luminescent display device of the present invention may include a raised portion protruding in a direction of emergent light from the light emitting portion.

With this arrangement, the cover member has a raised portion. By the protrusion on the outer side of the cover member, the players can see the emergent rays of the luminescent display device over a wide angle with respect to the luminescent display device.

The cover member in a luminescent display device of the present invention may include a lens that varies a direction of emergent light from the light emitting portion.

With this arrangement, depending on the shape of the lens, the light emitted by the light emitting portion converges or diverges as it passes through the lens. Thus, by varying the shape of the lens, the illumination area of the light emitted outside by the luminescent display device can be varied. Because the lens is formed with the cover member detachably provided for the housing, the shape of the lens can be appropriately varied by preparing cover members having different lens shapes.

The housing in the present invention may include a reflecting surface to reflect light emitted by the light emitting portion.

With this arrangement, some of the emitted light by the light emitting portion not entering the aperture is reflected into the aperture by the reflecting surface formed on the housing. In this way, the brightness of the light emerging from the luminescent display device can be improved. This helps the players to easily see the light emerging outside from the luminescent display device.

The reflecting surface of the housing in the present invention may be partially inclined, parabolic, or ellipsoidal, with an increasing diameter toward the aperture.

With this arrangement, some of the emitted light by the light emitting portion not entering the aperture is reflected into the aperture by the reflecting surface formed on the housing. Further, by the shape in part of the reflecting surface of the housing, the illumination area of the light emerging from the luminescent display device can be adjusted. This helps the players to easily see the light emerging outside from the luminescent display device.

The cover member of the luminescent display device in the present invention may include a half mirror.

With this arrangement, the quantity of light passing through the half mirror out of the luminescent display device can be controlled to make inside of the luminescent display device visible or invisible to the players. When the quantity of light passing through the half mirror out of the luminescent display device is excessively smaller than the quantity of external light entering the luminescent display device and reflected by the half mirror, the players can see only the surface of the half mirror. On the other hand, when the quantity of light passing through the half mirror out of the luminescent display device is greater, the players can see inside the luminescent display device. That is, by adjusting the transmittance of the half mirror, the players can see only the light emitted by the light emitting portion. This makes it easier for the players to see the light emerging from the luminescent display device.

Because the half mirror is formed with the cover member detachably provided for the housing, the transmittance of the half mirror can be appropriately varied by preparing cover members with half mirrors having different transmittances.

Further, in the present invention, the cover member in the luminescent display device may include a half mirror, and the housing may include a reflecting surface to reflect light emitted by the light emitting portion.

With this arrangement, some of the emitted light by the light emitting portion entering the half mirror is reflected by the half mirror and undergo multiple reflection by the reflecting surface of the housing. As a result, the brightness of the light emerging from the luminescent display device becomes substantially uniform over the illumination area. Therefore, in the illumination area of the light emerging from the luminescent display device, the players can easily recognize the illumination state of the luminescent display device, irrespective of their positions with respect to the luminescent display device.

A gaming machine of the present invention includes a luminescent display unit provided with a luminescent display device to provide luminescent effects, the luminescent display device including a light emitting portion to emit light; a housing, having an aperture formed in a predetermined portion within a path of emergent light from the light emitting portion, housing the light emitting portion; and a cover member, detachably provided to cover the aperture of the housing, to attenuate a quantity of transmitting light emitted by the light emitting portion, the luminescent display device being one of luminescent display devices provided in the luminescent display unit.

With this arrangement, the luminescent display unit includes at least one luminescent display device, which defines a path. By using more than one luminescent display unit, the path defined by the luminescent display device of one luminescent display unit can be connected to that of other luminescent display units to form paths of various shapes. Further, because the luminescent display unit includes at least one luminescent display device, the number of steps required to mount the luminescent display device to the gaming machine can be reduced.

Further, because the cover member is detachable, the cover member can be appropriately interchanged to help the players see the light emitted from the luminescent display device, according to the positions of the players with respect to the luminescent display device.

A gaming machine of the present invention, comprises:

a base game that awards a payout according to a predetermined winning;

a plurality of gaming terminals each including a terminal controller programmed to perform operations (a1) and (a2);

a bonus game that awards a bonus payout more rewarding than the payout in the base game;

a bonus payout indicator that displays the bonus payout;

a center controller programmed to perform operations (b1) through (b3); and a path defined by luminescent display devices to connect each gaming terminal to the bonus payout indicator, the luminescent display devices each including:

a light emitting portion to emit light;

a housing, having an aperture formed in a predetermined portion within a path of emergent light from the light emitting portion, housing the light emitting portion; and a cover member, detachably provided to cover the aperture of the housing, to attenuate a quantity of transmitting light emitted by the light emitting portion, the terminal controllers each including the steps of:

(a1) running the base game independently from the other gaming terminals and awarding the payout according to a predetermined winning, and (a2) awarding the bonus payout based on an instruction from the center controller, and the center controller including the steps of:

(b1) running the bonus game based on a predetermined condition, (b2) causing the light emitting portions in the luminescent display devices to undergo state changes toward the bonus payout indicator, when a predetermined winning is met in any of the gaming terminals, and (b3) instructing the terminal controller of the gaming terminal, corresponding to a path in which the light emitting portions in the luminescent display devices underwent state changes up to the bonus payout indicator, to award the bonus payout.

As used herein, the "state of light emitting portions" means a non-lighting state, a lighting state, a non-flashing state, a flashing state, a color-lighting state, or a state of emitted brightness.

With this arrangement, a path is defined by luminescent display devices to connect each gaming terminal to the bonus payout indicator, and the light emitting portions in the luminescent display devices are caused to undergo state changes toward the bonus payout indicator every time a predetermined winning is met, and a bonus payout is awarded to a gaming terminal corresponding to a path in which the light emitting portions in the luminescent display devices underwent state changes up to the bonus payout indicator.

The light emitted by the light emitting portion enters the aperture provided in a predetermined portion of the housing within a path of emergent light from the light emitting portion. The light entering the aperture is attenuated as it passes through the cover member provided to cover the aperture.

Accordingly, the brightness of the light is reduced as the light passes through the cover member. By reducing the brightness of the light through the cover member, luminescent effects can be provided at the brightness suitable to the players, even when the light emitted by the light emitting portion is too bright.

Further, the cover member is detachably provided for the housing. By providing more than one cover member having different attenuations for the transmitting light, the brightness of the emitted light from the luminescent display device can be appropriately adjusted. By the provision of the cover member covering the aperture of the housing, the players are prevented from directly touching the light emitting portion through the aperture of the housing. This reduces the risk of the light emitting portion being damaged by the players.

By the housing, the light emitted by the light emitting portion does not emerge outside except through the aperture. In this way, the light emitted by the light emitting portion emerges only through the aperture, making it possible for the players to recognize the luminescent display device emitting light. The players are therefore able to easily grasp the progress of a game, represented by the state of the light emitting portions of the luminescent display devices.

BRIEF DESCRIPTION OF THE DRAWINGS

FIG. 9 is an explanatory view showing a base game winning combination lottery table.

FIG. 10 is an explanatory view showing a base game payout table.

FIG. 11 is an explanatory view showing a jackpot point table.

FIG. 14 is a table showing symbol columns and code numbers of respective symbols.

FIG. 35 is an explanatory diagram illustrating a symbol column of symbols rearranged on a terminal display.

DESCRIPTION OF THE PREFERRED EMBODIMENTS (First Embodiment)

The following describes a first embodiment of a gaming machine and a playing method thereof according to the present invention. Note that reference numbers and symbols given to members and steps of flowcharts are only applicable to those described within the present embodiment, and do not represent the members or the steps of the other embodiments.

The followings describe an embodiment of a lighting device and a gaming machine including the lighting device according to the present invention. The below-described first embodiment deals with a case where the lighting device and the gaming machine including the lighting device according to the present invention are applied to a game system 1, by specifically implementing them from mechanical, electrical, and operational aspects.

[Mechanical Structure of Game System 1]

The game system 1 is installed in a gaming facility or the like. The game system 1 performs a unit game by use of a game value. The game value is a coin, a bill, or a value in the form of electronic information. However, the game value in the present invention is not particularly limited. For example, a medal, token, electronic money, a ticket and the like are also possible. Further, the ticket is not particularly limited and may be a barcoded ticket which will be described later, and the like.

Figure 2:
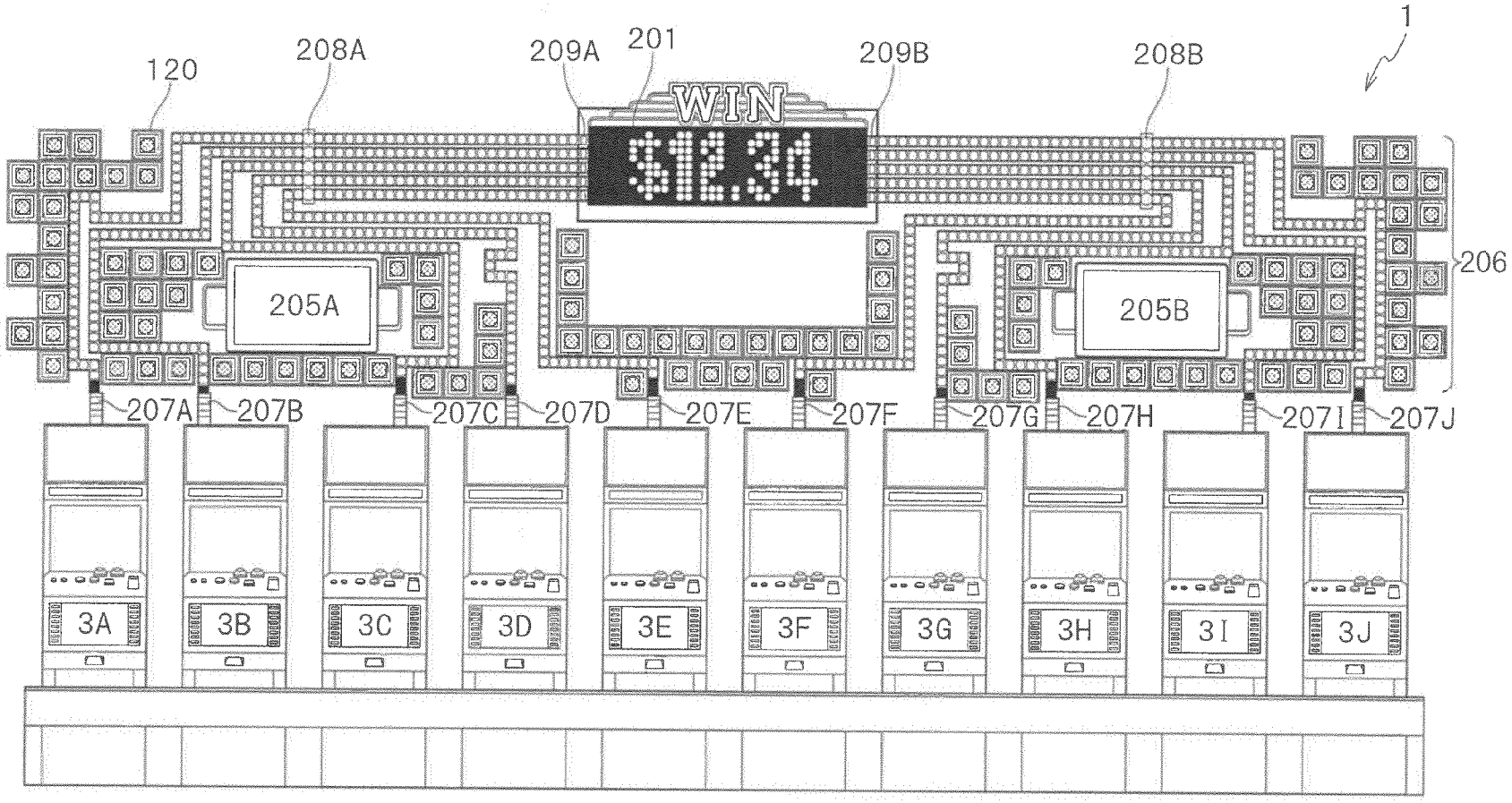
FIG. 2 is a front view showing an external appearance of a game system.

The first embodiment will be described with reference to FIG. 2. FIG. 2 is a front view of the game system 1 according to the embodiment of the present invention.

As shown in FIG. 2, the game system 1 includes: ten slot machines 3A to 3J; a shared display 201; two small shared displays 205A and 205B; a central control board 210 (see FIG. 12) provided to the shared display 201; a route board 206; and lighting devices 120 disposed at respective positions on the route board 206. These components are connected to one another via a network.

On the route board 206, routes 207A to 207J are disposed so as to correspond to the slot machines 3A to 3J respectively. Each of the routes 207A to 207J includes many LEDs continuously arranged from corresponding one slot machine out of the slot machines 3A to 3J to the shared display 201.

The LEDs arranged on the route board 206 are constituted by a combination of at least three types of LEDs, including a reddish LED, a greenish LED, and a bluish LED. This structure can realize color representation using the primary colors of light, which are R (red), G (green) and B (blue).

Each of the routes 207A to 207J is constituted of a straight portion and a bending portion. The routes are from goal lines 209A and 209B provided adjacent to the shared display 201 to the slot machines 3A to 3J, via on and off light lines 208A and 208B, respectively.

In the game system 1 according to this embodiment, a percentage of an amount bet at each of the slot machines 3A to 3J is accumulatively calculated, so that an accumulated value is obtained. An image showing the accumulated value resulting from the accumulative calculation is displayed on the shared display 201. For example, in FIG. 2, "$12,34" is displayed on the shared display 201, which indicates that the accumulated value is "$12,34". When the accumulated value reaches a predetermined value, a jackpot game is run at the slot machines 3A to 3J for the purpose of obtaining one or more coins equivalent to the accumulated value.

In a jackpot game, the positions corresponding to the respective connection points between the slot machines 3A to 3J and the routes 207A to 207J are the 0 point positions, and the respective positions where the routes intersect with the goal line 209A or 209B are the 50 point positions. For example, in a jackpot game, zero or more point is awarded according to the number of jackpot point symbols (described later) (see FIG. 11). Then, the thus awarded point is cumulated, and when the cumulative points reach a predetermined value (50 points), there is awarded coins equivalent to the accumulated value displayed on the shared display 201 (i.e. "$12,34"). Here, the number of cumulative points awarded at each of the slot machines 3A to 3J is indicated by the number of light-emitting LEDs disposed on a corresponding route out of the routes 207A to 207J.

Figure 1:
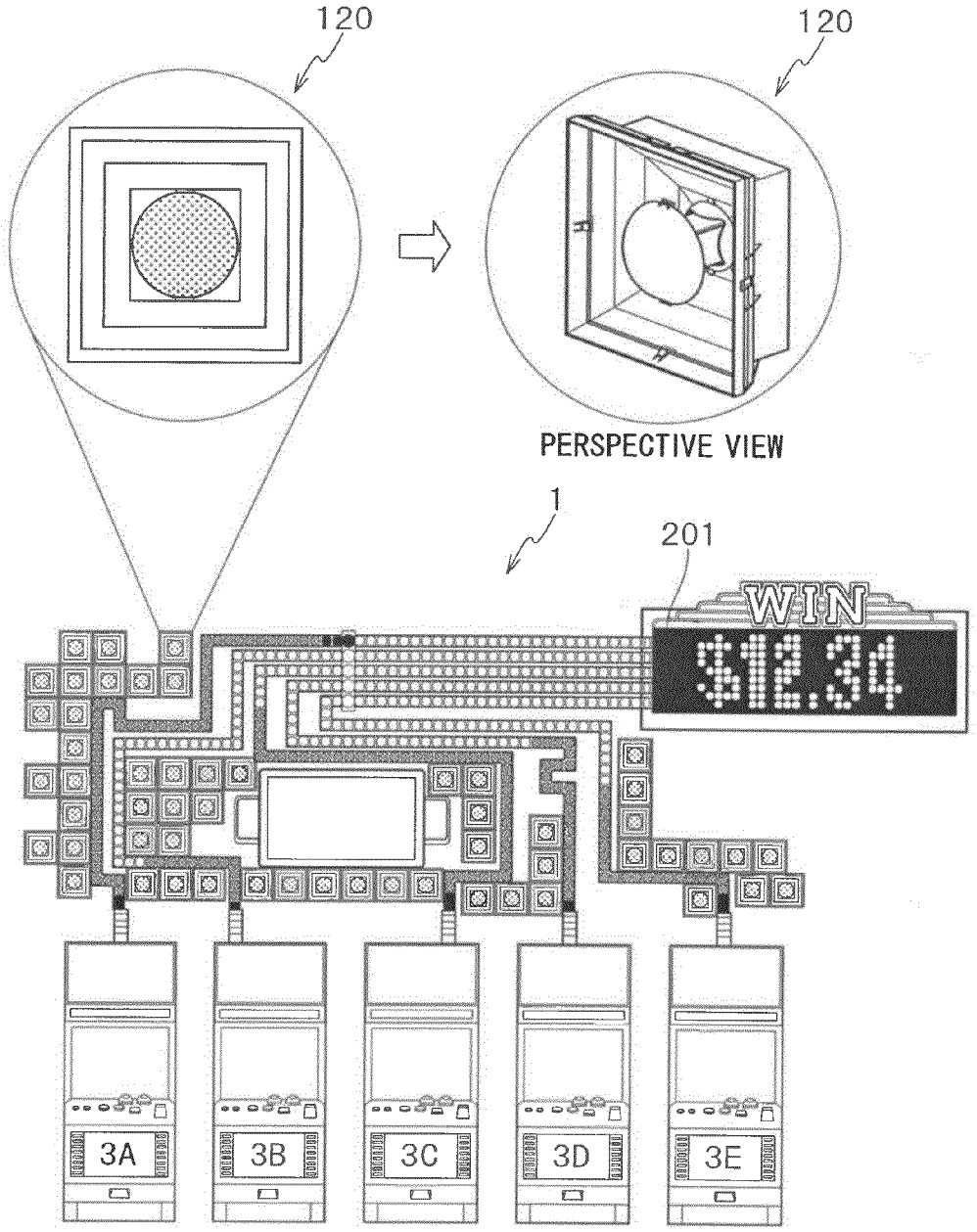
FIG. 1 is an explanatory view showing positions of lighting devices in a gaming machine.

The shared display 201 has LEDs 274 for indicating an accumulated value resulted from the accumulative calculation of a percentage of amount bet at each of the slot machines 3A to 3J. The LEDs 274 are arrayed on a printed circuit board 273 in a form of dot matrix of 16 rows and 48 columns. Light emission from the LEDs arrayed in the dot matrix of 16 rows and 48 columns allows a desired value to be displayed. For example, as shown in FIGS. 1 and 2, a value such as "$12,34" is displayed on the shared display 201 by light emission from the LEDs.

In addition, the routes 207A to 207J are coupled with the shared display 201 by respectively connecting the terminals of the shared display 201 to the terminals of the routes 207A to 207J.

[Structure of Lighting Device]

Figure 3:
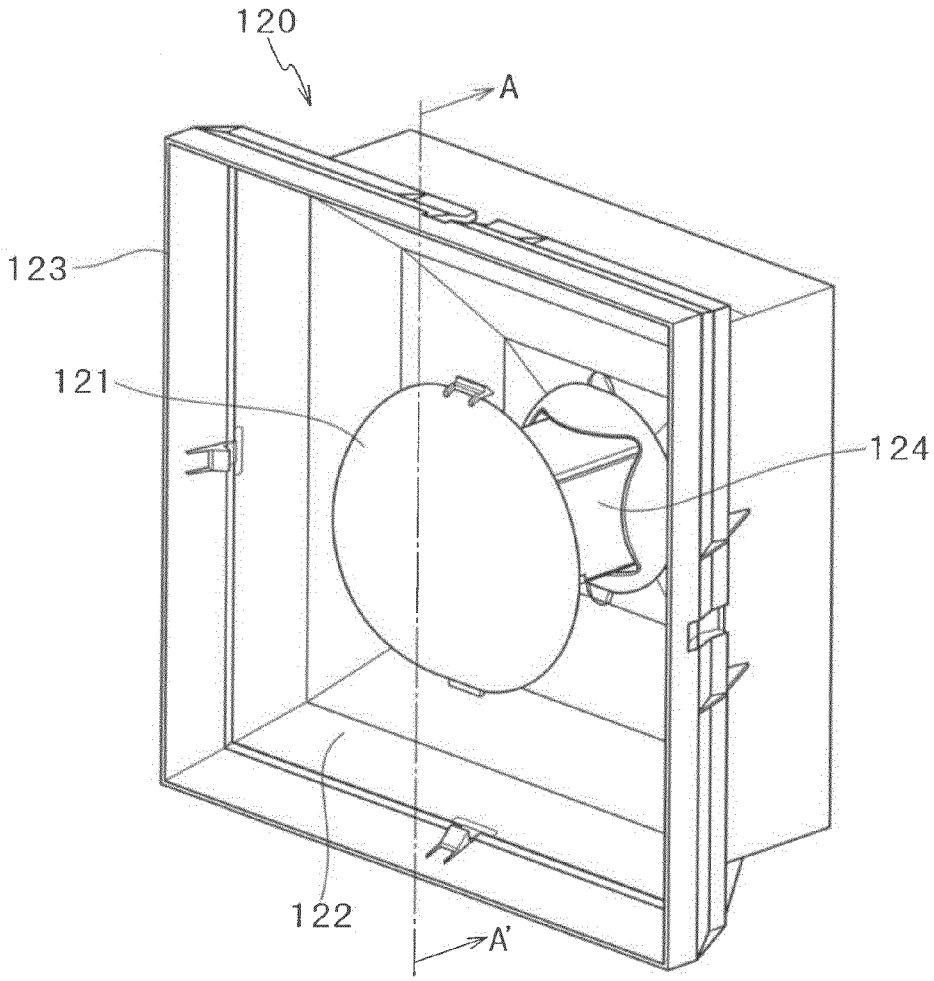
FIG. 3 is a perspective view showing an external appearance of a lighting device.
Figure 4:
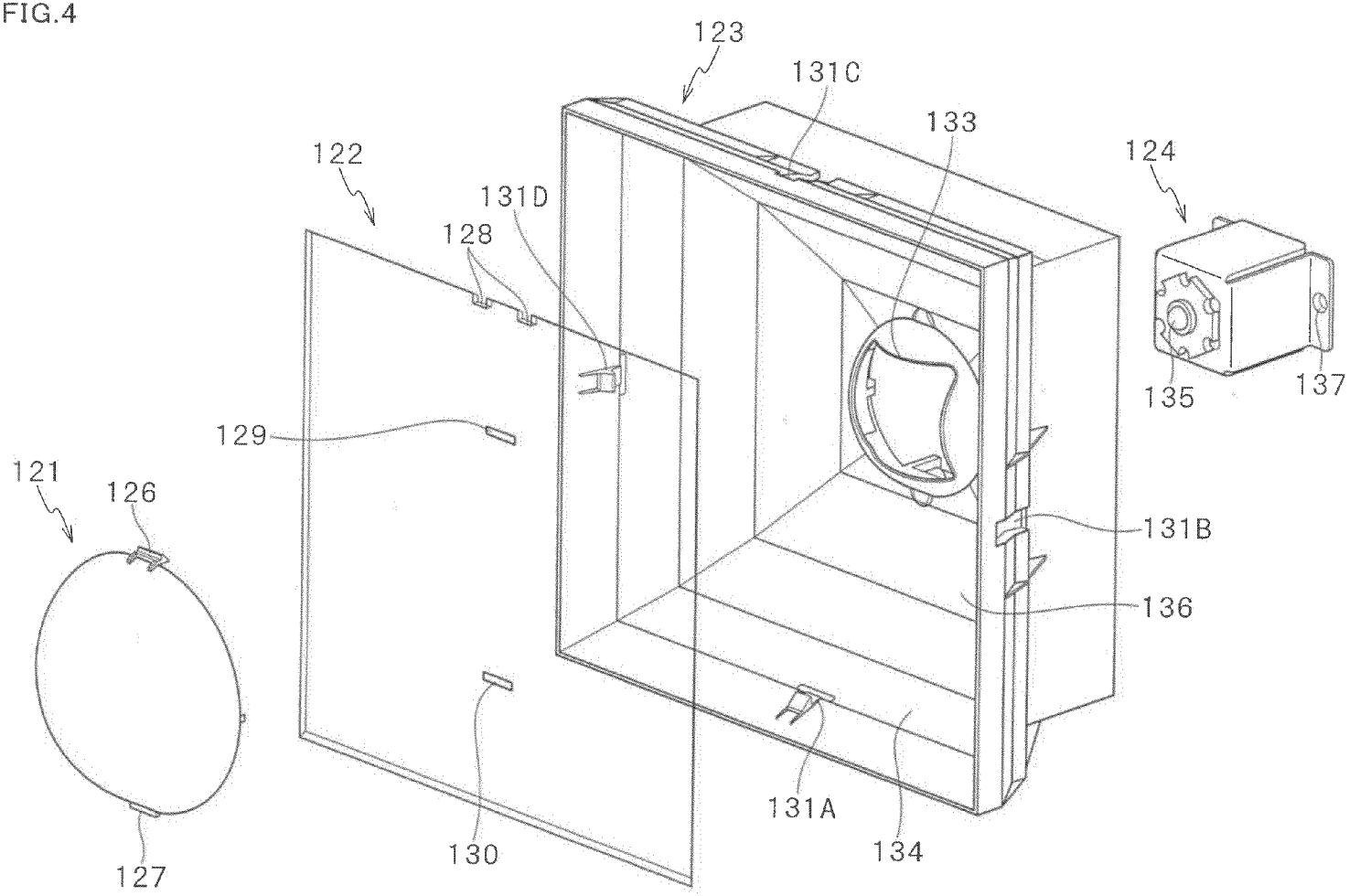
FIG. 4 is an exploded perspective view showing a structure of the lighting device.
Figure 5:
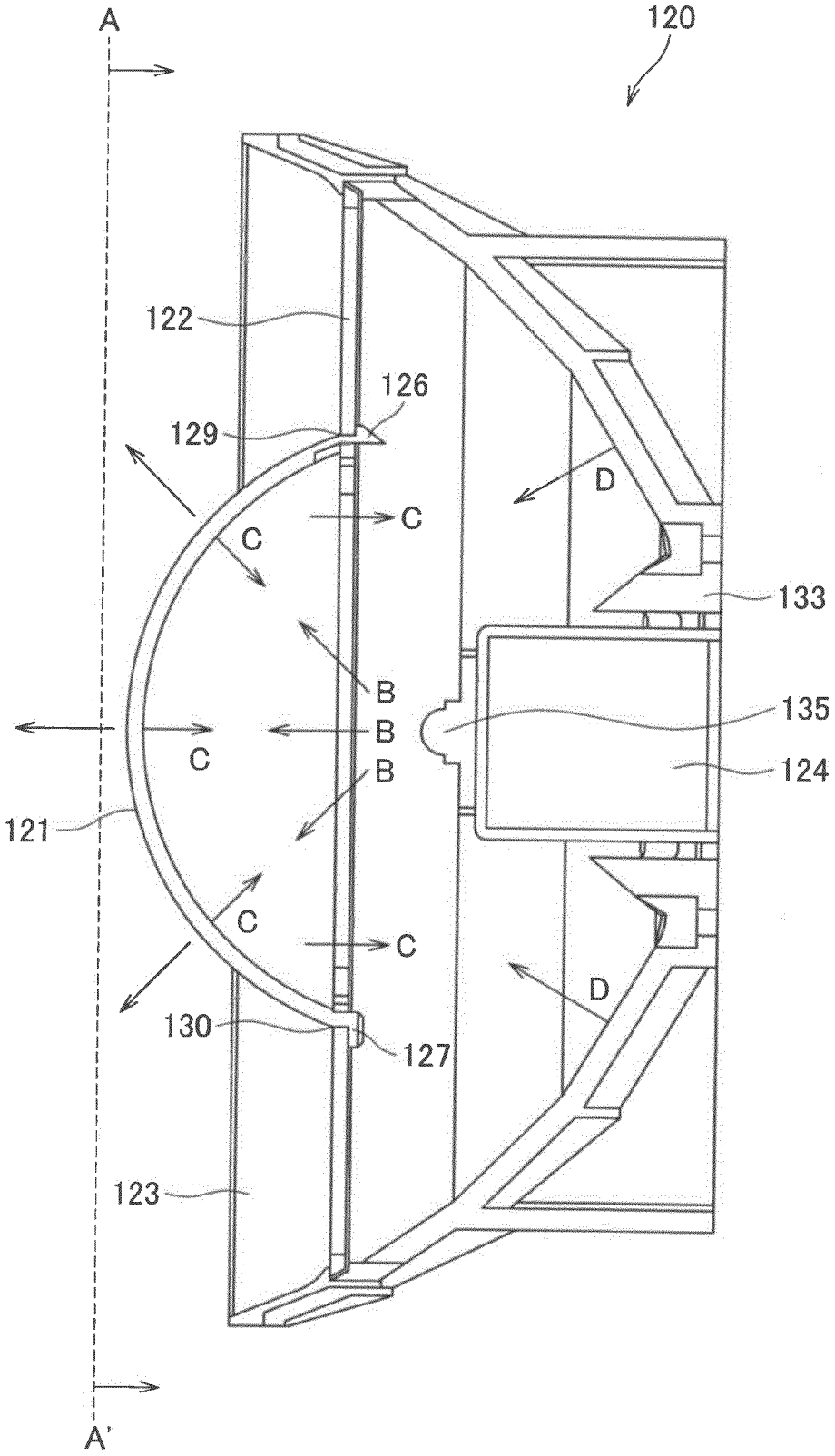
FIG. 5 is a sectional view of the lighting device taken along a line A-A'.

Next, with reference to FIGS. 3, 4, and 5, there will be described each of the lighting devices 120 disposed in respective positions of the route board 206. Each lighting device 120 presents a lighting effect. FIG. 3 is a perspective view of the lighting device 120. FIG. 4 is an exploded view the lighting device 120. FIG. 5 is a sectional view of the lighting device 120 taken along a line A-A'.

As shown in FIGS. 3 and 4, the lighting device 120 includes: an LED unit 124 provided with an LED 135 (light-emitting diode); a housing 123; a sealing plate 122; and a cover 121 (cover).

First, the LED unit 124 is provided with the light-emitting diode 135 (referred to as LED 135) acting as a light source of the LED unit. The LED unit 124 has a hole 137 by which the unit 124 is screwed onto the later-mentioned housing 123. Typically, the LED 135 is used in a form of a packaged LED device such as a lens-type LED or a SMD type (surface mount type) LED. The LED device contains an LED which emits light of a color suited for a purpose (e.g., blue, red, green or the like). The LED unit 124 is connected to a not-shown power source. Meanwhile, an LED device containing several LEDs may be used. In that case, different types of LEDs may be used in combination, as well as combination of the same type of LEDs. For example, it is possible to use a white light LED device, or multi color or full color LED device structured by combining LEDs which emit red light, green light, and blue light (primary colors of light), respectively.

In addition, as a white light LED device, it is possible to use an LED device in which white light is produced by mixing light from an LED with light from a phosphor excited by the light from the LED. As an example of the above LED device, there is an LED device using a bluish LED and a phosphor which emits yellowish to yellow-greenish light excited by the light emitted from the bluish LED.

Here, the type of phosphor is not particularly limited, and both organic phosphor and inorganic phosphor may be used. The use of organic phosphor produces shiny illuminating light. On the other hand, the use of inorganic phosphor allows dull illuminating light to be produced. It is possible to use phosphors which emit various colors of light respectively. For example, as well as red-emitting, green-emitting, and blue-emitting phosphors (primary colors of light), a phosphor which emits an intermediate color among these colors may be used. Further, several types of phosphors may be used in combination. For example, a reddish phosphor, a greenish phosphor, and a bluish phosphor may be used in combination.

The housing 123 (housing) is a frame body made of metal, which has a square shape when viewed from the front. One side of the housing 123 is open (hereinafter "opening 136"). The housing 123 is capable of containing therein the LED unit 124, and is provided with a reflector 134 (reflector) which curves inward (toward a side opposite to the opening 136) to form a recess shape. Reflection face of the reflector 134 is constituted by more than one areas having different reflection angles respectively. The opening 136 has engagement portions 131A, 131B, 131C, and 131D provided at the sides of the opening. The engagement portions are for engaging, with the housing 123, the sealing plate 122 which seals the opening 136. In addition, on a face opposite to the opening 136 of the housing 123, there is provided a hole 133 to which the LED unit 124 is attached.

Next, the sealing plate 122 (sealing member) is made of transparent acrylic and has a square shape such that the plate 122 is able to seal the opening 136 of the housing 123. At a peripheral edge of the sealing plate 122, an engagement portion 128 is formed which is to be engaged with the engagement portion 131C. Based on the engagement between the engagement portion 128 and the engagement portion 131C, the sealing plate 122 is fitted to the housing 123 so that the outer circumference of the sealing plate 122 conforms to the inner circumference of the opening 136. The engagement portions 131A, 131B, and 131D are respectively engaged with portions of the outer circumference of the sealing plate 122 which respectively correspond to the engagement portions 131A, 131B, and 131D, and as a result, the sealing plate 122 is fixed to the housing 123. In addition, the sealing plate 122 has engagement holes 129 and 130 through which the cover 121 (described later) is engaged with and fixed to the central portion of the sealing plate 122.

Next, the cover 121 is made of translucent polycarbonate, and has a shape of a hollow hemisphere. At one position in a peripheral edge of the cover 121, there is provided a hook 127 which is hooked in the before-mentioned engagement hole 130 of the sealing plate 122 to achieve engagement there between. At another position in the peripheral edge of the cover 121, which position is opposite to the hook 127, a hook 126 is provided. The hook 126 is hooked in the before-mentioned engagement hole 129 of the sealing plate 122 to achieve engagement there between. Note that in this embodiment, the cover has a hemispherical shape, however, the cover may have a bowl-shape, a substantially sector-shape in cross section, or a projected shape in a sectional view.

As shown in FIG. 3, the cover 121 is positioned near a light emitting portion of the LED 135. Preferably, as shown in FIG. 5, the cover 121 having enough size is positioned over the light emitting portion of the LED 135 so that the cover 121 can receive substantially all of the light emitted from the LED 135.

The cover 121 is made from polycarbonate which is translucent with regard to the light from the LED 135. Note that, "translucent with regard to the light from the LED 135" does not mean that the cover 121 is capable of transmitting all the introduced light without loss. In other words, the cover 121 may be made from a material which absorbs or blocks a portion of the light from the LED 135. For example, as a material of the cover 121, it is possible to use, silicone rubber, silicone resin, acrylic resin, polyethylene terephthalate (PET), epoxy resin, glass, or the like.

The cover 121 has an inner face which receives light from the LED 135, and an outer face which radiates the introduced light to outside. Onto the entire outer face of the cover 121, aluminum (metal layer) is vapor-deposited so that the deposited aluminum layer is thickest at a most outward portion of the cover 121. In this embodiment, aluminum is vapor-deposited onto the outer face of the cover 121, however, it is not limited to the outer face. Aluminum may be vapor-deposited onto the inner face, or both of the inner face and the outer face. The way to vapor-deposit aluminum onto the cover 121 will be described later. In this embodiment, there is provided the following feature. The translucency percentage of light is lowest at the most outward portion (intersection point of an optical axis of light and the cover 121), and the percentage increases with the distance from the most outward portion, since the metal layer of aluminum is vapor-deposited onto the cover 121 so that the deposited aluminum layer is thickest at the most outward portion of the cover 121 having a hemispherical shape. Due to the metal layer of aluminum, at the most outward portion which receives a largest amount of light and has the lowest translucency percentage, the amount of light emitted from the cover 121 to outside is decreased to a small amount; while at another portion which receives a small amount of light and has a high translucency percentage, most of the received light is transmitted to the outside. Accordingly, even if the light emitted from the LED 135 has high directivity, unevenness in the amount of light is smoothed as a whole and thus obtained light is emitted from the cover 121 to outside. As a result, it is possible to provide illuminating light similar to a light bulb by blurring high-directivity light emitted from the LED 135.

With reference to FIG. 5, operation of the lighting device 120 will be hereinafter described. FIG. 5 is a sectional view of the lighting device 120 taken along a line A-A'. Upon turning on the lighting device 120, most of the light emitted from the LED 135 of the lighting device 120 travels toward the cover 121 as indicated by solid-line arrows B in FIG. 5, and some portion of the light passes through the cover 121 and lights the space ahead of the cover 121. Another portion of the light is reflected by the cover 121 as indicated by solid-line arrows C in FIG. 5, and travels toward the reflector 134. Then, the light is reflected by the reflector 134 in a forward direction, i.e., toward the cover 121, as indicated by solid-line arrows D in FIG. 5. Then, a portion of the light reflected by the reflector 134 passes through the cover 121, and lights the space ahead of the cover 121. Here, the lighted area ahead of the cover 121 is defined by the tilt angle of the cover 121 and the tilt angles of the reflection faces of the reflector 134, respectively.

According to the above structure, when light emitted from the LED 135 passes through the cover 121 having aluminum vapor-deposited thereonto, the amount of the light is decreased to a predetermined amount. Thus, the amount of light from the LED 135 can be decreased thereby providing the amount of light similar to that of a light bulb. Also, it is possible to set the translucency percentage freely by varying the thickness of aluminum layer vapor-deposited onto the cover 121. Thus, the amount of light from the LED 135 can be adjusted, thereby providing the amount of light similar to that of a light bulb.

In addition, since the cover is made of polycarbonate, it is possible to achieve high heat resistance and reduction in weight of the cover 121 of the lighting device 120.

Furthermore, the lighting device 120 includes the reflector 134. When light emitted from the LED 135 is irradiated to the cover 121 having aluminum vapor-deposited thereonto, some portion of the light passes through the cover 121 and another portion of the light is reflected by the cover 121. Then, the reflected light is further reflected by the several areas having different reflection angle respectively, which areas are formed on the reflector 134 curving inward to form a recess shape. As a result, the reflected light is irradiated to the cover 121 again. Some portion of the irradiated light passes through the cover 121, and the other portion of the light is reflected. Repeating this operation allows the light from the LED 135 to be irradiated all over the cover 121 concentratedly, and therefore the light can be collected onto the cover 121. Accordingly, it is possible to emit, from the cover 121, illuminating light like light of a light bulb.

In addition, since the lighting device is provided with the housing 123 and the sealing plate 122, the lighting device is capable of disposing the LED 135 and the reflector 134 in the housing 123, and sealing the opening with the sealing plate 122. With this arrangement, it is possible to prevent a foreign matter from entering from outside, which may cause a variation in reflectivity of the reflector 134 and a failure of the LED 135.

[Vapor Deposition Method]

Figure 6:
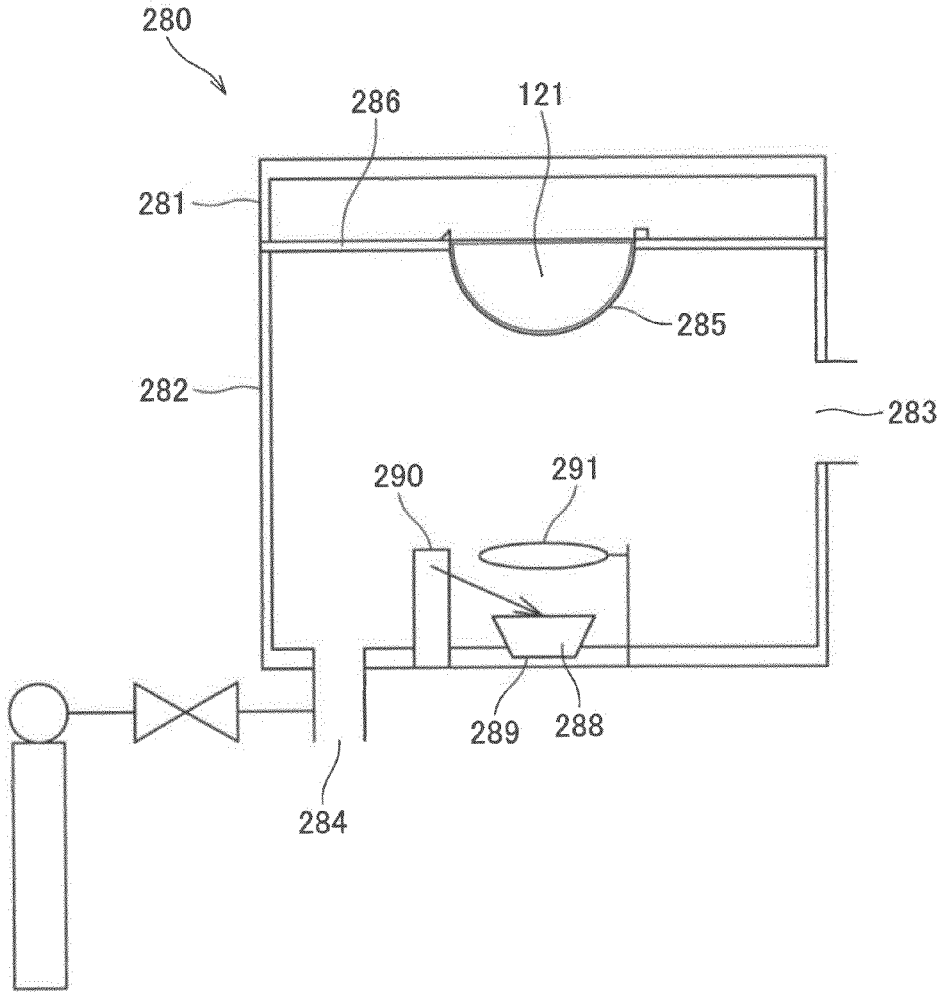
FIG. 6 is an explanatory view showing a structure of a vacuum vapor-deposition apparatus.

The followings describe the method for vapor-depositing aluminum onto the cover 121. FIG. 6 shows the structure of a vacuum vapor-deposition apparatus 280. In FIG. 6, the vacuum vapor-deposition apparatus 280 includes: a vacuum chamber 282 constituted by a gastight container; a vacuum chamber lid 281 which gastightly closes the vacuum chamber 282; a gas outlet 283 which is connected to an exhaust device such as a not-shown vacuum pump and through which gas is evacuated from the vacuum chamber 282; a gas inlet 284 thorough which any gas such as a discharge gas (e.g., argon (Ar), oxygen ($O_2$), or the like) and a process gas is introduced into the vacuum chamber 282; a base supporting plate 286 which supports the cover 121 that is subject of layer formation; crucibles 289 to be filled with aluminum 288 that is an deposition material; electron gun 290 for heating aluminum 288 in the crucibles 289 to its evaporation temperature by colliding electron beam with the aluminum 288, and an openable shutter 291 which is closed before and after vapor-deposition operation to block the aluminum 288. For the convenience of explanation, the gas outlet 283 and the gas inlet 284, and various types of valves, pumps, or the like connected to the outlet 283 and the inlet 284 are collectively referred to as gas intake/exhaust means.

Next, vapor deposition process will be described. The process can be roughly divided into two stages of: (i) a pre-layer formation stage which is a stage before the start of vapor-deposition operation, and (ii) a layer formation stage which is a stage after the start of the vapor-deposition operation. The pre-layer formation stage includes a preparation step, an atmosphere adjustment step, a melting step, and the like.

In the preparation step, the cover 121 is mounted on the base supporting plate 286, and the crucibles 289 are filled with aluminum 288, which is to be a metal layer vapor-deposited onto the outer face of the cover 121. Then, the vacuum chamber 282 is gastightly closed with the vacuum chamber lid 281. It is necessary to reserve, in the vacuum chamber 282, a certain amount of aluminum 288 required for layer formation. Therefore a deposition material supplying mechanism is provided which successively supplies aluminum 288 to the crucibles 289. Although not shown, the vacuum vapor-deposition apparatus 280 includes: more than one crucibles 289 each having aluminum 288 filled therein; and the deposition material supplying mechanism, so that the vacuum vapor-deposition apparatus 280 successively supplies aluminum 288 to the crucibles 289.

In the atmosphere adjustment step, the vacuum chamber 282 is evacuated through the outlet 283 to achieve a high vacuum.

In the melting step, with the shutter 291 being closed, an electron beam is irradiated from the electron gun 290 to aluminum 288 in the crucibles 289 to melt down the aluminum 288. The melting step is a step of thermally melting granular aluminum 288, as a preparation for the layer formation stage. Melting aluminum in advance provides advantageous effects. For example, it is possible to eliminate, prior to layer formation, water, gas, or an entered impurity, which are adsorbed by the deposition material, and to prevent bumping from occurring at a time of layer formation. In the vacuum vapor-deposition apparatus 280, by operating the not-shown deposition material supplying mechanism, the crucibles 289 are supplied to/removed from a position of a vapor-deposition source, one after another. The melting step ends when melting down of the aluminum 288 filled in the crucibles 289 is completely finished.

After the melting step, the layer formation stage is started. In an atmosphere adjustment step, first, a gas such as Ar and $O_2$ is introduced into the vacuum chamber 282 through the gas inlet 284, and a predetermined layer formation atmosphere is achieved and maintained in the vacuum chamber. Parallel to this step, aluminum 288 is thermally melted in a layer formation preparation step. In this step, aluminum 288 which was melted down and then solidified is heated until the evaporated aluminum necessary for layer formation is obtained. An electron beam is irradiated from the electron gun 290 to the aluminum 288 in the crucibles 289, with the shutter 291 being closed. After the predetermined layer formation atmosphere is achieved in the vacuum chamber 282 and the aluminum is heated until the predetermined evaporation is obtained, layer formation step is performed. In this step, the shutter 291 is opened, so that the aluminum 288 is scattered in the vacuum chamber 282 and deposited onto the cover 121, and as a result a metal layer of aluminum is formed.

In the above structure, high-reflective aluminum is adopted as a metal layer which is vapor-deposited onto the cover 121, and therefore, the cover 121 which receives light emitted from the LED 135 has high reflectivity. Due to the this, at the most outward portion which receives a largest amount of light, the aluminum layer has highest reflectivity, so that the amount of light emitted from the cover 121 to outside is decreased to a small amount; while at another portion which receives a small amount of light and has a low reflectivity, most of the received light is transmitted to the outside. Accordingly, even if the light emitted from the LED 135 has high directivity, unevenness in the amount of light is smoothed as a whole and thus obtained light is emitted from the cover 121 to outside. As a result, it is possible to provide illuminating light similar to a light bulb by blurring high-directivity light emitted from the LED 135.

[Electrical Structure of Slot Machine]

Figure 7:
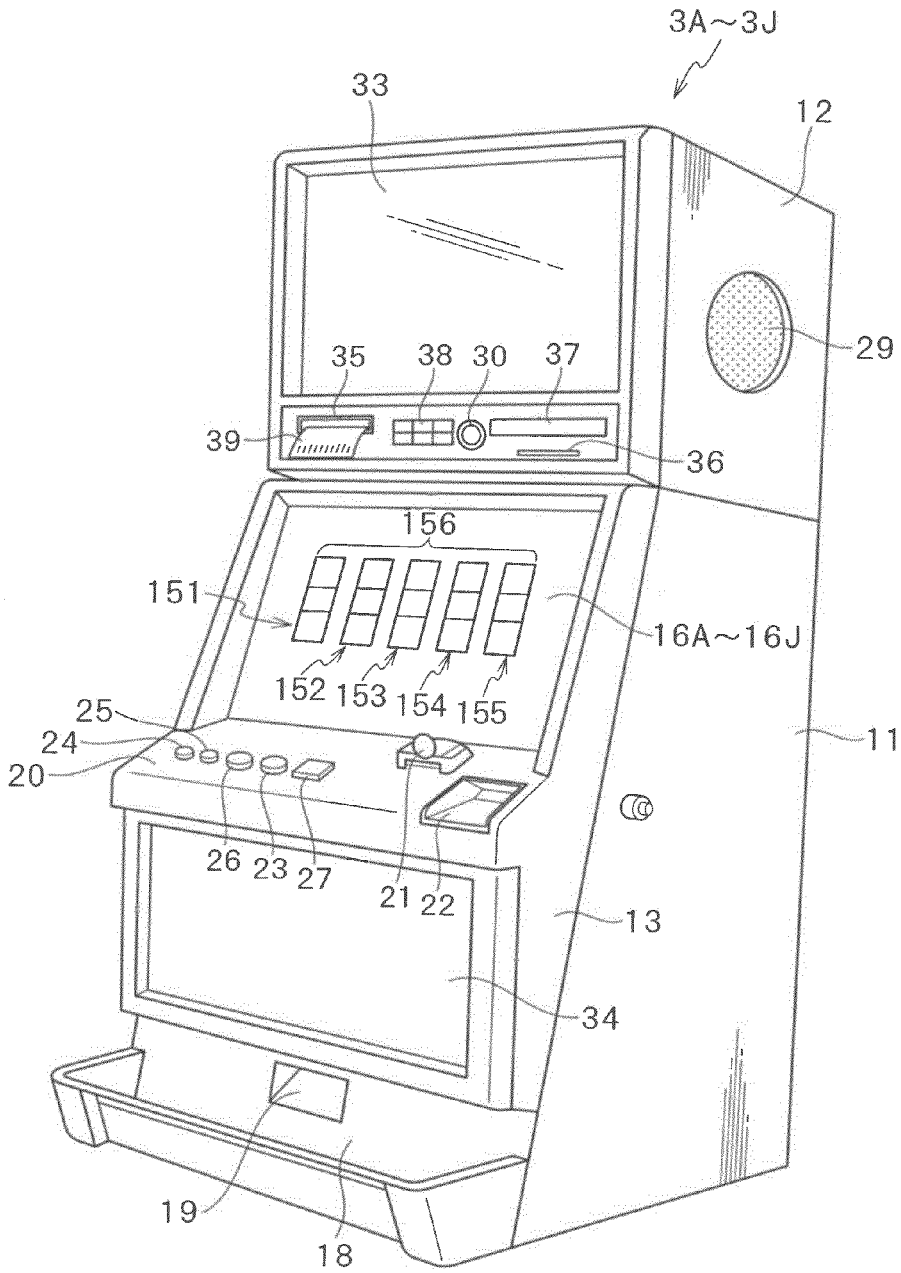
FIG. 7 is a perspective view showing an external appearance of a slot machine.

As shown in FIG. 7, the slot machine (3A to 3J) has a cabinet 11, a top box 12 placed on an upper side of the cabinet 11, and a main door 13 provided on a front surface of the cabinet 11. To the main door 13, a lower image display panel (16A to 16J) is provided. The lower image display panel (16A to 16J) has a transparent liquid crystal panel which displays various information. In addition, the lower image display panel (16A to 16J) displays thereon display windows 151 to 155 (a matrix 156) where more than one symbols 180 are arranged, and displays game-related various information, an effect image, and the like, as needed.

Here, "arranging" means making a state where symbols 180 are visibly identifiable by a player. For example, in FIG. 13, it means making a state where symbols 180 are displayed in the display windows 151 to 155. Arranging symbols 180 again after dismissing symbols 180 is called "rearranging".

This embodiment deals with, as an example, a case where each of the lower image display panel (16A to 16J) electrically displays symbols 180 to thereby display five columns and three rows of symbols. However, the present invention is not limited thereto. For example, three columns and three rows of symbols, or five columns and five rows of symbols, may be acceptable.

In this embodiment, symbols 180 arranged in the display windows 151 to 155 are scatter symbols. Here, scatter symbols mean such symbols that activation occurs (i.e., a payout is awarded, a bonus game is given, or the like) when a predetermined number of them stop in the matrix of arrangement regions made up of the five columns and three rows of the display windows 151 to 155. For example, in a base game where scatter symbols are adopted, a payout is awarded when a predetermined number (e.g., five or more) of scatter symbols are displayed in the display windows 151 to 155 (fifteen arrangement regions). That is, when a predetermined number of scatter symbols are displayed in the display windows 151 to 155, a payout is awarded regardless of display positions or an arrangement way of the scatter symbols.

Note that the lower image display panel (16A to 16J) may have a credit value indicator and a payout value indicator. The credit value indicator displays a total value (hereinafter also referred to as total credit value) which the slot machine (3A to 3J) can pay out to a player. The payout value indicator displays the number of coins to be paid out.

Below the lower image display panel (16A to 16J), provided are a control panel 20, a coin receiving slot 21, and a bill validator 22. The control panel 20 is provided with buttons 23 to 27. These buttons 23 to 27 allow a player to input commands relating to a game progress. The coin receiving slot 21 enables coins to be received into the cabinet 11.

The control panel 20 includes a spin button 23, a change button 24, a cashout button 25, a 1-BET button 26, and a MAX-BET button 27. The spin button 23 is for inputting a command to start scrolling the symbols 180. The change button 24 is used to ask a staff person of the gaming facility for money exchange. The cash out button 25 is for inputting a command to pay out coins corresponding to the total credit-value into a coin tray 18.

The 1-BET button 26 is for inputting a command to bet, on a game, one coin among coins corresponding to the total credit value. The MAX-BET button 27 is for inputting a command to bet, on a game, the maximum number of coins bettable on one game (e.g., fifty coins) among coins corresponding to the total credit value.

The bill validator 22 validates whether a bill is genuine or not and receives the genuine bill into the cabinet 11. Note that the bill validator 22 is capable of reading a barcoded ticket 39 which will be described later. When the bill validator 22 reads the barcoded ticket 39, the bill validator 22 outputs to the main CPU 41 a read signal relating to what has been read.

On a front surface of a lower part of the main door 13, that is, below the control panel 20, a belly glass 34 is provided. On the belly glass 34, a character of the slot machine (3A to 3J), or the like is drawn. On a front surface of the top box 12 is provided an upper image display panel 33. The upper image display panel 33 has a liquid crystal panel, and displays an effect image, an image representing game introduction or game rules, or the like.

Further, the top box 12 has a lamp 30 for presenting an effect, and a speaker 29 for performing an audio output. Below the upper image display panel 33 are provided a ticket printer 35, a card reader 36, a data displayer 37, and a keypad 38. The ticket printer 35 prints, on to a ticket, a barcode which is an encoded form of data such as a credit-value, time and date, identification number of the slot machine (3A to 3J), and the like. As a result, the ticket printer 35 issues a barcoded ticket 39. A player can play a game in another slot machine (3A to 3J) using the barcoded ticket 39, or can exchange the barcoded ticket 39 with a bill or the like at a change booth of the gaming facility.

The card reader 36 reads and writes data from and into a smart card. The smart card is carried by a player, and stores therein data for identifying the player and data relating to a history of games played by the player, for example.

The data displayer 37 includes a fluorescent display or the like, and displays the data read by the card reader 36 and the data input by the player through the keypad 38, for example. The keypad 38 is for entering a command or data relating to issuing of a ticket.

[Electrical Structure of Game System]

Figure 8:
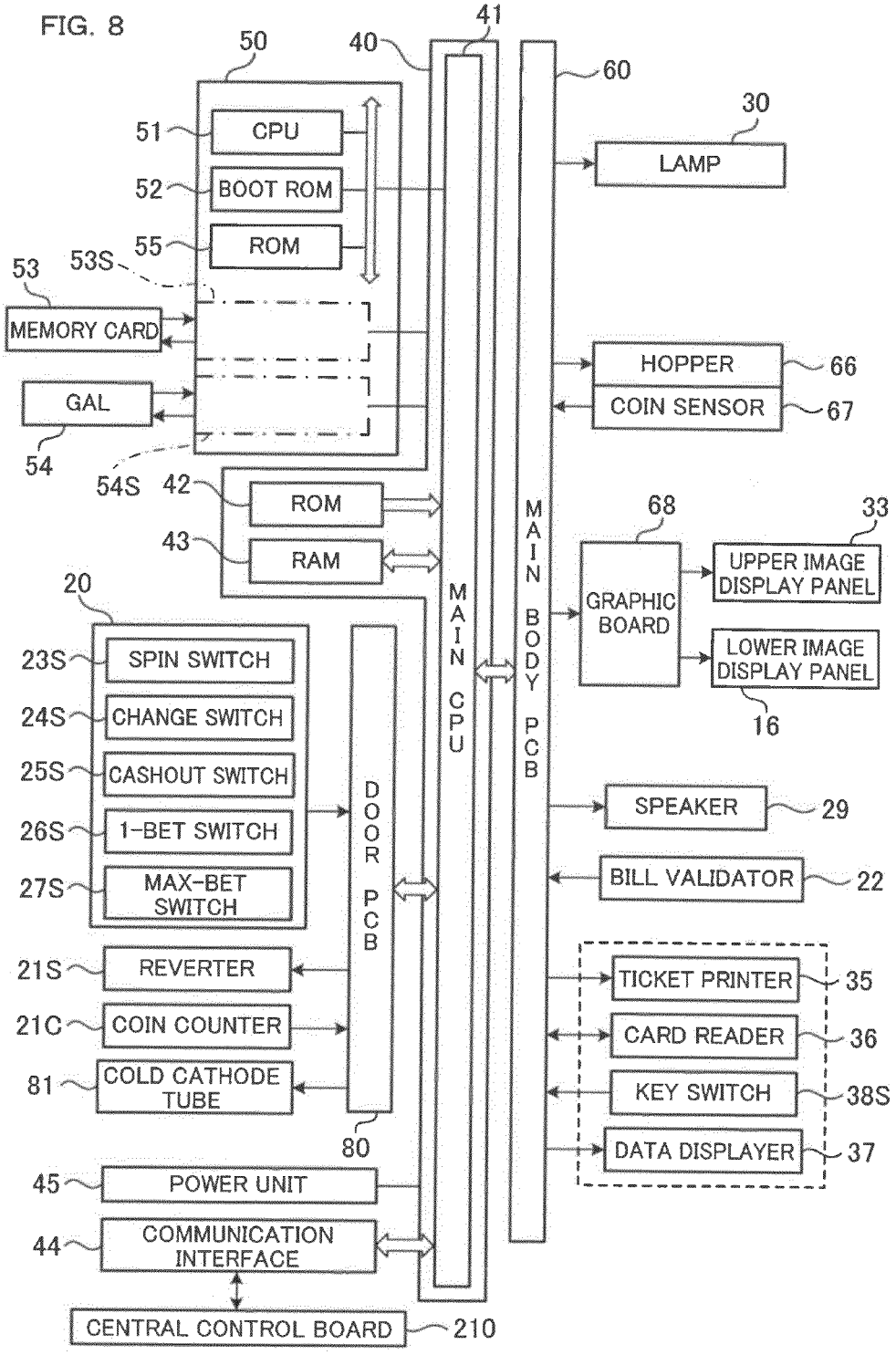
FIG. 8 is a block diagram showing an electrical structure of the slot machine.
Figure 12:
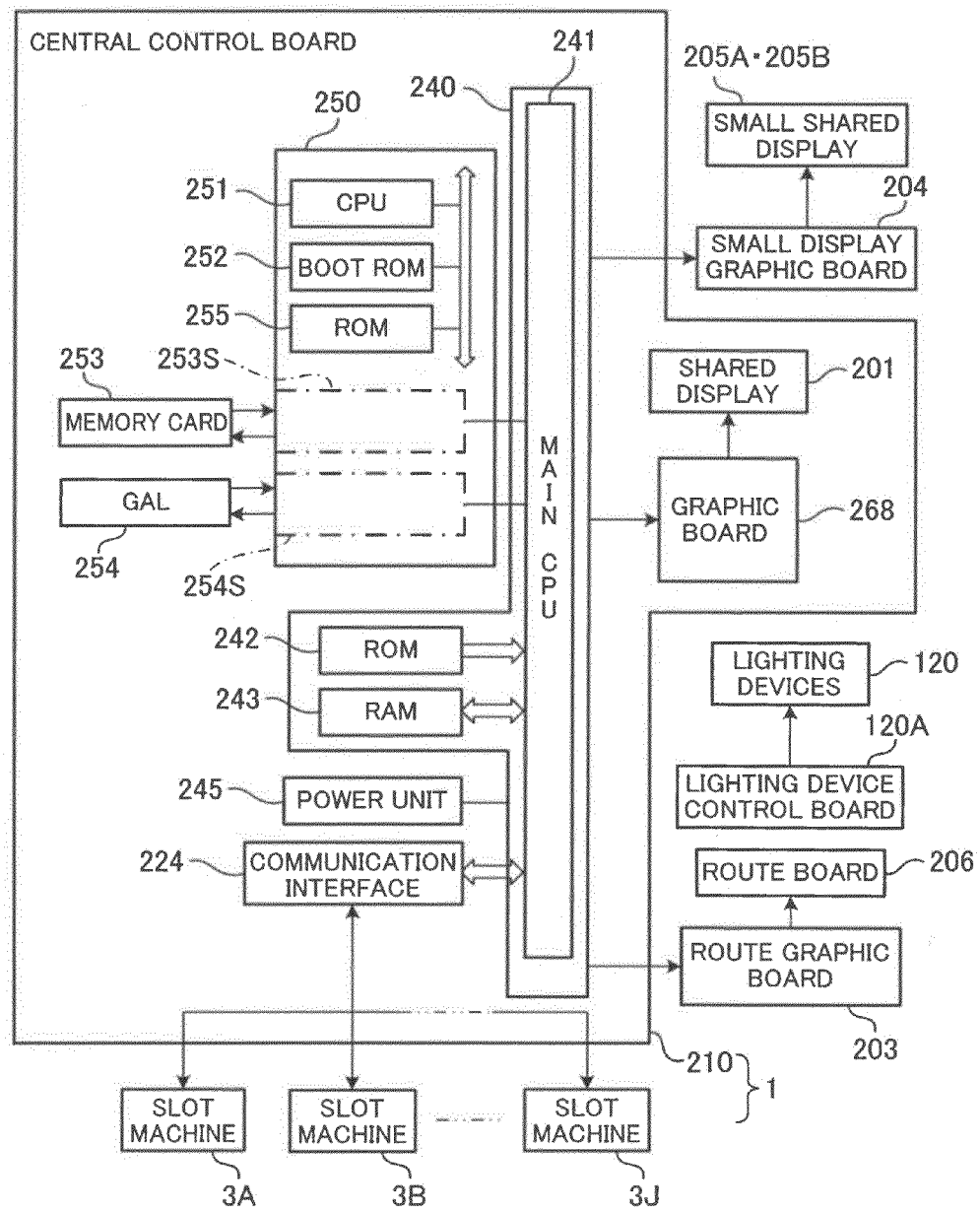
FIG. 12 is a block diagram showing an electrical structure of a central control board.

FIGS. 8 and 12 are block diagrams showing the electrical structure of the entire game system 1.

[Electrical Structure of Slot Machine]

FIG. 8 is a block diagram showing an electrical structure of the slot machine (3A to 3J). A control unit is provided within the cabinet 11. As illustrated in FIG. 8, the control unit includes a motherboard 40, a main body PCB (Printed Circuit Board) 60, a gaming board 50, a door PCB 80, various switches, sensors, or the like.

The gaming board 50 has a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code numbers corresponding to the symbols) to be stopped on the matrix 156.

This stop symbol determining program may contain sets of symbol weighting data respectively corresponding to various payout rates (e.g., 80%, 84%, and 88%). Each set of the symbol weighting data indicates, for each of the display windows 151 to 155, correspondence between a code number of each symbol column (symbol lines A to E) and at least one random number value belonging to a predetermined range. The payout rate is determined based on payout rate setting data output from the GAL 54. Based on a set of the symbol weighting data corresponding to the payout rate determined, symbols to be stopped are determined.

The memory card 53 stores therein various types of data for use in the game program and the game system program. For example, the memory card 53 stores data indicating correspondence between each of symbols 180 displayed in the display windows 151 to 155 and a range of random number values, in the form of a base game winning combination lottery table 160 (see FIG. 9). The memory card 53 also stores payout data which are based on a lottery result obtained from the base game winning combination lottery table 160, in the form of a base game payout table 161 (see FIG. 10). In addition, the memory card 53 stores, in the form of jackpot point table 162 (see FIG. 11), data indicating correspondence between the number of symbols of "SUN" 181 which are displayed in the display windows 151 to 155 in a jackpot game and the number of points to be obtained. These sets of data are transferred to a RAM 43 of the motherboard 40, at the time of running a game.

The card slot 53S is structured so as to allow the memory card 53 to be attached and detached to and from the card slot 53S. This card slot 53S is connected to the motherboard 40 through an IDE bus. Thus, a type and contents of a game run at the slot machine (3A to 3J) can be changed by detaching the memory card 53 from the card slot 53S, writing a different game program and a different game system program into the memory card 53, and inserting the memory card 53 back into the card slot 53S.

The game program includes a program relating to a game progress. The game program also includes data of images and sounds to be output during a game.

The GAL 54 has input and output ports. When the GAL 54 receives data via the input port, it outputs, from its output port, data corresponding to the input data.

The IC socket 54S is structured so as to allow the GAL 54 to be attached and detached to and from the IC socket 54S. The IC socket 54S is connected to the motherboard 40, via a PCI bus. Thus, data to be output from the GAL 54 can be changed by detaching the GAL 54 from the IC socket 54S, overwriting the program stored in the GAL 54, and then attaching the GAL 54 back to the IC socket 54S.

The CPU 51, the ROM 55, and the boot ROM 52 connected to one another through the internal bus are connected to the motherboard 40 through a PCI bus. The PCI bus communicates signals between the motherboard 40 and the gaming board 50, and supplies power from the motherboard 40 to the gaming board 50. The ROM 55 stores country identification information and an authentication program. The boot ROM 52 stores a preliminary authentication program, a program (boot code) for enabling the CPU 51 to run the preliminary authentication program, and the like.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified, that is, for authenticating the authentication program.

The motherboard 40 has the main CPU 41, a ROM (Read Only Memory) 42, a RAM (Random Access Memory) 43, and a communication interface 44.

The main CPU 41 has a function of entirely controlling the slot machine (3A to 3J). In particular, the main CPU 41 controls the following operations of: outputting a command signal for making the graphic board 68 variably display symbols 180, at a time when the spin button 23 is pressed after betting of credit; determining symbols 180 to be stopped after the variable-displaying of symbols 180; and stopping the symbols 180 thus determined in the display windows 151 to 155.

In other words, the main CPU 41 serves to control arrangement, by scrolling symbols displayed on the lower image display panel (16A to 16J), then selecting and determining symbols to be rearranged from various kinds of symbols, to rearrange new symbols, and stopping scrolling of the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized, and the game program and the game system program stored in the memory card 53 are read out through the gaming board 50. The RAM 43 stores data or a program used for the main CPU 41 to perform a process. For example, the base game winning combination lottery table 160, the base game payout table 161, the jackpot point table 162, a game running processing program, and a terminal side jackpot game running processing program are stored in the RAM 43. In addition, a credit value is stored in the RAM 43.

The communication interface 44 communicates with a central control board 210 through a communication line. Further, a main body PCB (Printed Circuit Board) 60 and a door PCB 80 are connected to the motherboard 40, respectively through USBs (Universal Serial Buses). Further, a power unit 45 is connected to the motherboard 40. When the power unit 45 supplies power to the motherboard 40, the main CPU 41 of the mother board 40 is booted and in addition power is supplied to the gaming board 50 through the PCI bus so that the CPU 51 is booted.

Various devices or units which generate signals to be input to the main CPU 41, and various devices or units whose operations are controlled by signals output from the main CPU 41 are connected to the main body PCB 60 and the door PCB 80. Based on a signal input to the main CPU 41, the main CPU 41 runs the game program and the game system program stored in the RAM 43, to perform an arithmetic process. Then, the main CPU 41 stores a result of the arithmetic process in the RAM 43, or performs a control process on various devices and units by transmitting a control signal to the various devices and units.

A lamp 30, a hopper 66, a coin sensor 67, a graphic board 68, the speaker 29, a bill validator 22, a ticket printer 35, a card reader 36, a key switch 38S, and a data displayer 37 are connected to main body PCB 60.

The lamp 30 is turned on/off based on a control signal output from the main CPU 41.

The hopper 66 is mounted within the cabinet 11 and pays out a predetermined number of coins through a coin outlet 19 into the coin tray 18, based on a control signal output from the main CPU 41. The coin sensor 67 is provided inside the coin outlet 19. When the coin sensor 67 senses that a predetermined number of coins have been delivered from the coin outlet 19, the coin sensor 67 outputs a signal to be input to the main CPU 41.

The graphic board 68 controls image display on the upper image display panel 33 and the lower image display panel (16A to 16J), based on a control signal from the main CPU 41. Further, the graphic board 68 is provided with a VDP (Video Display Processor) for generating image data based on a control signal output from the main CPU 41, a video RAM for temporarily storing the image data generated by the VDP, and the like. Note that image data used at the time when the VDP generates the image data are included in the game program which has been read out from the memory card 53 and stored into the RAM 43.

The bill validator 22 reads an image on a bill and takes only one recognized to be genuine into the cabinet 11. When taking in a genuine bill, the bill validator 22 outputs, to the main CPU 41, an input signal based on a value of the bill. The main CPU 41 stores into the RAM 43 a credit value equivalent to the value of the bill indicated by the input signal.

Based on a control signal output from the main CPU 41, the ticket printer 35 prints a barcode on a ticket, and outputs it as a barcoded ticket 39. The barcode contains encoded data of the credit value stored in the RAM 43, time and date, an identification number of the slot machine (3A to 3J), and the like.

The card reader 36 reads out data from the smart card and transmits the data to the main CPU 41. Further, the card reader 36 writes data into the smart card based on a control signal output from the main CPU 41. The key switch 38S is mounted to the keypad 38, and outputs a signal to the main CPU 41 in response to a player's operation on the keypad 38. The data displayer 37 displays, based on a control signal output from the main CPU 41, data read by the card reader 36 or data input by the player through the key pad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a MAX-BET switch 27S associated with the MAX-BET button 27. Each of the switches 23S to 27S outputs a signal to the main CPU 41, when a player presses the associated button.

The coin counter 21C is provided within the coin receiving slot 21, and identifies whether a coin inserted into the coin receiving slot 21 by the player is genuine. A coin other than a genuine coin is discharged from the coin outlet 19. The coin counter 21C outputs an input signal to the main CPU 41 upon detection of a genuine coin.

The reverter 21S is operated based on a control signal output from the main CPU 41. The reverter 21S distributes a coin, which the coin counter 21C has recognized as a genuine coin, to the hopper 66 or a cash box (not shown) mounted in the slot machine (3A to 3J). In other words, when the hopper 66 is full of coins, a genuine coin is distributed into the cash box by the reverter 21S. On the other hand, when the hopper 66 is not yet full of coins, a genuine coin is distributed into the hopper 66. The cold cathode tube 81 functions as a backlight mounted to the rear side of the lower image display panel (16A to 16J) and the rear side of the upper image display panel 33. The cold cathode tube 81 turns on based on a control signal output from the main CPU 41.

[Base Game Winning Combination Lottery Table]

A base game winning combination lottery table 160 which is used in a game running process executed at the slot machine (3A to 3J) will be described with reference to FIG. 9. FIG. 9 is an explanatory view showing a base game winning combination lottery table. The base game winning combination lottery table 160 is stored in the RAM 43, and read during a symbol determining process of the game running process which will be described later.

As shown in FIG. 9, random number values used in the base game winning combination lottery table 160 range from 0 to 5998. When a random number value sampled by the main CPU 41 is 0 to 29, a winning combination of "SUN" 181 is made. Then, five symbols 180 of "SUN" 181 are stopped in the display windows 151 to 155. When a random number value sampled by the main CPU 41 is 30 to 51, a winning combination of "HEART" 182 is made. Then, five symbols 180 of "HEART" 182 are stopped in the display windows 151 to 155. When a random number value sampled by the main CPU 41 is 52 to 107, a winning combination of "MOON" 183 is made. Then, five symbols 180 of "MOON" 183 are stopped in the display windows 151 to 155. Likewise, when a random number value is 108 to 207, a winning combination of "K" 186 is made. When a random number value is 208 to 407, a winning combination of "A" 184 is made. When a random number value is 408 to 807, a winning combination of "Q" 187 is made. When a random number value is 808 to 1477, a winning combination of "J" 185 is made. When a random number value is 1478 to 1807, a winning combination of "10" 188 is made. When a random number value sampled by the main CPU 41 is 1808 to 5998, it means a loss, and a losing combination of symbols 180, which is different from any of the above-mentioned winning combinations, is stopped in the display windows 151 to 155. Here, making any of these winning combinations means that a winning combination is achieved.

[Base Game Payout Table]

Next, a base game payout table 161 will be described with reference to FIG. 10. The base game payout table 161 indicates the number of coins to be paid out for a winning combination determined using the base game winning combination lottery table 160 shown in FIG. 9. FIG. 10 shows a base game payout table. The base game payout table 161 is stored in the RAM 43, and is read during a base game payout process of the game running process which will be described later.

For a result of sampling using the base game winning combination lottery table 160, zero or more coins are paid out in accordance with a winning combination displayed in the display windows 151 to 155, based on the base game payout table 131.

More specifically, when five symbols 180 of "SUN" 181 are stopped in the display windows 151 to 155, seventy coins are paid out. When five symbols 180 of "HEART" 182 are stopped in the display windows 151 to 155, fifty coins are paid out. When five symbols 180 of "MOON" 183 are stopped in the display windows 151 to 155, thirty coins are paid out as a payout. Likewise, when five symbols 180 of "K" 186 are stopped in the display windows 151 to 155, twenty-five coins are paid out as a payout. When five symbols 180 of "A" 184 are stopped in the display windows 151 to 155, twenty coins are paid out as a payout. When five symbols 180 of "Q" 187 are stopped in the display windows 151 to 155, fifteen coins are paid out as a payout. When five symbols 180 of "J" 185 are stopped in the display windows 151 to 155, ten coins are paid out as a payout. When five symbols 180 of "10" 188 are stopped in the display windows 151 to 155, five coins are paid out as a payout. When a lottery results in losing, and a losing combination of symbols 180, which is different from any of the above-mentioned winning combinations, is stopped in the display windows 151 to 155, zero coin is paid out as a payout. Note that, when one coin is inserted for a game, the above-mentioned number of coins are paid out as a payout. When two or more coins are inserted for one game, the number of coins actually paid out is calculated by multiplying the number of inserted coins by each of the above-mentioned numbers of coins paid out.

[Jackpot Point Table]

With reference to FIG. 11, the following describes a jackpot point table 162 which is referred to in a jackpot game. The jackpot point table 162 is a table showing the number of points to be awarded to a player, at a time of execution of a jackpot game, in accordance with the number of jackpot point symbols ("SUN" 181) displayed in the display windows 151 to 155. FIG. 11 shows the jackpot point table. The jackpot point table 162 is stored in the RAM 43, and is read during a terminal side jackpot game running process which will be described later. In the meantime, the total number of points awarded to each of the slot machines 3A to 3J is indicated by the number of light-emitting LEDs disposed on a corresponding route out of the routes 207A to 207J.

Specifically, when the total number of jackpot point symbols ("SUN" 181) displayed in the display windows 151 to 155 at a time of execution of a jackpot game is zero, zero point is obtained. When the total number of jackpot point symbols ("SUN" 181) is one, one point is obtained. When the total number of jackpot point symbols ("SUN" 181) is two, two points are obtained. When the total number of jackpot point symbols ("SUN" 181) is three, three points are obtained. When the total number of jackpot point symbols ("SUN" 181) is four, four points are obtained. When the total number of jackpot point symbols ("SUN" 181) is five, five points are obtained. When the total number of jackpot point symbols ("SUN" 181) is six, six points are obtained. When the total number of jackpot point symbols ("SUN" 181) is seven, seven points are obtained. When the total number of jackpot point symbols ("SUN" 181) is eight, eight points are obtained. When the total number of jackpot point symbols ("SUN" 181) is nine, nine points are obtained.

[Electrical Structure of Central Control Board]

FIG. 12 is a block diagram showing an electrical structure of the central control board 210. A control unit is provided within the central control board 210. As shown in FIG. 12, the control unit includes a motherboard 240, a gaming board 250, an actuator, and the like.

The gaming board 250 has a CPU (Central Processing Unit) 251, a ROM 255, a boot ROM 252, a card slot 253S corresponding to a memory card 253, and an IC socket 254S corresponding to a GAL (Generic Array Logic) 254. The CPU 251, the ROM 255, and the boot ROM 252 are connected to one another through an internal bus. In other words, the gaming board 250 has the same structure and the same functions as those of the gaming board 50.

The motherboard 240 includes: a main CPU 241, a ROM (Read Only Memory) 242, a RAM (Random Access Memory) 243, a power unit 245, a graphic board 268, a shared display 201 connected to the graphic board 268, a route graphic board 203, a route board 206 connected to the route graphic board 203, a small display graphic board 204, the small shared displays 205A and 205B each connected to the small display graphic board 204, lighting device control board 120A, a group of lighting devices 120 connected to the lighting device control board 120A, and a communication interface 224. The RAM 243 stores therein a center side jackpot game running processing program. The RAM 243 also stores therein an accumulated value resulting from accumulative calculation of a percentage of an amount bet at the slot machine (3A to 3J) (jackpot credit information).

The shared display 201 displays thereon an image indicating an accumulated value resulting from accumulative calculation of a percentage of an amount bet at each of the slot machines 3A to 3J. For example, as shown in FIGS. 1 and 2, "$12,34" is displayed on the shared display 201, which indicates that the accumulated value is "$12,34". When the accumulated value reaches a predetermined value, a jackpot game is run at each of the slot machines 3A to 3J, for the purpose of obtaining coins corresponding to the accumulated value. In addition, the shared display 201 is capable of displaying thereon various information relating to a game, an effect image, or the like, when needed.

The main CPU 241 controls the entire central control board 210. For example, when a jackpot game is executed, the main CPU 241 controls, through the route graphic board 203, operation of turning on and turning off of the LEDs provided on each of the routes 207A to 207J disposed on the route board 206. In addition, when a game is executed in the game system 1, the main CPU 241 controls operation of turning on and off of the lighting devices 120 disposed on the route board 206, through the lighting device control board 120A.

The communication interface 224 communicates with the communication interfaces 44 of the slot machines 3A to 3J through communication lines.

The graphic board 268 controls operations of turning on and turning off of the LEDs disposed on the shared display 201, based on a control signal output from the main CPU 241. The small display graphic board 204 controls image displaying on the small shared displays 205A and 205B based on a control signal output from the main CPU 241.

Based on a control signal output from the main CPU 241, the route graphic board 203 controls operations of turning on and turning off of the LEDs arranged on each of the routes 207A to 207J disposed on the route board 206.

The lighting device control board 120A controls operation of turning on and off of the lighting devices 120 disposed on the route board 206, based on a control signal output from the main CPU 241.

[Display State of Display Windows 151 to 155 of Slot Machine]

Figure 13:
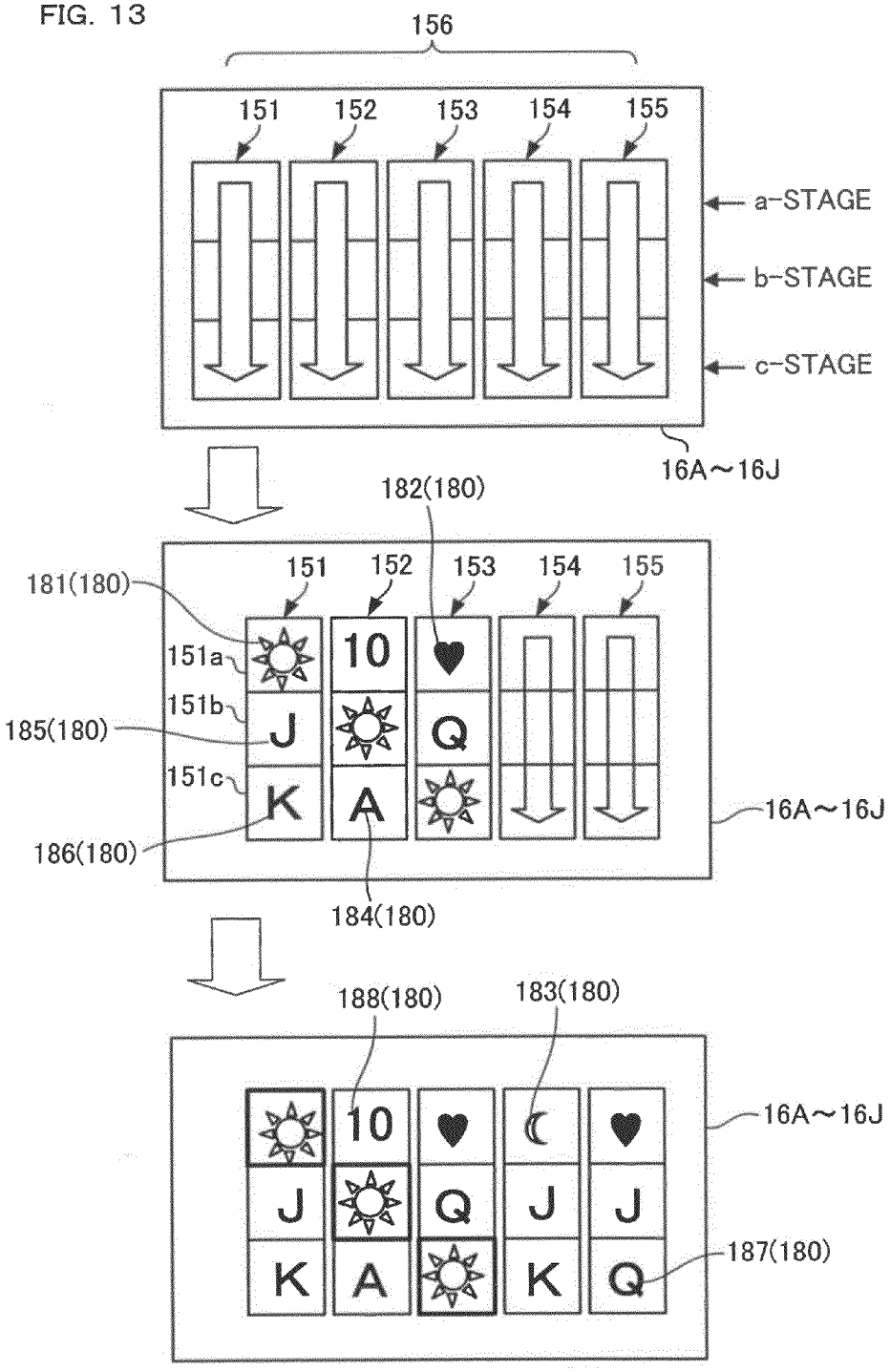
FIG. 13 is an explanatory view for a display screen.

The following details an exemplary display state of the lower image display panel (16A to 16J) of the slot machine (3A to 3J) during operation processes of the game system 1. Note that the following example deals with a case where symbols 180 are arranged in the display windows 151 to 155 by means of a video reel method, as shown in FIG. 13.

The lower image display panel (16A to 16J) has display windows 151 to 155 where symbols 180 are arranged. The display windows 151 to 155 are disposed at a center part of the lower image display panel (16A to 16J). In the display windows 151 to 155, symbol columns (symbol lines A to E: see FIG. 14) each made up of symbols 180 are scroll-displayed (see FIG. 13). The display windows 151 to 155 are respectively divided into a-stages 151*a* to 155*a*, b-stages 151*b* to 155*b*, and c-stages 151*c* to 155*c*. The symbols 180 are stopped (arranged) in the stages 151*a* to 155*a*, 151*b* to 155*b*, and 151*c* to 155*c*, respectively. For example, in FIG. 13, a symbol of "SUN" 181 is stopped in 151*a* which is a-stage of the display window 151, a symbol of "J" 185 is stopped in 151*b* which is b-stage of the display window 151, and a symbol of "SUN" 181 is stopped in 153*c* which is c-stage of the display window 153. In short, the display windows 151 to 155 displays a matrix 156 as arrangement regions made up of five columns and three rows. The matrix 156 however is not limited to the matrix of five columns and three rows.

In a base game, a payout awarding process such as paying out coins is executed when a predetermined number of symbols 181 to 188 called scatter symbols are displayed on the lower image display panel (16A to 16J) as a winning combination. Scatter symbols are symbols which provide an effective result (such as awarding a payout, giving a bonus game, or the like) merely when a predetermined number of them are stopped on any of the display areas of the arrangement regions made up of five columns and three rows of the display windows 151 to 155. For example, when five symbols of "J" 185, which is one of the scatter symbols shown in FIG. 13, are rearranged (displayed) in the display windows 151 to 155, ten coins are paid out as a payout. When five symbols of "HEART" 182, which is one of the scatter symbols, are rearranged (displayed) in the display windows 151 to 155, fifty coins are paid out as a payout.

Although in this embodiment the symbols 181 to 188 are defined as scatter symbols, this is not limitative and only a specific symbol may be defined as a scatter symbol. Alternatively, a player may select a scatter symbol. It may also be possible that a coin payout process or the like is executed when a predetermined combination of symbols is stopped on a payline L extending horizontally through the b-stages (151*b* to 155*b*) of the display windows 151 to 155. That is, the payline L is for determining a combination of symbols 180. When symbols 180 are rearranged on the payline L and outside the payline L, only the symbols 180 rearranged on the payline are judged for a combination. It may be possible that, when a winning combination is achieved as a result of the determination of a combination, a coin payout process or the like is executed according to the winning combination.

[Symbol Column, Etc.]

Symbols 180 displayed in the display windows 151 to 155 of the lower image display panel (16A to 16J) of the slot machine (3A to 3J) form five symbol columns (symbol lines A to E) each including twenty-two symbols, as shown in FIG. 14. To each of the symbols 180 constituting each column is given one of code numbers 00 to 21. Each of the symbol columns has a combination of picture symbols of "SUN" 181, "HEART" 182, and "MOON" 183, and letter symbols of "A" 184, "J" 185, "KK" 186, "Q" 187, and "10" 188.

Three successive symbols in the symbol columns are displayed (arranged) in the upper stages 151*a*, 152*a*, 153*a*, 154*a*, 155*a*, the center stages 151*b*, 152*b*, 153*b*, 154*b*, 155*b* and the lower stages 151*c*, 152*c*, 153*c*, 154*c*, 155*c* of the display windows 151 to 155, respectively, to form a matrix of five columns and three rows in the display windows 151 to 155. When the 1-BET button 26 or the MAX-BET button 27 is pushed and then the spin button 23 is pushed to start a game, the symbols 180 forming the matrix are started to scroll. After the symbols 180 are scrolled for a predetermined period of time, the scroll of the symbols 180 is stopped (rearranged).

The symbols 181 to 188 are set as scatter symbols. Scatter symbols are such symbols that a player is put into an advantageous position when a predetermined number or more of them are displayed in the display windows 151 to 155. The advantageous position is a state where coins corresponding to the scatter symbols are paid out, a state where the number of coins to be paid out is added to a credit value, or the like.

For example, when five or more symbols of "MOON" 183 are stopped in the display windows 151 to 155, thirty coins (game value) per bet are paid out.

In this embodiment, a game value is paid out when a predetermined number of predetermined symbols are stopped in the display windows 151 to 155. However, a bonus game may be given instead. The bonus game is a gaming state which is more advantageous than a basic game. For example, the bonus game is a free game. The free game is a game allowing a player to play a game a predetermined number of times without betting a coin. No particular limitation is put on the bonus game, as long as it is a gaming state advantageous to the player, that is, it is more advantageous than the basic game. For example, the bonus game may include a state where more game value are obtainable than in the basic game, a state where a game value is obtainable with higher probability than in the basic game, a state where a game value is less consumed than in the basic game, and the like. Specifically, a free game, a second game, a feature game, and the like may be mentioned as examples of the bonus game.

In a jackpot game, a symbol of "SUN" 181 is a jackpot point symbol. When a predetermined number of symbols of "SUN" 181 are displayed in the display windows 151 to 155, a player can obtain one or more points in accordance with the number of jackpot point symbols of "SUN" 181 displayed in the display windows 151 to 155 (see FIG. 11).

[Operation of Game System]

Next, various processes executed in the game system 1 will be described. As the main CPU 41 and the main CPU 241 read out and execute programs stored in the ROM 42, the RAM 43, the ROM 242, and the RAM 243, processes relating to various games are run.

[Operation of Game System: Boot Process]

The following describes a boot process which takes place in the game system 1. Upon powering on the game system 1, a boot processing routine shown in FIG. 15 starts in the motherboard 240 and the gaming board 250 in the central control board 210, and in the motherboard 40 and the gaming board 50 in the slot machine (3A to 3J). The memory cards 53 and 253 are assumed to be inserted into the card slots 53S and 253S of the gaming boards 50 and 250, respectively. Further, the GALs 54 and 254 are assumed to be attached to the IC sockets 54S and 254S, respectively.

First, turning on the power switch of (powering on) the power units 45 and 245 boots the motherboards 40 and 240, and the gaming boards 50 and 250. Booting the motherboards 40 and 240 and the gaming boards 50 and 250 starts separate processes in parallel. Specifically, in the gaming board 50 and 250, the CPUs 51 and 251 read out preliminary authentication programs stored in the boot ROMs 52 and 252, respectively. Then, preliminary authentication is performed according to the read out programs so as to confirm and authenticate that no modification is made to authentication programs, before reading them into the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 255 of the gaming boards 50 and 250 via PCI buses, read out authentication programs stored in the ROMs 55 and 255 and store them into the RAMs 43 and 243 (S4). During this step, the main CPUs 41 and 241 each derives a checksum through ADDSUM method (a standard check function) which is adopted in a standard BIOS, and store the authentication programs into the RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 253 inserted into the card slots 53S and 253S, and read out game programs and game system programs from the memory cards 53 and 253, respectively. In this case, the CPUs 41 and 241 each reads out four bytes of data constituting the game program and the game system program at one time. Next, in accordance with the authentication programs stored in the RAMs 43 and 243, the CPUs 41 and 241 authenticate the game programs and the game system programs read out to confirm and prove that these programs are not modified (S5).

When the authentication process properly ends, the main CPUs 41 and 241 write and store the authenticated game programs and game system programs into RAMs 43 and 243 (S6).

Next, the main CPUs 41 and 241 access, via the PCI buses, to the GALs 54 and 254 attached to the IC sockets 54S and 254S, and read out data from the GALs 54 and 254, respectively. The data read out is then written and stored in the RAMs 43 and 243 (S7).

Next, the main CPUs 41 and 241 read out, via the PCI buses, country identification information stored in the ROMs 55 and 255 of the gaming boards 50 and 250, respectively. The country identification information read out is then written and stored in the RAMs 43 and 243 (S8). After this, the main CPUs 41 and 241 each performs an initial process shown in FIG. 16.

[Operation of Game System: Initial Process]

Figure 15:
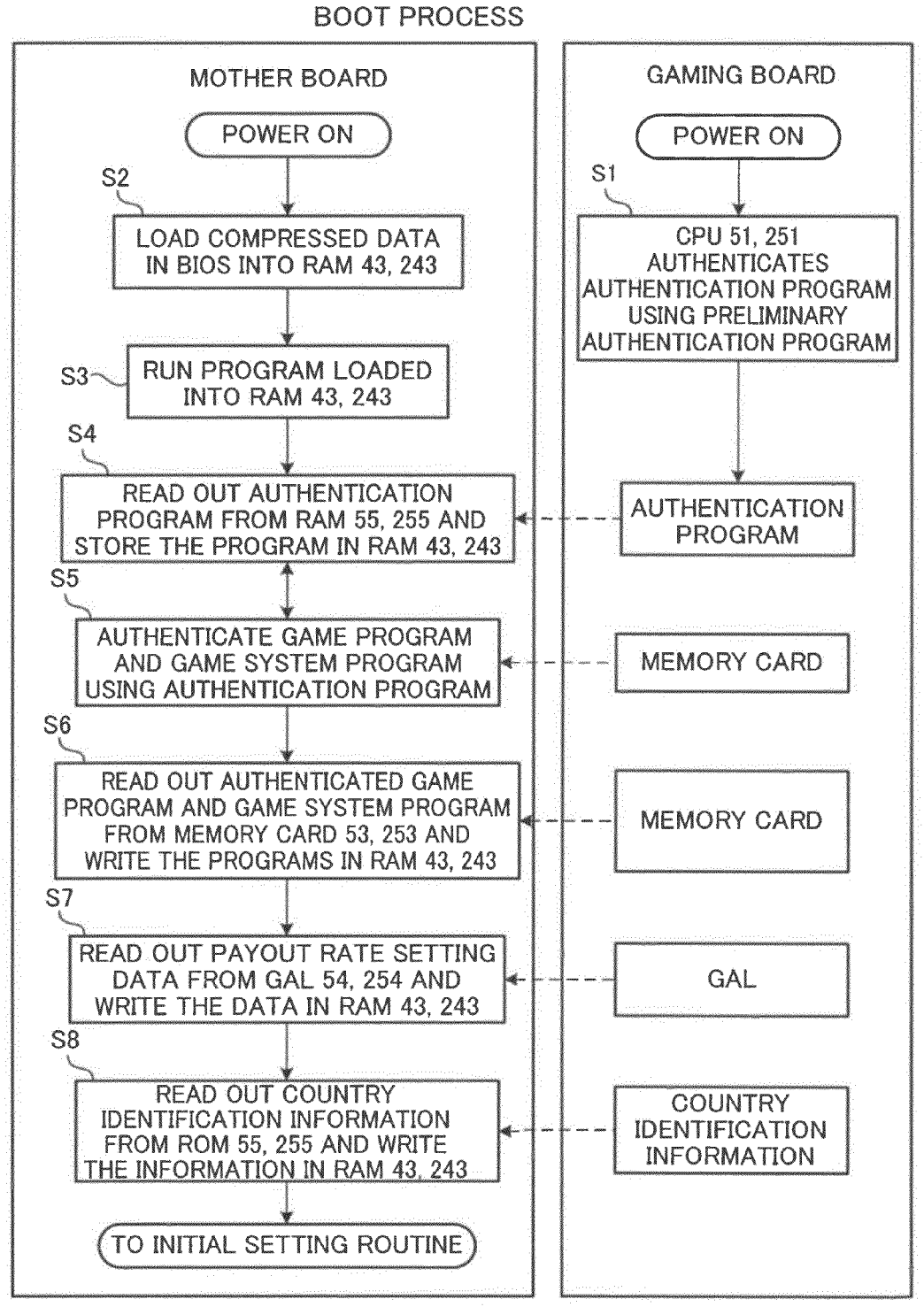
FIG. 15 is a flowchart of a boot process executed in the game system.

The following describes an initial process which takes place in the game system 1. When the boot process of FIG. 15 is completed, the central control board 210 reads out from the RAM 243 a center side initial setting routine illustrated in FIG. 16 and executes the routine. Meanwhile, after the boot process shown in FIG. 15 is completed, the slot machine (3A to 3J) reads out from the RAM 43 a terminal side initial setting routine illustrated in FIG. 16 and executes the routine. The center side and terminal side initial setting routines are executed in parallel.

First, the main CPU 41 of the slot machine (3A to 3J) checks operations of work memories such as the RAM 43, various sensors, various driving mechanisms, and various decorative illuminations (A1). Then, the main CPU 41 determines if all the check results are normal (A2). When the main CPU 41 determines that the check results are not all normal (A2: NO), the main CPU 41 outputs an error signal to the central control board 210 (A3), reports the error in the form of illuminating the lamp 30 or the like (A4), and then ends the routine.

On the other hand, in A2, when the main CPU 41 determines that all the check results are normal (A2: YES), an initial setting signal is output to the central control board 210 (AS). Then, an initial setting signal is waited from the central control board 210 (A6, A7: NO).

The main CPU 241 of the central control board 210 receives a signal from each of the terminals (B1). Then, the main CPU 241 determines whether a signal received is an error signal (B2). When the main CPU 241 determines that the signal is an error signal (B2: YES), the main CPU 241 outputs an error signal to a management server such as a not-shown host computer (B9) to report the error (B10), and ends the routine.

On the other hand, in B2, when the main CPU 241 determines that the signal is not an error signal (B2: NO), the main CPU 241 determines whether a predetermined time (check time) has elapsed from the time of powering on (B3). When the main CPU 241 determines that the check time has elapsed (B3: YES), the step B9 is executed. On the other hand, when the main CPU 241 determines that the check time has not yet elapsed (B3: NO), the main CPU 241 determines whether initial setting signals are received from all of the slot machines 3A to 3J (B4). When the main CPU 241 determines that initial setting signals are not received from all the slot machines 3A to 3J (B4: NO), the process returns to the step B1. On the other hand, when it is determined that initial setting signals are received from all the slot machines 3A to 3J (B4: YES), the main CPU 241 checks operations of work memories such as RAM 243 or the like, various sensors, various driving mechanisms, and various decorative illuminations (B5). Then, the main CPU 241 determines whether all the check results are normal (B6). When the main CPU 241 determines the check results contains an error (B6: NO), the main CPU 241 executes the step B9.

On the other hand, in the step B6, when the main CPU 241 determines that all the check results are normal (B6: YES), the main CPU 241 outputs an initial setting signal to all the slot machines 3A to 3J (B7), and causes the shared display 201 to display a demo-screen (B8). Then, the main CPU 241 ends this routine.

In the step A7, the main CPU 41 of each of the slot machines 3A to 3J determines that an initial setting signal is received from the central control board 210 (A7: YES), and causes the upper image display panel 33 to display a demo-screen (A8). The main CPU 41 then ends the routine.

[Operation of Game System: Game Running Process]

Figure 16:
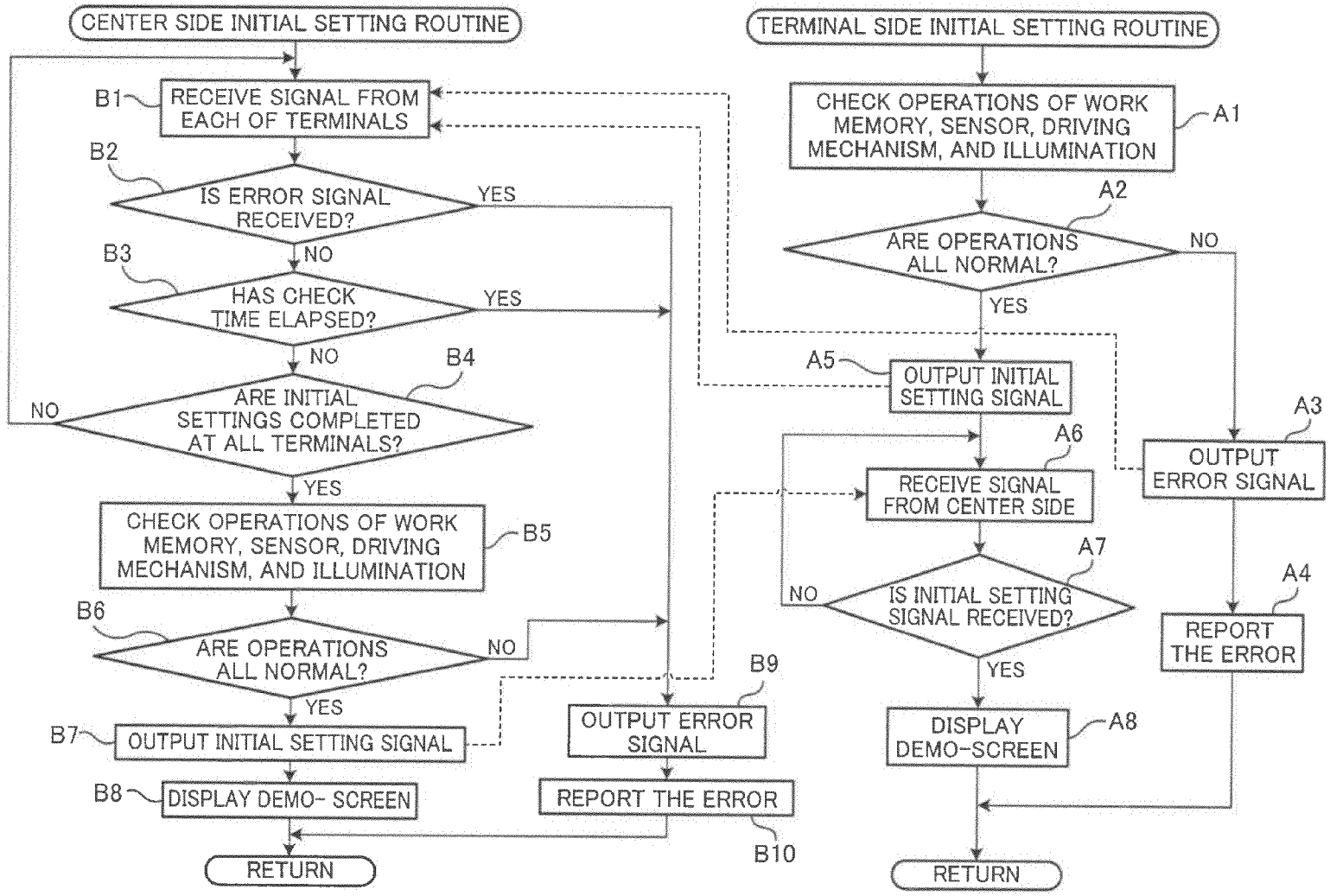
FIG. 16 is a flowchart of an initial process executed in the game system.
Figure 17:
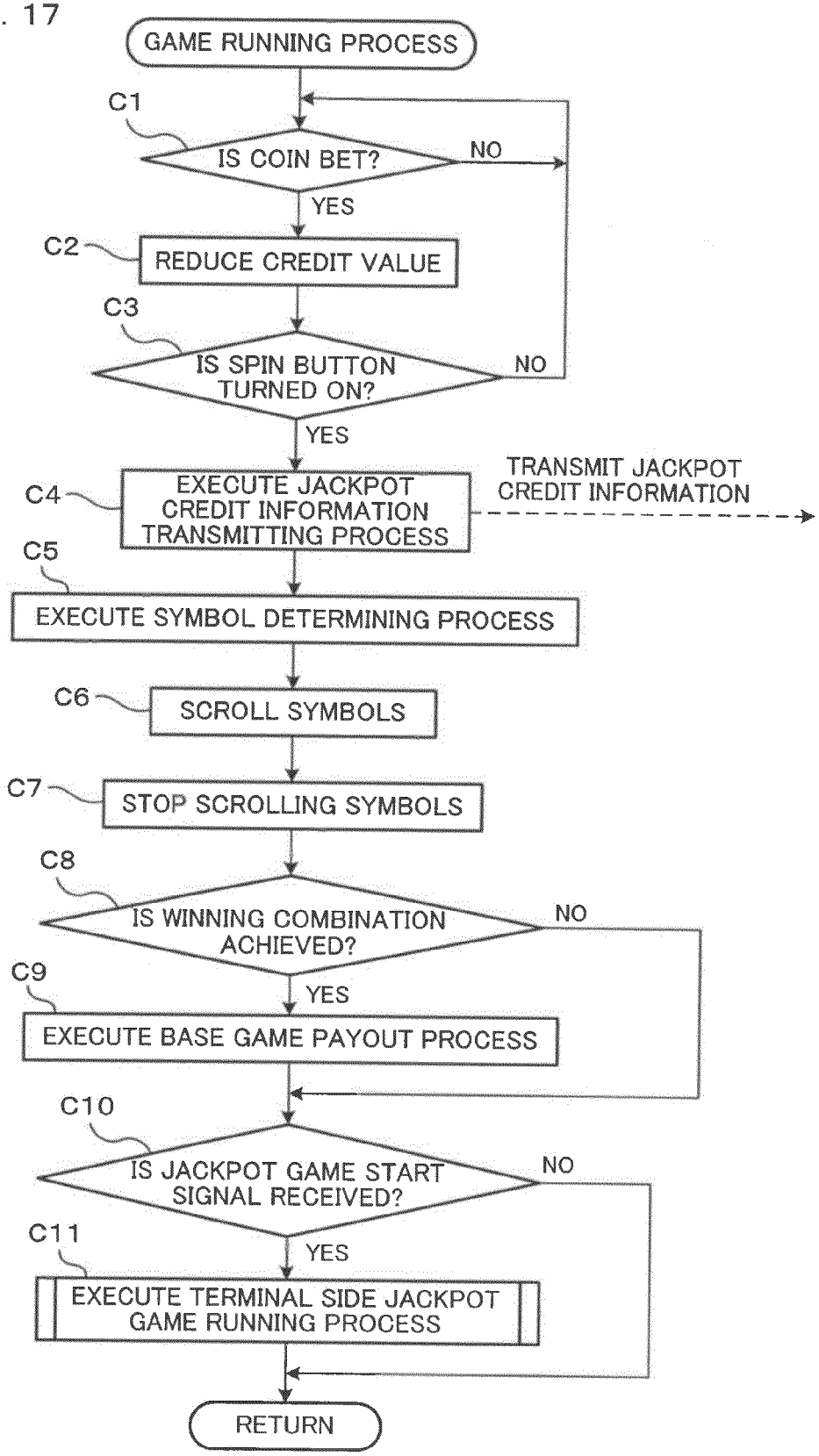
FIG. 17 is a flowchart of a game running process executed in the slot machine.

After the terminal side initial setting routine of FIG. 16 is completed, the main CPU 41 of each of the slot machines 3A to 3J reads out and executes the game program and the game system program sequentially, thereby executing a game running process shown in FIG. 17. A game running processing program is stored in the RAM 43.

The main CPU 41 of each of the slot machines 3A to 3J executes the game running process shown in FIG. 17. When the game running process is run, first, the main CPU 41 determines whether a coin is bet or not (C1). In this step, whether an input signal from the 1-BET switch 26S entered by pressing of the 1-BET button 26 is received or not is determined. Meanwhile, whether an input signal from the MAX-BET switch 27S entered by pressing of the MAX-BET button 27 is received or not is determined. When no coin is bet (C1: NO), C1 is repeated so that a standby state continues until a coin is bet.

On the other hand, when it is determined that a coin is bet (C1: YES), the credit value stored in the RAM 43 is reduced according to the number of coins bet (C2). When the number of coins bet surpasses the number of coins equivalent to the credit value stored in the RAM 43, the credit value is reduced to zero and the step C3 is performed. When the number of coins bet exceeds the maximum number of coins bettable on one game (50 pieces in this embodiment), the credit value is reduced by fifty and the step C3 is performed.

Then, whether a spin button 23 is turned on or not is determined (C3). When the spin button 23 is not turned on (C3: NO), the process returns to C1. Here, if the spin button 23 is not turned on (for example, the spin button 23 is not turned on but a command to end the game is input), the reduction of the credit value in the step C2 is canceled.

On the other hand, when it is determined that the spin button 23 is turned on (C3: YES), executed is a jackpot credit information transmitting process (C4). In other words, the main CPU 41 transmits, to the central control board 210, a percentage (5% in this embodiment) of one or more coins bet in the step C1, as jackpot credit information.

Then, a symbol determining process is executed (C5). In other words, a stop symbol determining program is executed based on the base game winning combination lottery table 160 stored in the RAM 43, to determine fifteen symbols 180 to be stopped in the display windows 151 to 155.

Then, symbols 180 in the symbol columns (symbol lines A to E) in the display windows 151 to 155 are scrolled (C6). When a predetermined period of time (base time) has elapsed after the scroll of the symbols 180 is started, the symbols 180 determined in the step C5 are stopped (rearranged) in the display windows 151 to 155 (C7).

Then, whether a winning combination is achieved or not, that is, whether a combination of symbols 180 stopped in the display windows 151 to 155 corresponds to a winning combination listed in the base game payout table 161 or not, is determined (C8). When it is determined that a winning combination is not achieved (C8: NO), the process proceeds to the step C10. On the other hand, when it is determined that a winning combination is achieved (C8: YES), a base game payout process is executed (C9). More specifically, the number of coins to be paid out which corresponds to the kind of the winning combination is calculated based on the base game payout table 161 shown in FIG. 10. When coins to be paid out are reserved, a credit value equivalent to the coins to be paid out is added to the credit value stored in the RAM 43. When the coins are paid out, a control signal is transmitted to the hopper 66 so that a predetermined number of coins are paid out to the coin tray 18. That is, a base payout is awarded in accordance with the winning combination.

Then, it is determined whether a jackpot game start signal which is transmitted in a later-mentioned center side jackpot game running process is received or not (C10) When the jackpot game start signal is not received (C10: NO), this process ends. On the other hand, when the jackpot game start signal is received (C10: YES), a later-mentioned terminal side jackpot game running process is executed (C11). Then, this process once ends.

[Operation of Game System: Terminal Side Jackpot Game Running Process]

Figure 18:
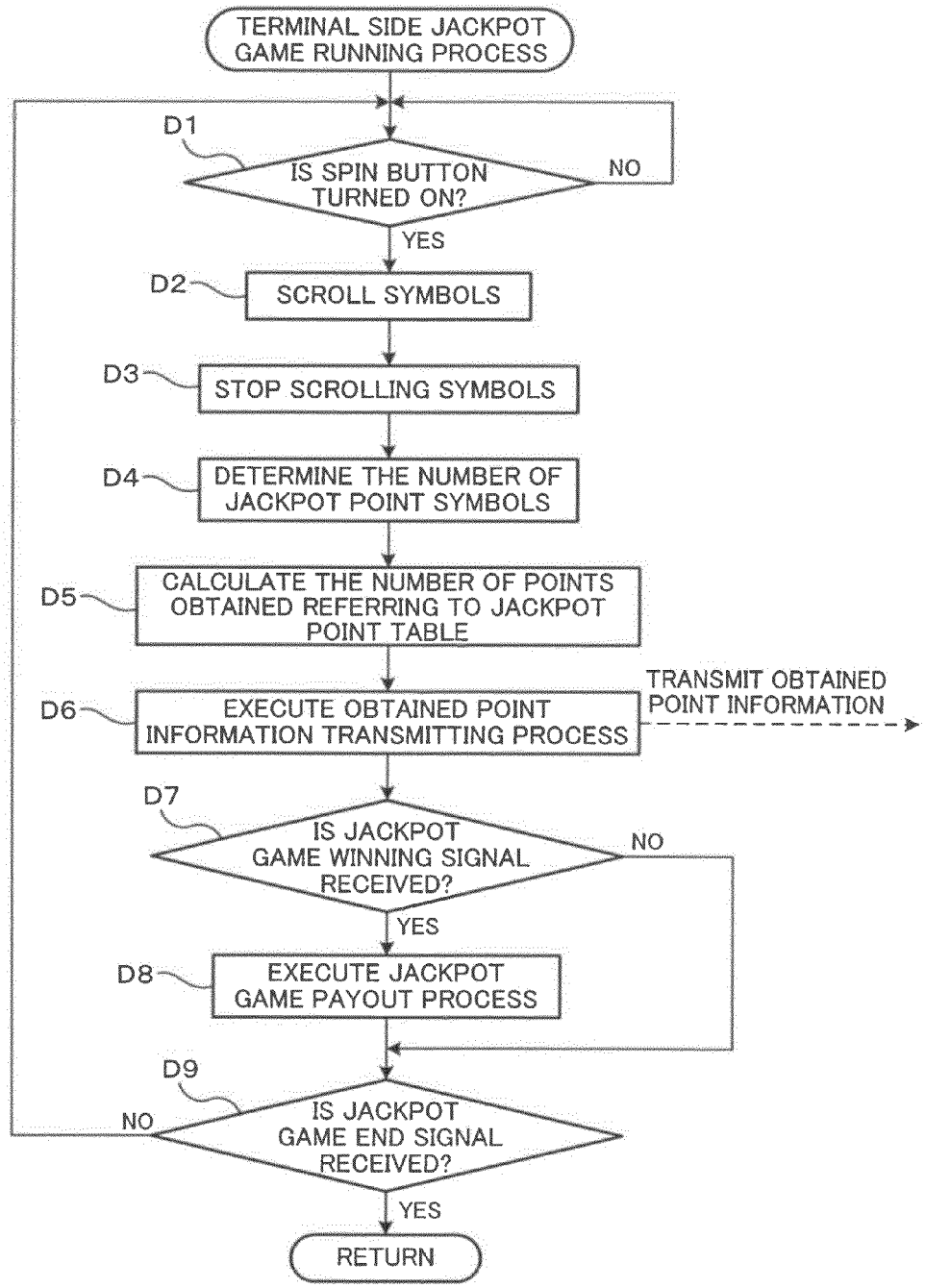
FIG. 18 is a flowchart of a terminal side jackpot game running process executed in the slot machine.

When the terminal side jackpot game running process is executed in the step C11 of FIG. 17, the main CPU 41 of the slot machine (3A to 3J) executes the terminal side jackpot game running process shown in FIG. 18. A terminal side jackpot game running processing program is stored in the RAM 43.

When the terminal side jackpot game running process is executed, first, whether the spin button 23 is turned on or not is determined (D1). When it is determined that the spin button 23 is not turned on (D1: NO), the process returns to D1.

On the other hand, when it is determined that the spin button 23 is turned on (D1: YES), symbols 180 are scroll-displayed in the display windows 151 to 155 (D2). When a predetermined period of time (base time) has elapsed after the scroll of the symbols 180 is started, symbols 180 are stopped (rearranged) in the display windows 151 to 155 (D3).

Then, it is determined how many symbols of "SUN" 181 each acting as a jackpot point symbol appear among the symbols 180 stopped in the display windows 151 to 155 (D4)

Then, the number of points obtained is calculated, based on the number of symbols of "SUN" 181 each acting as a jackpot point symbol, which number is determined in the step D4, as well as referring to the jackpot point table 162 (D5). After that, executed is an obtained point information transmitting process (D6). That is, the main CPU 41 transmits to the central control board 210 the number of points obtained which is calculated in the step D5, as obtained point information.

Then, whether a jackpot game winning signal is received or not is determined, which signal is transmitted in the later-mentioned center side jackpot game running process (D7). When the jackpot game winning signal is not received (D7: NO), the process proceeds to the step D9.

On the other hand, when the jackpot game winning signal is received (D7: YES), a jackpot game payout process is executed (D8). In other words, paid out are one or more coins equivalent to an accumulated value resulting from accumulative calculation of a percentage of an amount bet at each of the slot machines 3A to 3J. For example, as shown in FIG. 2, "$12,34" is displayed on the shared display 201, and coins equivalent to this accumulated value of "$12,34" are to be paid out. When coins to be paid out are reserved, a credit value equivalent to the accumulated value is added to the credit value stored in the RAM 43. When the coins are paid out, a control signal is transmitted to the hopper 66 so that coins equivalent to the accumulated value are paid out to the coin tray 18.

Then, it is determined whether a jackpot game end signal is received or not, which signal is transmitted in the later-mentioned center side jackpot game running process (D9). When the jackpot game end signal is not received (D9: NO), the process returns to the step D1. On the other hand, when the jackpot game end signal is received (D9: YES), this process once ends.

[Operation of Game System: Center Side Jackpot Game Running Process]

Figure 19:
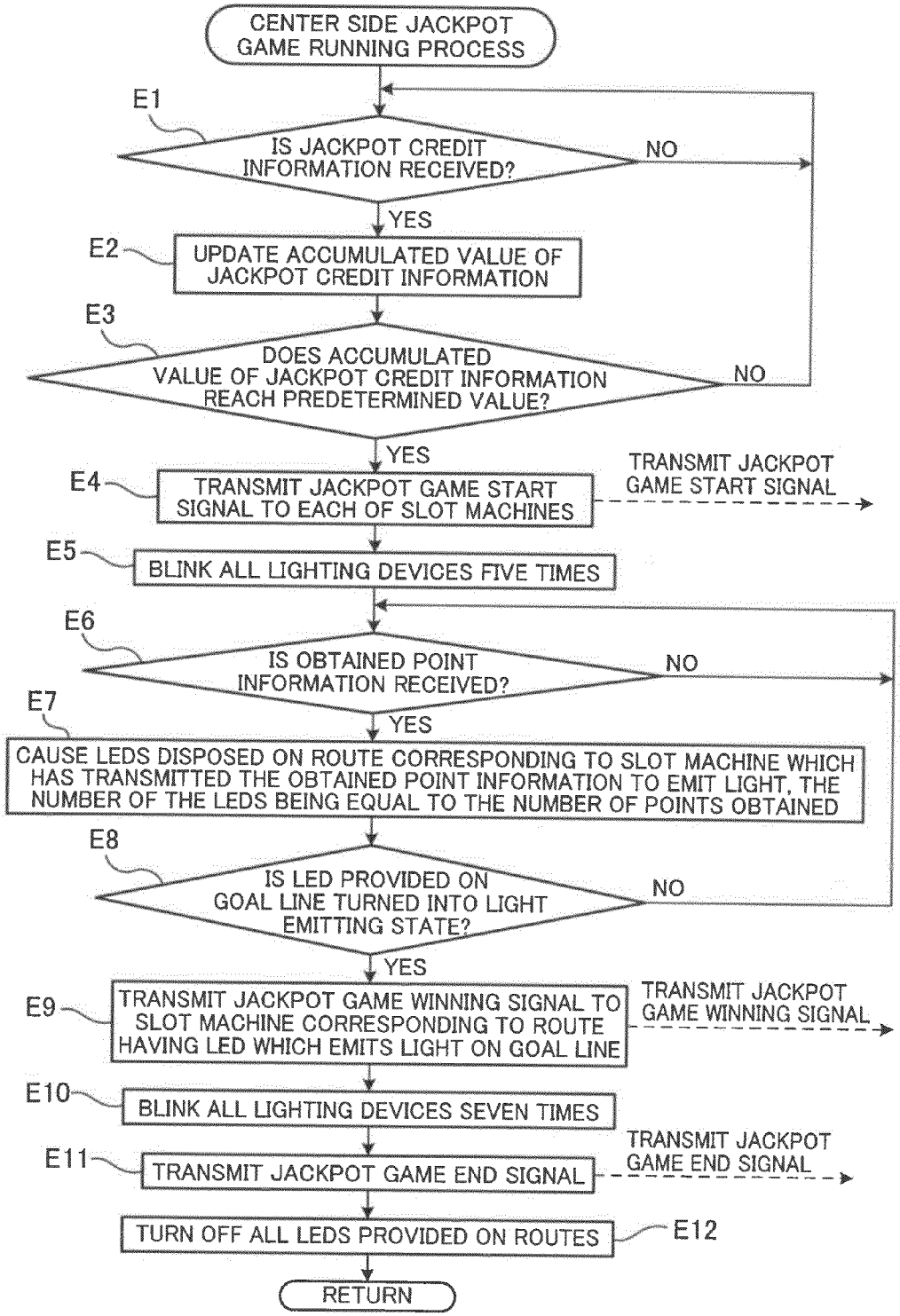
FIG. 19 is a flowchart of a center side jackpot game running process executed in the central control board.

After the center side initial setting routine shown in FIG. 16 ends, the main CPU 241 of the central control board 210 reads out and executes the game program and the game system program sequentially, thereby running the center side jackpot game running process shown in FIG. 19. This center side jackpot game running processing program is stored in the RAM 243.

When the center side jackpot game running process is executed, first, it is determined whether the jackpot credit information transmitted in the before-mentioned game running process is received or not (E1). When the jackpot credit information is not received (E1: NO), the step E1 is repeated. On the other hand, when the jackpot credit information is received (E1: YES), the accumulated value of the jackpot credit information is updated (E2). In other words, based on the jackpot credit information transmitted from each of the slot machines 3A to 3J, the main CPU 241 adds a percentage (5% in this embodiment) of an amount bet at each of the slot machines 3A to 3J to the accumulated value of jackpot credit information stored in the RAM 243, and stores the thus obtained value.

Next, the main CPU 241 determines whether the accumulated value of jackpot credit information stored in the RAM 243 reaches a predetermined value ("$12,34" in this embodiment) (E3). When the accumulated value does not reach the predetermined value (E3: NO), the process returns to the step E1. On the other hand, when the accumulated value reaches the predetermined value (E3: YES), a jackpot game start signal which triggers a jackpot game is transmitted to each of the slot machines 3A to 3J (E4). After the step E4, all the lighting devices 120 are blinked five times (E5). This operation allows one or more players of the game system 1 to know the start of a jackpot game.

In this embodiment, a jackpot game is started when the accumulated value of jackpot credit information exceeds a predetermined value (e.g., a fixed value of "$12,34"), however, this embodiment is not limited thereto. For example, the game system 1 may have a structure that a threshold value, for triggering a jackpot game, of the accumulated value of jackpot credit information is randomly varied in each jackpot game within a predetermined range (e.g., $200 to $300).

Next, it is determined whether the obtained point information is received or not, which information is transmitted in the before-mentioned terminal side jackpot game running process (E6). When the obtained point information is not received (E6: NO), the step E6 is repeated. On the other hand, when the obtained point information is received (E6: YES), LEDs disposed on a route corresponding to a slot machine which has transmitted the obtained point information are turned on toward the goal line 209A or 209B so as to emit light, the number of the LEDs turned on being equal to the number of points obtained (E7).

Next, it is determined whether an LED provided on the goal line 209A or 209B is turned into a light emitting state (E8). In other words, it is determined whether the number of points awarded in a jackpot game reaches a predetermined value (50 points). (That is, whether there is a player who has won the jackpot game is determined). When an LED provided on the goal line 209A or 209B is not turned into a light emitting state (E8: NO), the process returns to the step E6. On the other hand, when an LED provided on the goal line 209A or 209B is turned into a light emitting state (E8: YES), a jackpot game winning signal is transmitted to a slot machine corresponding to a route having the LED which emits light on the goal line 209A or 209B (E9).

In this embodiment, a fixed value (50 points) is set as the number of points required to receive, at the slot machine (3A to 3J), an award of the accumulated value of jackpot credit information (in this embodiment, a predetermined value of "$12,34"). However, the required number of points may be set by selection. For example, the number of points required to receive an award of the accumulated value of jackpot credit information may be selected, by an input from outside, from several values (e.g., 50 points, 100 points, and 150 points).

After the step E9, all the lighting devices 120 are blinked seven times (E10). This operation allows the players of the game system 1 to be aware that a winner of the jackpot game has been determined.

Next, a jackpot game end signal is transmitted to the slot machines 3A to 3J (E11). Then, all the LEDs disposed on the routes 207A to 207J are turned off (E12). Then, this process once ends.

[Operation of Game System: Effect Operation]

When the above-described various processes are executed in the game system 1, results or contents corresponding to the processes are, in the form of commands or data, input to respective actuators. For example, when a jackpot game winning signal is received at the slot machine (3A to 3J), the main CPU 41 controls the lamp 30 so as to blink. When a jackpot game winning signal is transmitted, effect images are displayed on the upper image display panel 33 of each of the slot machines 3A to 3J and the small shared displays 205A and 205B. Moreover, an effect is presented through audio output from the speaker 29, together with or independently of the above-described effects.

In addition, when an LED provided on the goal line 209A or 209B is turned into a light emitting state, an effect is presented such that an effect sound is output from the speaker 29 in response to turning on of the LED.

According to the game system 1 having the above-described structure, it is possible to mount, on the game system 1, the lighting device 120 which emits illuminating light similar to a light bulb by blurring high-directivity light emitted from the LEDs 135. Thus, using low-cost, long-life light-emitting diode, it is possible to provide illuminating light similar to a light bulb as effect illumination of the game system 1.

Note that the present invention is not limited to the above-described first embodiment. The below-described second embodiment may also be possible.

Figure 20:
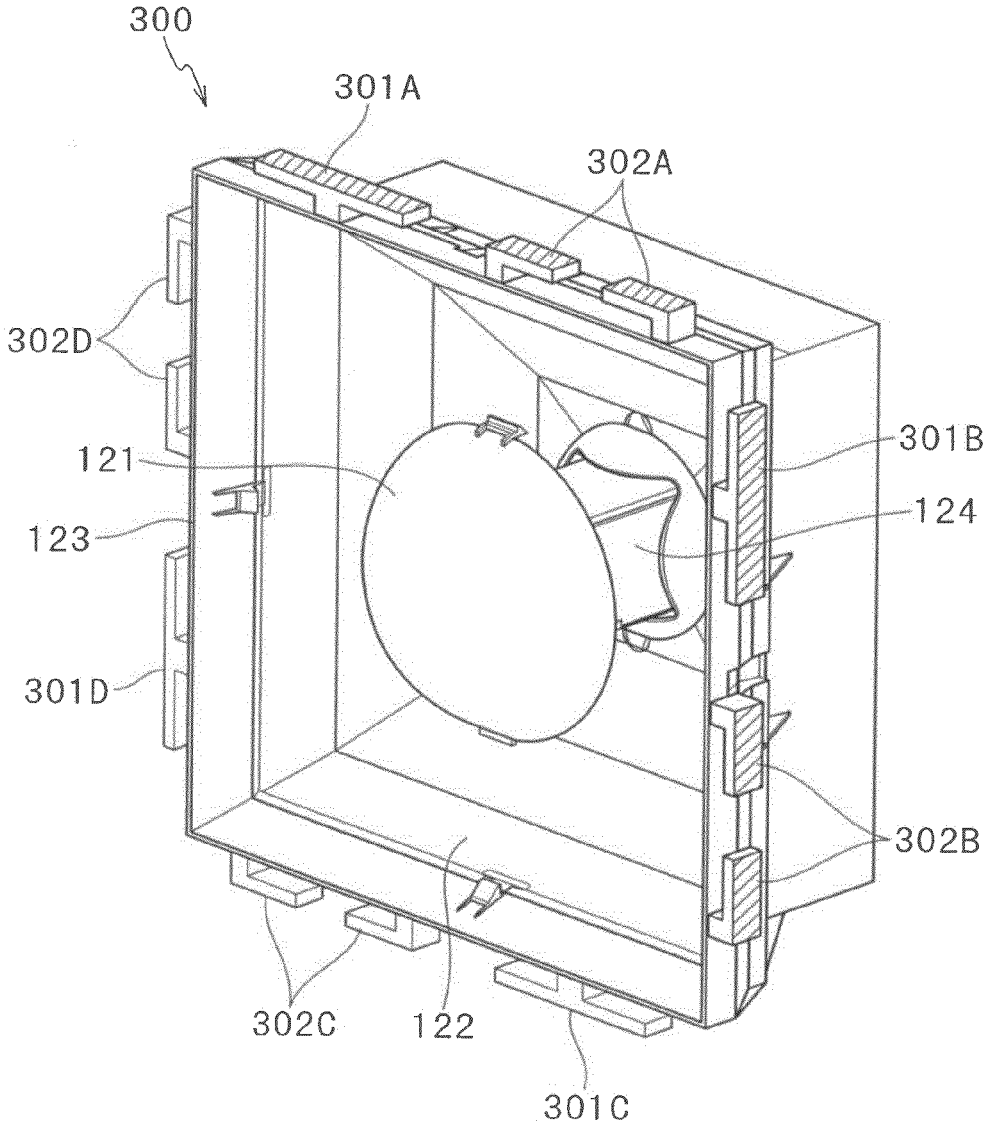
FIG. 20 is a perspective view showing an external appearance of a lighting device provided with a T-shape connecting portion and an L-shape connecting portion.
Figure 21:
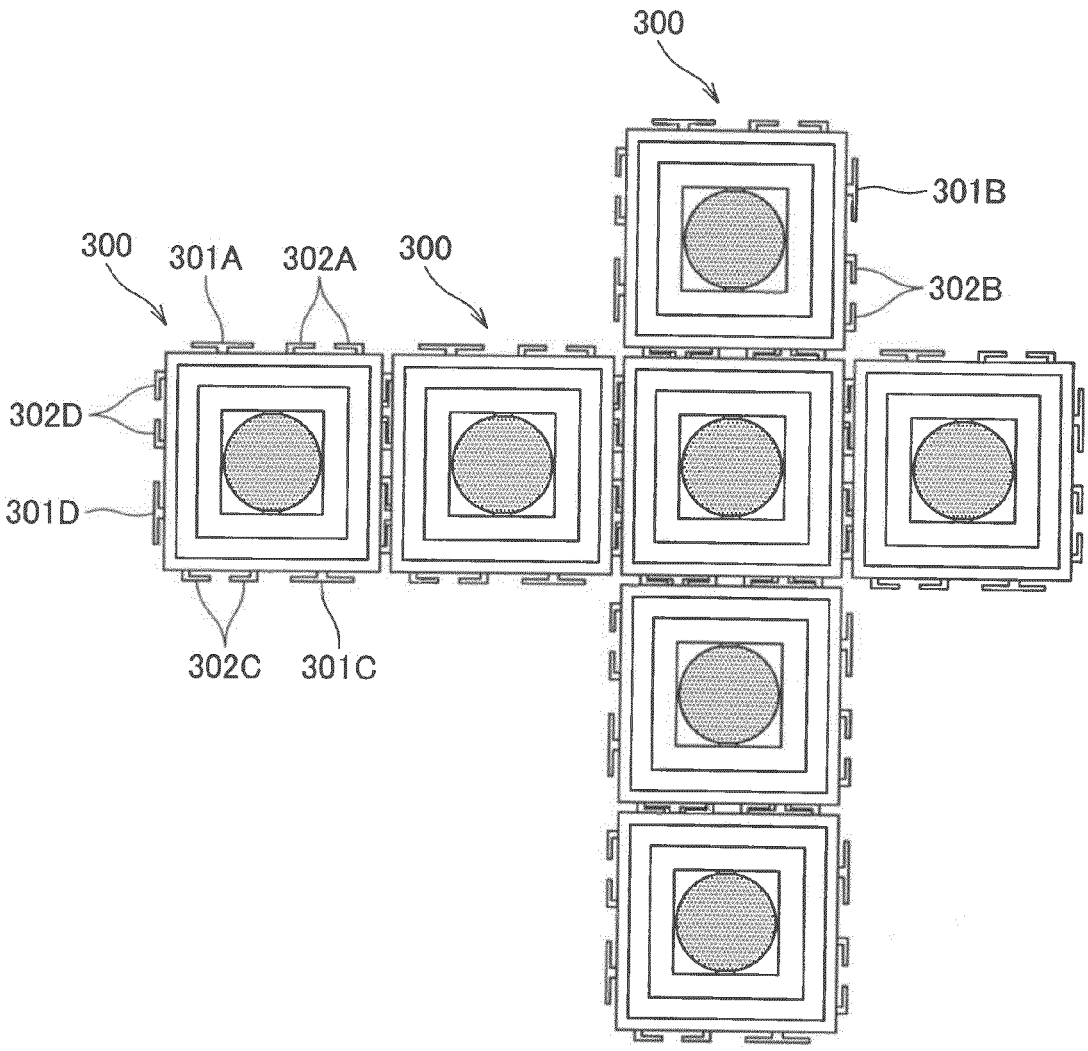
FIG. 21 is an explanatory view showing the lighting devices connected to each other.

As shown in FIGS. 20 and 21, each of lighting devices 120 of a game system 1 according to the second embodiment includes: T-shape connecting portions 301A, 301B, 301C, and 301D each having a shape of letter T; and L-shape connecting portions 302A, 302B, 302C, and 302D each having a pair of protrusions of a shape of letter L ("connecting portion"). These connecting portions are formed on four side edges of the outer frame of a housing 123, respectively.

In the above structure, the lighting devices 120 can be connected to each other. To be more specific, as shown in FIG. 21, the lighting devices 120 are connected to each other by fitting one of the T-shape connecting portions 301A, 301B, 301C, and 301D provided on one lighting device 120 into the associated one of the L-shape connecting portions 302A, 302B, 302C, and 302D of another lighting device 120, and locking the fit connecting portions.

In this manner, more than one lighting devices 120 can be connected to each other freely. This structure allows more than one lighting devices 120 to be disposed adjacent to one another at a time of installation of the lighting devices 120 in the game system 1. It is also possible to arrange the lighting devices 120 freely, at the left, right, top and bottom of one device, so as to match their installation space.

Note that in this embodiment, the cover has a hemispherical shape, however, the cover may have a bowl-shape, a substantially sector-shape in cross section, or a projected shape in a sectional view.

Such a shape allows the external appearance of the lighting device 120 to resemble a light bulb.

The game system 1 according to the second embodiment of the present invention has a structure that a jackpot game is started when the accumulated value of jackpot credit information exceeds a predetermined value (e.g., a fixed value of "$12,34"). However, the second embodiment is not limited thereto. For example, the game system 1 may have a structure that a threshold value, for triggering a jackpot game, of the accumulated value of jackpot credit information is randomly varied in each jackpot game within a predetermined range (e.g., $200 to $300).

In addition, in the second embodiment of the present invention, a fixed value (50 points) is set as the number of points required to receive, at the slot machine (3A to 3J), an award of accumulated value of jackpot credit information (in the second embodiment, "$12,34") However, the required number of points may be set by selection. For example, the game system 1 (gaming machine) may have a structure that the accumulated value of jackpot credit information is awarded when the number of points award and accumulated reaches a value which is varied in each jackpot game within a predetermined range (e.g., 3000 to 5000 points)

In addition, in the second embodiment, a fixed value (50 points) is set as the number of points required to receive, at the slot machine (3A to 3J), an award of accumulated value of jackpot credit information (in the second embodiment, "$12, 34"). However, the required number of points may be set by selection. For example, the number of points required to receive an award of the accumulated value of jackpot credit information may be selected, by an input from outside, from several values (e.g., 50 points, 100 points, and 150 points).

(Second Embodiment)

The following describes another embodiment of a gaming machine and a playing method thereof according to the present invention. Note that reference numbers and symbols given to members and steps of flowcharts in the present embodiment as well as the subsequent embodiments (i.e., third and fourth embodiments) are only applicable to those described within these embodiments, and do not represent the members or the steps of the above mentioned first embodiment.

Figure 22:
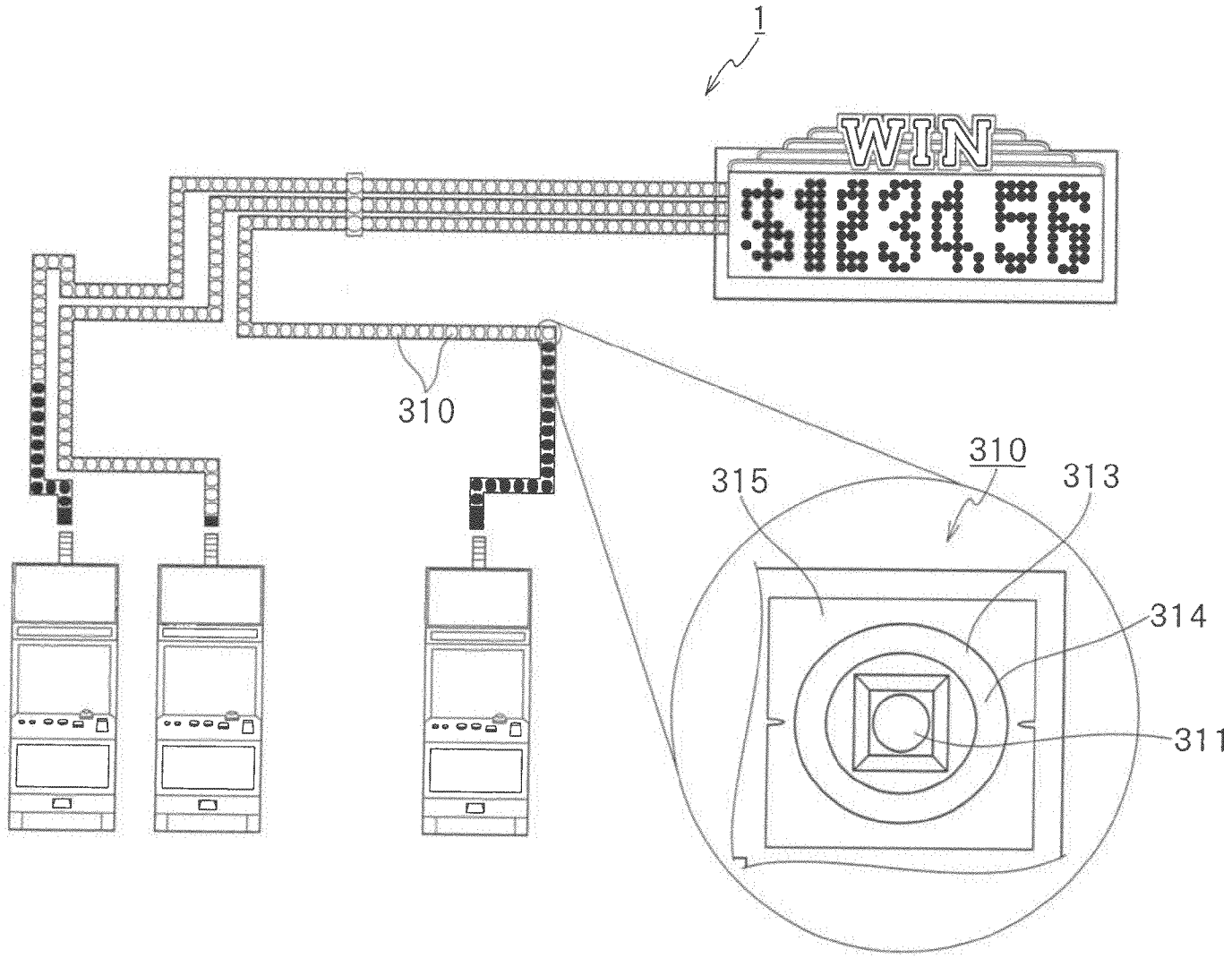
FIG. 22 is an explanatory diagram concerning a luminescent display device provided in a gaming machine according to one embodiment of the present invention.

As shown in FIG. 22, a luminescent display device 310 is provided in a gaming machine 1. The luminescent display device 310 includes a light emitting portion 311 for emitting light, a housing 314, provided with a circular aperture 313, housing the light emitting portion 311, and a cover member 315, detachably provided to cover the aperture 313 of the housing 314, to attenuate the quantity of transmitting light emitted by the light emitting portion 311.

Figure 23A:
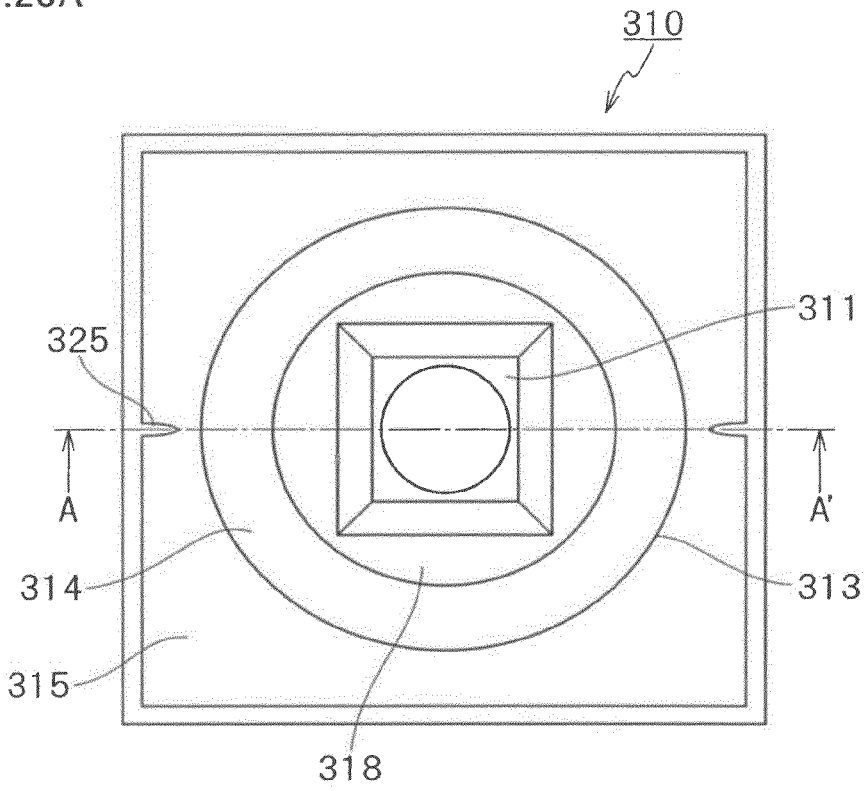
FIG. 23A is a front view of the luminescent display device.
Figure 23B:
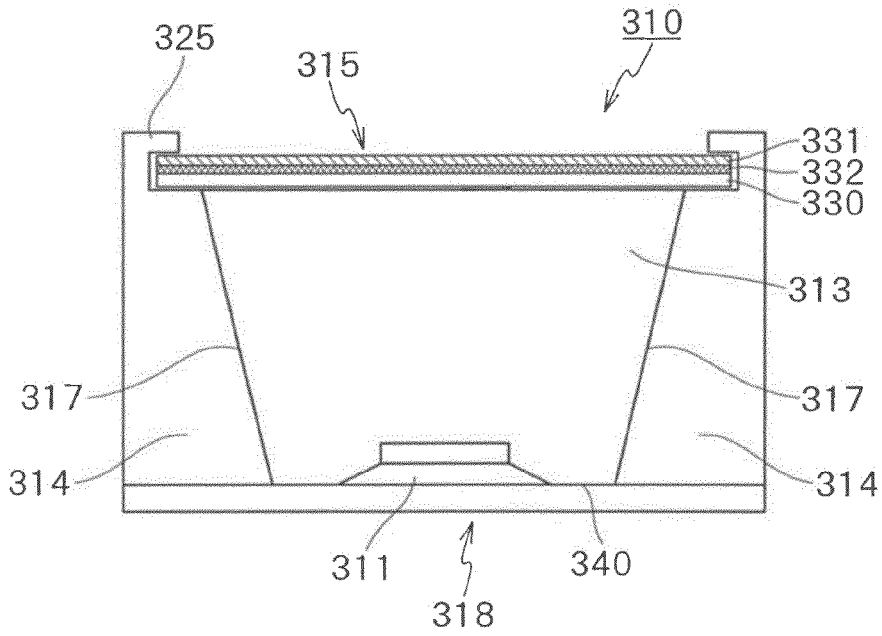
FIG. 23B is a cross sectional view of the luminescent display device taken along line A-A'.

FIG. 23A and FIG. 23B are diagrams illustrating the luminescent display device 310, in which FIG. 23A is a front view of the luminescent display device 310, and FIG. 23B is a cross sectional view taken along the line A-A' of FIG. 23A.

As shown in FIG. 23A and FIG. 23B, the light emitting portion 311 is an LED (light-emitting diode) that emits light of predetermined wavelengths, disposed on a predetermined position of a luminescent substrate 318. The luminescent substrate 318 includes a reflecting substrate surface 340, which occupies a portion of the upper surface of the luminescent substrate 318 to reflect light. The LED is directional in a sense that the brightness is greater in portions closer to the center of the optical axis, and smaller farther away from the center of the optical axis.

The housing 314 is made of ABS (Acrylonitrile Butadiene Styrene) resin, and the aperture 313 is formed in a predetermined portion of the housing 314 within a path of emergent light from the light emitting portion 311. The housing 314 is formed to surround the light emitting portion 311. With this construction, the light emitted by the light emitting portion 311 does not emerge from the luminescent display device 310 except through the aperture 313.

The housing 314 has a reflecting surface 317 to reflect light. The reflecting surface 317 is inclined with an increasing diameter toward the aperture 313. The light emitted by the light emitting portion 311 and directly incident on the reflecting surface 317 is reflected into the aperture 313. The reflecting surface 317 may be formed by depositing a metal such as aluminum. Alternatively, the reflecting surface 317 may be made of a substance having a different refractive index from the surroundings, so that the light emitted by the light emitting portion 311 and directly incident on the reflecting surface 317 undergoes total reflection.

The housing 314 also includes a pair of hooked, opposing locking portions on the inner periphery of the aperture 313. The cover member 315 can be locked in place when engaged with the locking portions 325.

The cover member 315 includes a translucent resin 330, a color film 331, and a metallization layer 332, and is detachably provided to cover the aperture 313 of the housing 314. In this way, the players are prevented from directly touching the light emitting portion 311 through the aperture 313 of the housing 314. This reduces the risk of the light emitting portion 311 being damaged by the players. The metallization layer 332 and the color film 331 are formed on the upper surface of the translucent resin 330, in this order. The color film 331 is a black coated film, capable of attenuating the quantity of transmitting light. The metallization layer 332 is a semi-transmissive half mirror with a thin reflecting surface.

The cover member 315 can engage with the locking portions 325 of the housing 314 by bending. The cover member 315 is therefore detachable with respect to the housing 314.

The translucent resin 330 forming the cover member 315 is preferably made of polycarbonate, which is highly transparent, impact resistant, heat resistant, and fire resistant. The metallization layer 332 forming the cover member 315 may be made of metal such as gold, silver, copper, aluminum, chromium, nickel, titanium, or tin, as well as metal alloys and metal compounds. Aluminum is particularly preferable in terms of ease of deposition, specular reflection, and cost. Deposition of metal can be preferably performed by PVD methods such as a vacuum deposition method, a sputtering method, and an ion plating method.

By the provision of the cover member 315 in the luminescent display device 310, the light emitted by the light emitting portion 311 and entered the aperture 313 falls on the metallization layer 332, which transmits some of the light while reflecting the remainder with an angle. The light reflected by the metallization layer 332 is reflected by the reflecting surface 317 of the housing 314, or the reflecting substrate surface 340 of the luminescent substrate 318, and enters the aperture 313 again. Some of the light entering the aperture 313 passes through the metallization layer 332, while the remainder is reflected by the metallization layer 332. In this manner, the metallization layer 332 repeatedly transmits and reflects light. The result of this is that the light leaving the luminescent display device 310 is darker in portions closer to the center of the optical axis of the light emitting portion 311, and brighter in portions farther from the center of the optical axis of the light emitting portion 311. Accordingly, uniform illumination can be realized over the illumination area of the luminescent display device. The light transmitted through the metallization layer 332 emerges from the luminescent display device 310 through the color film 331, which attenuates the quantity of the light passing through it.

By providing the metallization layer 332 and the color film 331 for the cover member 315, luminescent effects can be provided at the brightness suitable to the players, even when the light emitted by the light emitting portion 311 is too bright.

Further, by the provision of the color film 331 for the cover member 315, the light emitted by the light emitting portion 311 and the surrounding light (outside light), such as the room illumination of the place where the gaming machine 1 is installed, can have different attenuations. The outside light, when reflected by the light emitting portion 311 or other members in the luminescent display device 310, makes it difficult for the players to distinguish between the ON state and OFF state of the luminescent display device 310. Indeed, such outside light is one of the factors that lowers the visibility of the illumination state of the luminescent display device 310.

Outside light passes through the cover member 315 and falls on the reflecting surface 317 of the housing 314, or the reflecting substrate surface 340 of the luminescent substrate 318, where it is reflected back into the cover member 315 and emerges from the device through it. That is, the outside light is attenuated twice by the color film 331. By contrast, the light emitted by the light emitting portion 311 passes through the color film 331 only once, and accordingly has a smaller attenuation (single attenuation). That is, outside light and the light emitted by the light emitting portion 311 have different attenuations. As described, the color film 331 forming a surface of the cover member 315 can reduce the influence of outside light reflected inside the luminescent display device 310.

By the provision of the metallization layer 332 for the cover member 315, the quantity of light passing through the metallization layer 332 out of the luminescent display device 310 can be controlled to make inside of the luminescent display device 310 visible or invisible to the players. When the quantity of light passing through the metallization layer 332 out of the luminescent display device 310 is excessively smaller than the quantity of external light entering the luminescent display device 310 and reflected by the metallization layer 332, the players can see only the surface of the metallization layer 332. On the other hand, when the quantity of light passing through the metallization layer 332 out of the luminescent display device 310 is greater, the players can see inside the luminescent display device 310. That is, by adjusting the transmittance of the metallization layer 332, the players can see only the light emitted by the light emitting portion 311. This makes it easier for the players to see the light emerging from the luminescent display device 310.

The thickness of the metallization layer 332 provided for the cover member 315 may vary across different portions of the metallization layer 332. For example, the thickness of the metallization layer 332 may be thicker in portions closer to the center of the optical axis of the light emitting portion 311, and thinner away from the center of the optical axis of the light emitting portion 311. In this way, the transmittance of the light passing through the metallization layer 332 becomes relatively smaller, and the reflectance relatively greater, in portions closer to the center of the optical axis of the light emitting portion 311. On the other hand, in portions farther away from the center of the optical axis of the light emitting portion 311, the transmittance of the light passing through the metallization layer 332 will be relatively greater, and the reflectance relatively smaller. In this way, the light emerging from the luminescent display device 310 will be darker in portions closer to the center of the optical axis of the light emitting portion 311, and brighter in portions farther away from the center of the optical axis of the light emitting portion 311. Accordingly, uniform illumination can be realized over the illumination area of the luminescent display device 310.

The color film 331 may have an attenuation greater in portions closer to the center of the optical axis of the light emitting portion 311, and smaller in portions farther away from the center of the optical axis of the light emitting portion 311. In this way, uniform illumination can be realized over the illumination area of the luminescent display device 310.

In the present invention, the quantity of transmitting light is attenuated by the color film 331; however, the invention is not limited to this example. Further, the present invention may be adapted to attenuate the quantity of transmitting light only for light emitted in a specific direction from the light emitting portion 311. For example, the quantity of transmitting light may be attenuated only in portions closer to the center of the optical axis of the light emitting portion 311. Further, in the present embodiment, the cover member 315 may include only the translucent resin 330 and the metallization layer 332.

Further, a fluorescent material may be blended into the translucent resin 330 of the cover member 315 to contain it in the cover member 315. The fluorescent material absorbs light of relatively shorter wavelengths emitted by the light emitting portion 311, and converts this into light of relatively longer wavelengths to produce light different from the one emitted by the light emitting portion 311. For example, when the light emitting portion 311 is adapted to emit light of the blue wavelength range, the cover member 315 may include a fluorescent material that produces light of the yellow wavelength range by absorbing light emitted by the light emitting portion 311. In this way, the luminescent display device 310 can emit light that has the impression of white light.

The light emitted by the light emitting portion 311 is diffused by the fluorescent material contained in the cover member 315. Accordingly, uniform illumination can be realized over the illumination area of the luminescent display device 310. Further, different kinds of fluorescent materials may be contained in the cover member 315, or the content of fluorescent material may be adjusted to emit a predetermined mixture of different colors, or predetermined intermediate colors from the luminescent display device 310.

The fluorescent material contained in the cover member 315 may have a concentration gradient. For example, the concentration of the fluorescent material may be increased or decreased from the outer surface of the cover member 315 toward the light emitting portion 311. Further, the concentration of the fluorescent material in the cover member 315 may be increased or decreased outwardly from the center of the optical axis of the light emitting portion 311. Note that, a fluorescent pigment may be coated over the surface of the cover member 315 to contain a fluorescent material in the cover member 315.

Further, small holes may be formed through the cover member 315. In this case, it is preferable that the holes be formed to provide water tightness yet enable the heat of radiation from the light emitting portion 311 to be released outside. When the fluorescent material is contained in the translucent resin 330 of the cover member 315 and small holes are formed through the translucent resin 330, the light emerging from the luminescent display device 310 will be a color mixture of the light of the converted wavelengths by the fluorescent material, and the light traveling through the holes from the light emitting portion 311.

Further, in the present invention, the cover member 315 may have a raised portion protruding in a direction of emergent light from the light emitting portion 311. In this case, by the protrusion on the outer side of the cover member 315, the players can see the emergent rays of the luminescent display device 310 over a wide angle with respect to the luminescent display device 310.

Figure 24A:
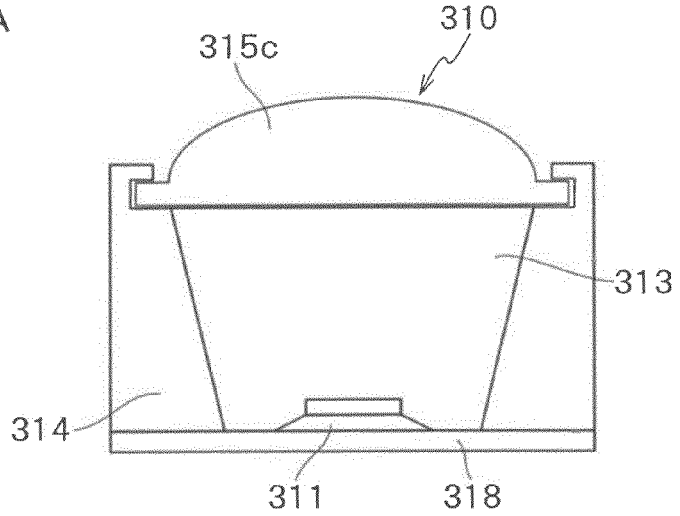
FIG. 24A is a diagram showing a luminescent display device provided with a cover member integral with a plano-convex lens.
Figure 24B:
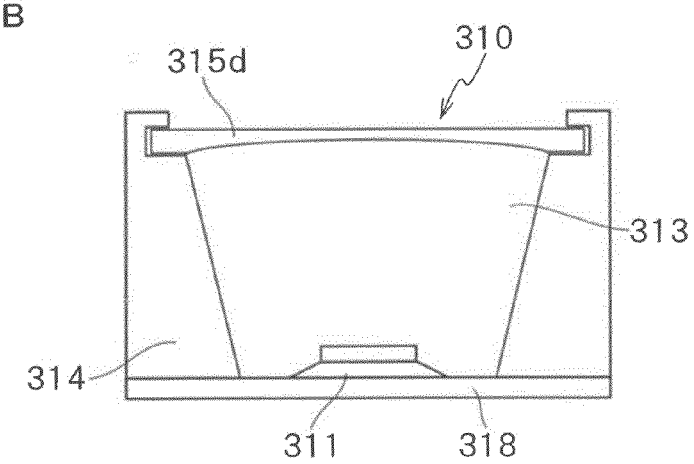
FIG. 24B is a diagram showing a luminescent display device provided with a cover member integral with a plano-concave lens.
Figure 24C:
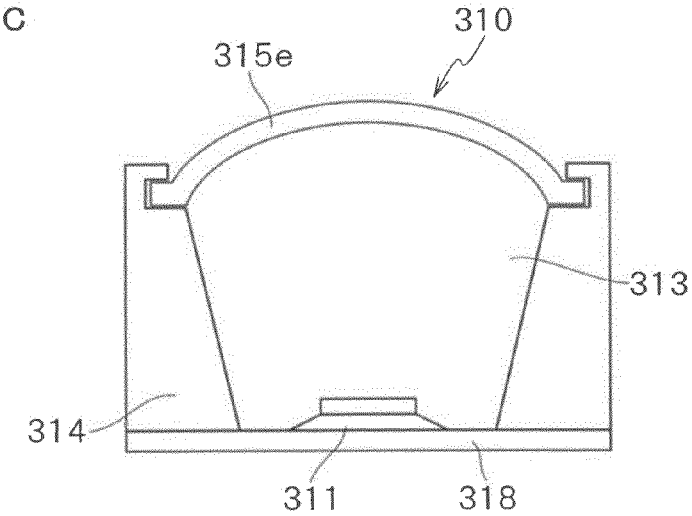
FIG. 24C is a diagram showing a luminescent display device provided with a cover member integral with a convex-meniscus lens.

Further, in the present invention, the cover member 315 may be provided with a lens. Further, by appropriately shaping the cover member 315, the cover member 315 may be provided integral with a lens. FIG. 24A is a diagram showing a cover member 315*c* integrated with a planoconvex lens. FIG. 24B is a diagram showing a cover member 315*d* integrated with a planoconcave lens. FIG. 24C is a diagram showing a cover member 315*e* integrated with a convex-meniscus lens. The form of lens provided for the cover member 315 is not limited to these examples, and the lens may be a bi-convex lens, for example. Further, the lens may be a concave lens such as a planoconcave lens, a bi-concave lens, or a concave-meniscus lens. Further, more than one type of lens, such as a convex lens and a concave lens, may be used together. The light incident on the cover member 315 diverges or converges, depending on the shape of the lens. Thus, by varying the shape of the lens provided for the cover member 315, the illumination area of the light emitted outside by the luminescent display device 310 can be varied.

Figure 25A:
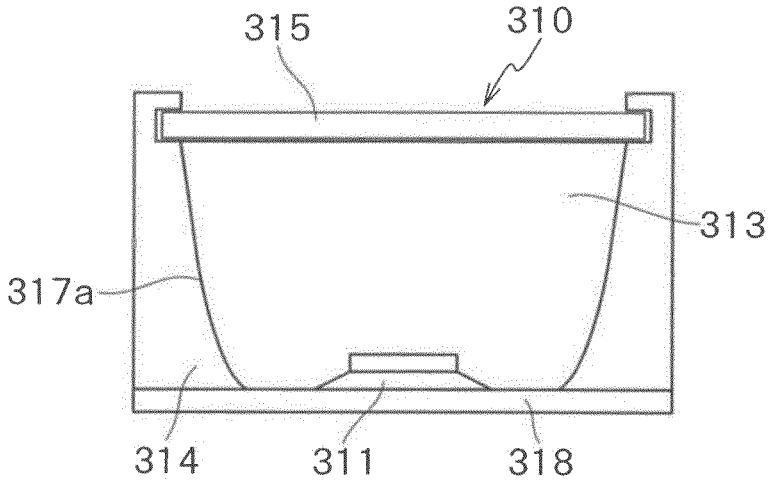
FIG. 25A is a diagram showing a luminescent display device provided with a housing having a parabolic reflecting surface.
Figure 25B:
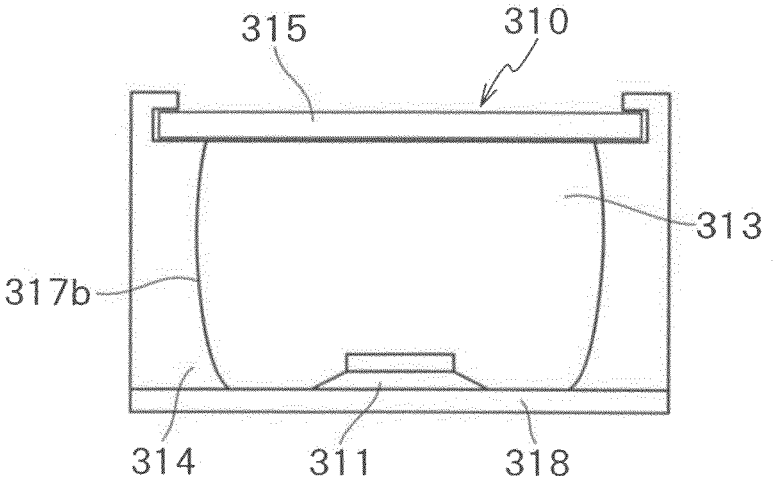
FIG. 25B is a diagram showing a luminescent display device provided with a housing having an ellipsoidal reflecting surface.

In the present embodiment, the reflecting surface 317 of the housing 314 is inclined with an increasing diameter toward the aperture 313. The invention is not limited to this example, however. For example, as shown in FIG. 25A, a reflecting surface 317*a* may be formed that is parabolic with an increasing diameter toward the aperture 313, or a reflecting surface 317*b* may be formed that is ellipsoidal, as shown in FIG. 25B.

In these cases, the varied shape of the reflecting surface 317 of the housing 314 varies the illumination area of the light emitted outside by the luminescent display device 310. That is, by appropriately varying the shape of the reflecting surface 317, the light can be shone over a predetermined illumination area.

In the present embodiment, the cover member 315 is detachably provided for the housing 314 by bending. However, the invention is not limited to this example. For example, internal thread portions may be provided on the inner periphery of the opening 313 of the housing 314, and external thread portions, to be screwed into the internal thread portions, may be provided on edges of the cover member 315. In this case, the cover member 315 can be detachably provided for the housing 314 by screwing the external thread portions of the cover member 315 into the internal thread portions of the housing 314.

In the present invention, the number of LEDs provided as the light emitting portions 311 in the luminescent display device 310 is not particularly limited. It can be decided by considering factors such as the required illumination area and brightness. LEDs having different emission wavelengths may be used as the light emitting portions 311.

As described, the light emitted by the light emitting portion 311 enters the aperture 313 formed in a predetermined portion of the housing 314 within a path of emergent light from the light emitting portion 311. The light entering the aperture 313 is attenuated as it passes through the cover member 315 provided to cover the aperture 313. Accordingly, the brightness of the light is reduced as the light passes through the cover member 315. By reducing the brightness of the light through the cover member 315, luminescent effects can be provided at the brightness suitable to the players, even when the light emitted by the light emitting portion 311 is too bright.

Further, the cover member 315 is detachably provided for the housing 314. By providing more than one cover member 315 having different attenuations for the transmitting light, the brightness of the emitted light from the luminescent display device can be appropriately adjusted. By the provision of the cover member 315 covering the aperture 313 of the housing 314, the players are prevented from directly touching the light emitting portion 311 through the aperture 313 of the housing 314. This reduces the risk of the light emitting portion 311 being damaged by the players.

By the housing 314, the light emitted by the light emitting portion 311 does not emerge outside except through the aperture 313. In this way, the light emitted by the light emitting portion 311 emerges only through the aperture 313, making it possible for the players to recognize the luminescent display device 310 emitting light.

(Third Embodiment)

The following will describe a luminescent display unit provided with at least one luminescent display device, according to another embodiment of the present invention.

Figure 26:
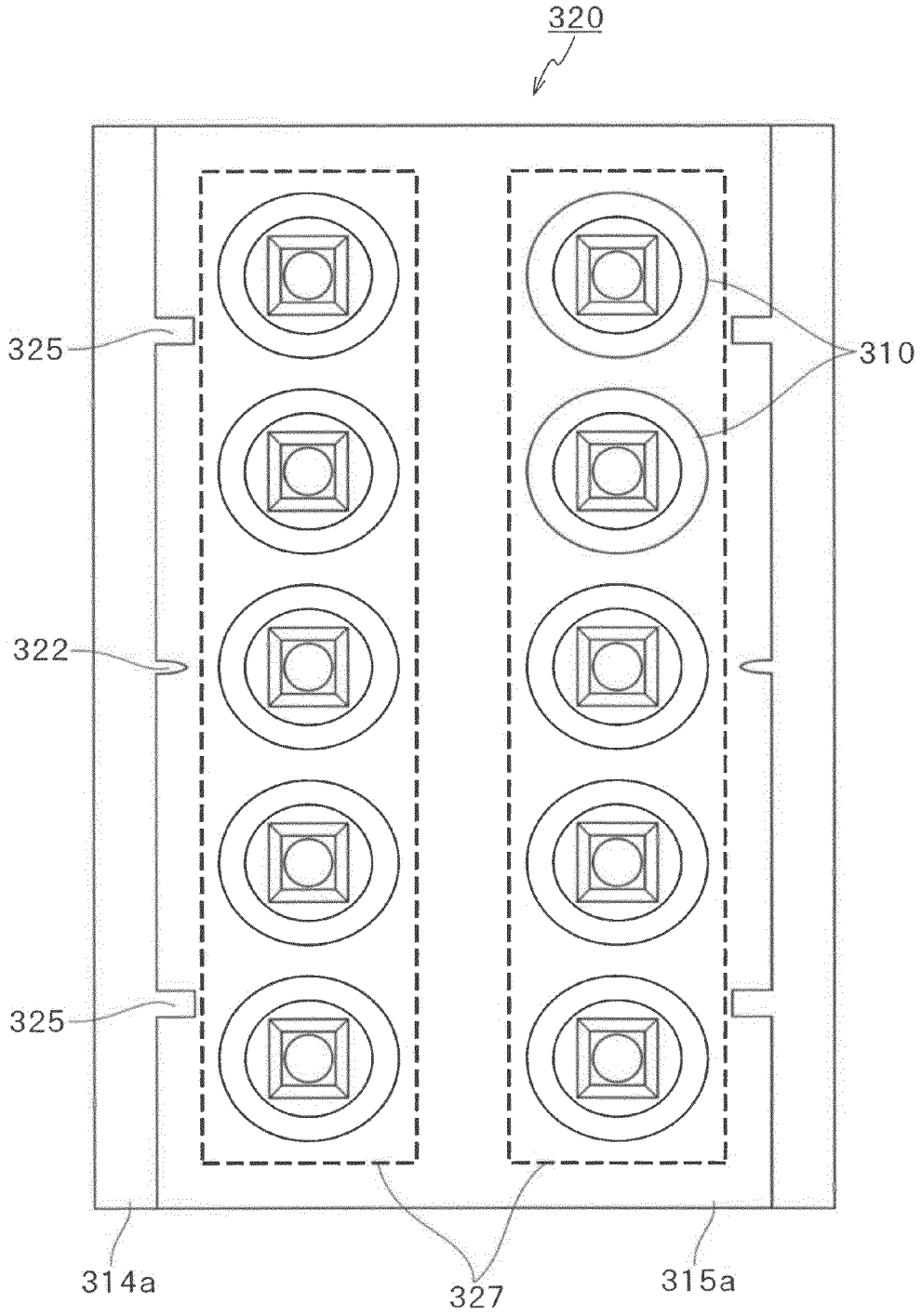
FIG. 26 is a front view of a luminescent display unit provided with luminescent display devices.
Figure 27:
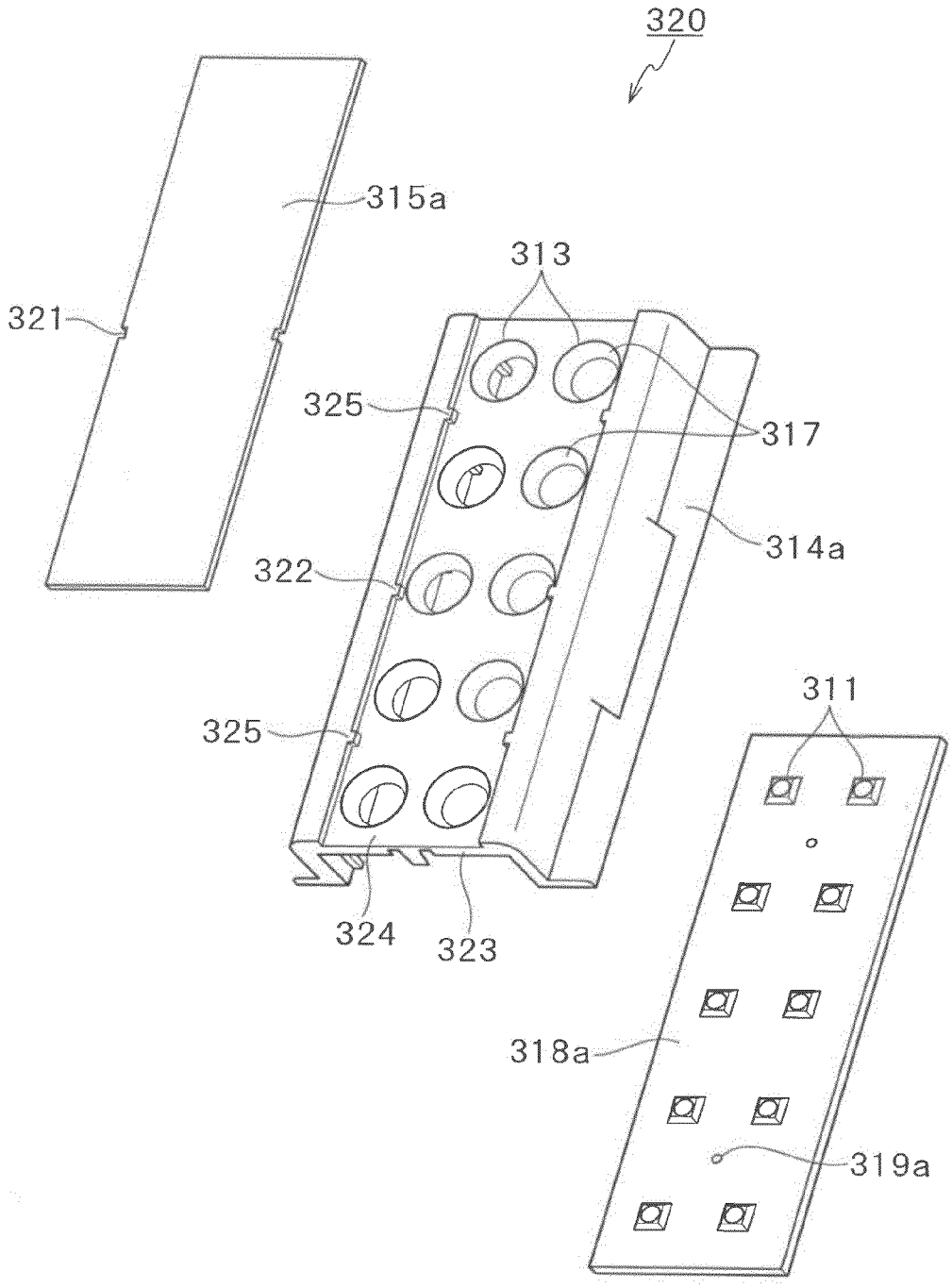
FIG. 27 is a front perspective view of a luminescent display unit provided with luminescent display devices.

As shown in FIG. 26, a luminescent display unit 320 includes a total of ten luminescent display devices 310 disposed in two columns along the longer side of the luminescent display unit 320. As shown in FIG. 27, the luminescent display unit 320 includes a housing 314*a*, which is an integral unit formed by the housings 314 for the luminescent display devices 310. The luminescent display unit 320 also includes a cover member 315*a*, which is an integral unit formed by the cover members 315 for the luminescent display devices 310. The light emitting portions 311 for the luminescent display devices 310 are disposed on a common, luminescent substrate 318*a*.

As shown in FIG. 27, an upper surface of the housing 314*a* has a recessed portion 324, fitted to the cover member 315*a*. The recessed portion 324 of the housing 314*a* includes hooked, locking portions 325 for locking the cover member 315*a*, and protrusions 322 for positioning the cover member 315*a*. The locking portions 325 and the protrusions are provided on side surfaces of the recessed portion 324. On the edges of the cover member 315*a*, indentations 321 are formed to be fitted to the protrusions 322. The cover member 315*a* can be bent to readily attach and detach it to and from the housing 314*a*.

In the present embodiment, the cover member 315*a* is detachably provided for the housing 314*a* by bending. However, the invention is not limited to this example. For example, a double-sided tape may be attached to the cover member 315*a* to detachably fasten the other side of the tape to a predetermined position of the recessed portion 324 of the housing 314*a*.

Figure 28:
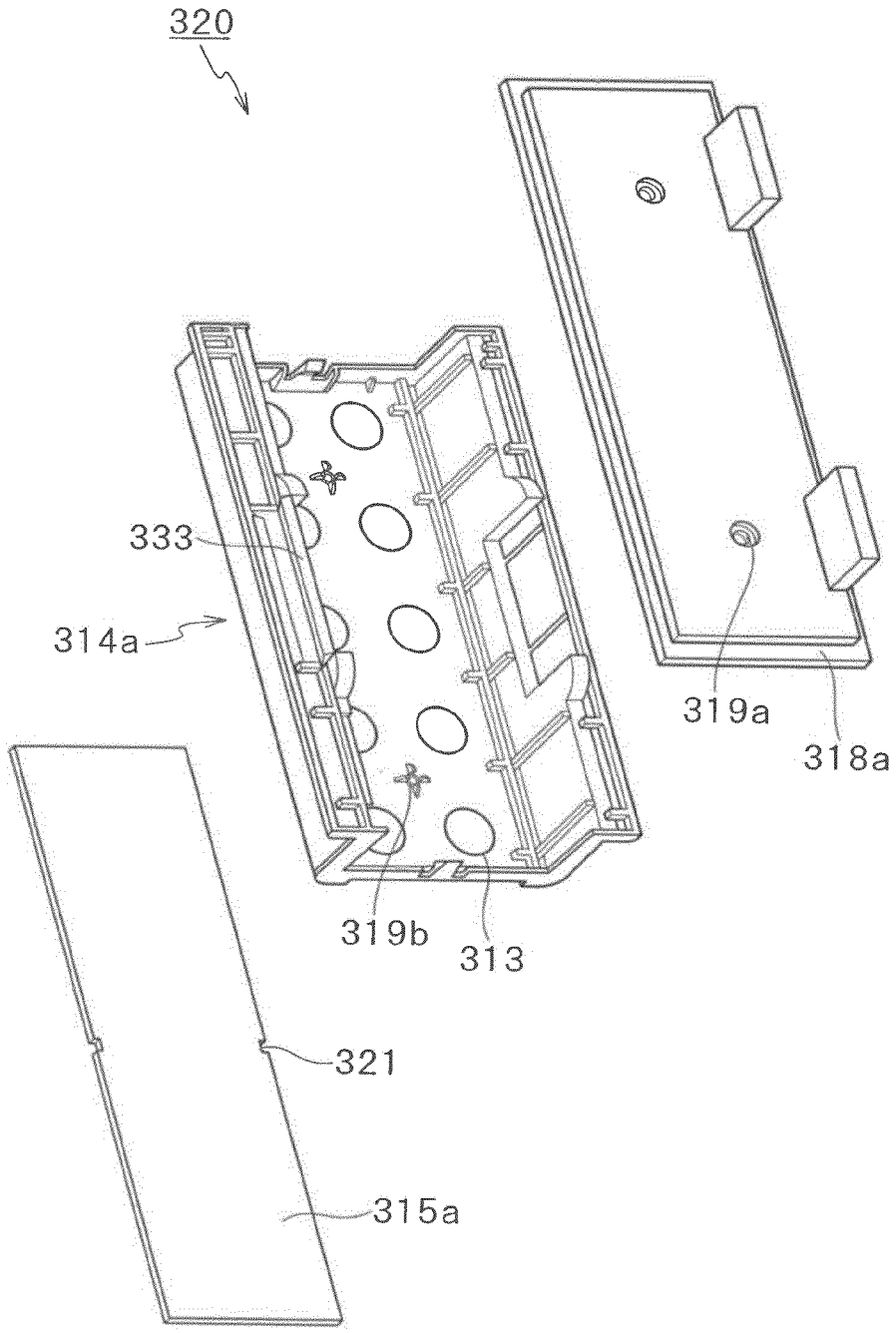
FIG. 28 is a rear perspective view of a luminescent display unit provided with luminescent display devices.

As shown in FIG. 28, screw openings 319*a* for inserting screws are formed at predetermined positions of the luminescent substrate 318*a*. The housing 314*a* has screw holes 319*b* to fasten the screws, on the opposite side of the screw openings 319*a* of the luminescent substrate 318*a*. The luminescent substrate 318*a* can be fastened to the housing 314*a* at a predetermined position by inserting the screws in the screw openings 319*a* and fastening to the screw holes 391*b*. In this way, a predetermined distance can be maintained between the light emitting portion 311 and the cover member 315*a*.

The distance between the light emitting portion 311 and the cover member 315*a* may be variable. In this case, the illumination areas of the luminescent display devices 310 provided in the luminescent display unit 320 can be adjusted when the cover member 315*a* has a lens.

The housing 314*a* includes a unit mount 333 used to hold the luminescent display unit 320 to a predetermined position of the gaming machine 1.

Figure 29:
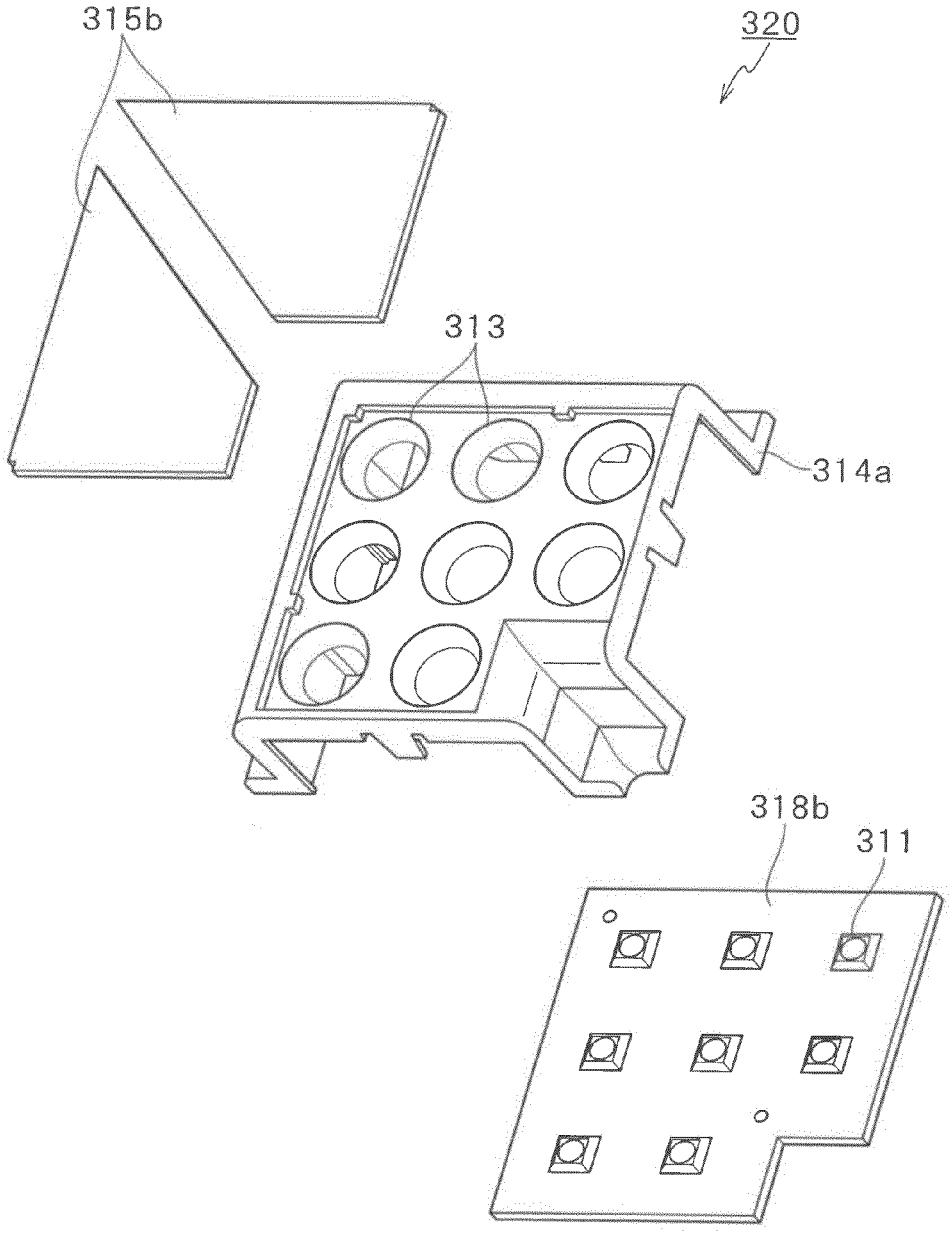
FIG. 29 is a front perspective view of a square luminescent display unit.
Figure 30A:
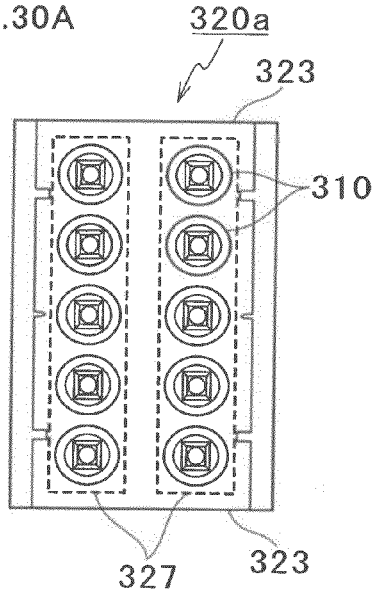
FIG. 30A is a diagram concerning a shape of a luminescent display unit.
Figure 30C:
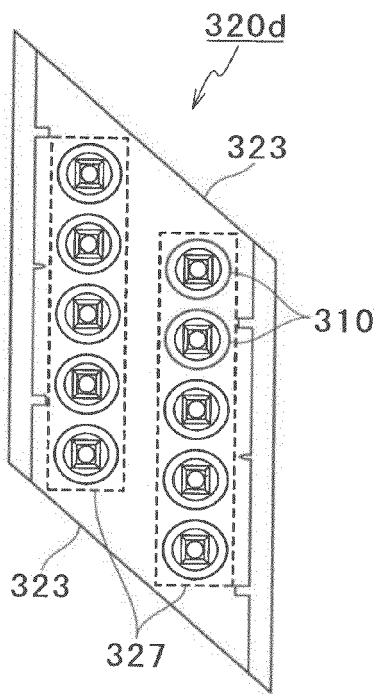
FIG. 30C is a diagram concerning a shape of a luminescent display unit.
Figure 30B:
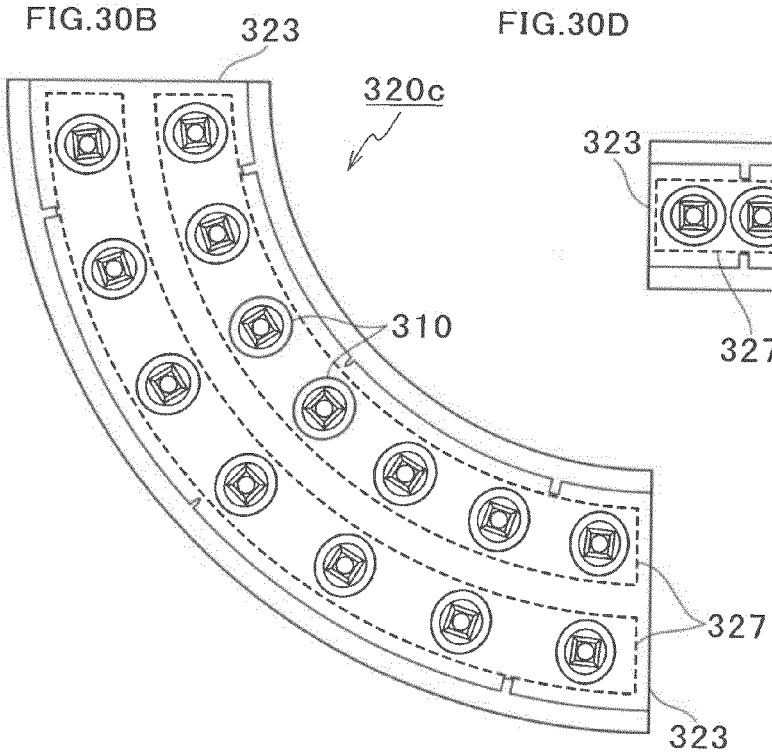
FIG. 30B is a diagram concerning a shape of a luminescent display unit.
Figure 30D:
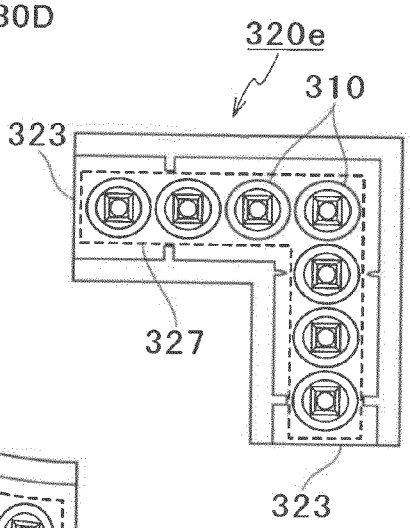
FIG. 30D is a diagram concerning a shape of a luminescent display unit.

The luminescent display unit 320 can have various shapes depending on, for example, the shape of the luminescent substrate 318*a* and the housing 314*a*, the positions of the light emitting portions 311 arranged on the luminescent substrate 318*a*, and the position of the apertures 313 formed in the housing 314*a*. For example, a luminescent display unit 320*b* may be provided that is square in shape, as shown in FIG. 29. Further, the luminescent display unit 320 may be provided as a luminescent display unit 320*a*, linear in shape as shown in FIG. 30A, a luminescent display unit 320*c* in the shape of a circular arc as shown in FIG. 30B, or a luminescent display unit 320*d*, whose end surfaces 323 are not right angle to a path 327 defined by the luminescent display devices 310, as shown in FIG. 30C. Further, in the present embodiment, the luminescent display unit 320 has two columns along the sides of the recessed portion 324 of the housing 314*a*. However, the structure of the luminescent display unit 320 is not limited to this, and, for example, a luminescent display unit 320*e* may be provided that has a single column along the sides of the recessed portion 324 of the housing 314*a*, as shown in FIG. 30D. The number of luminescent display devices 310 formed in the housing 314*a* is not particularly limited.

Figure 31:
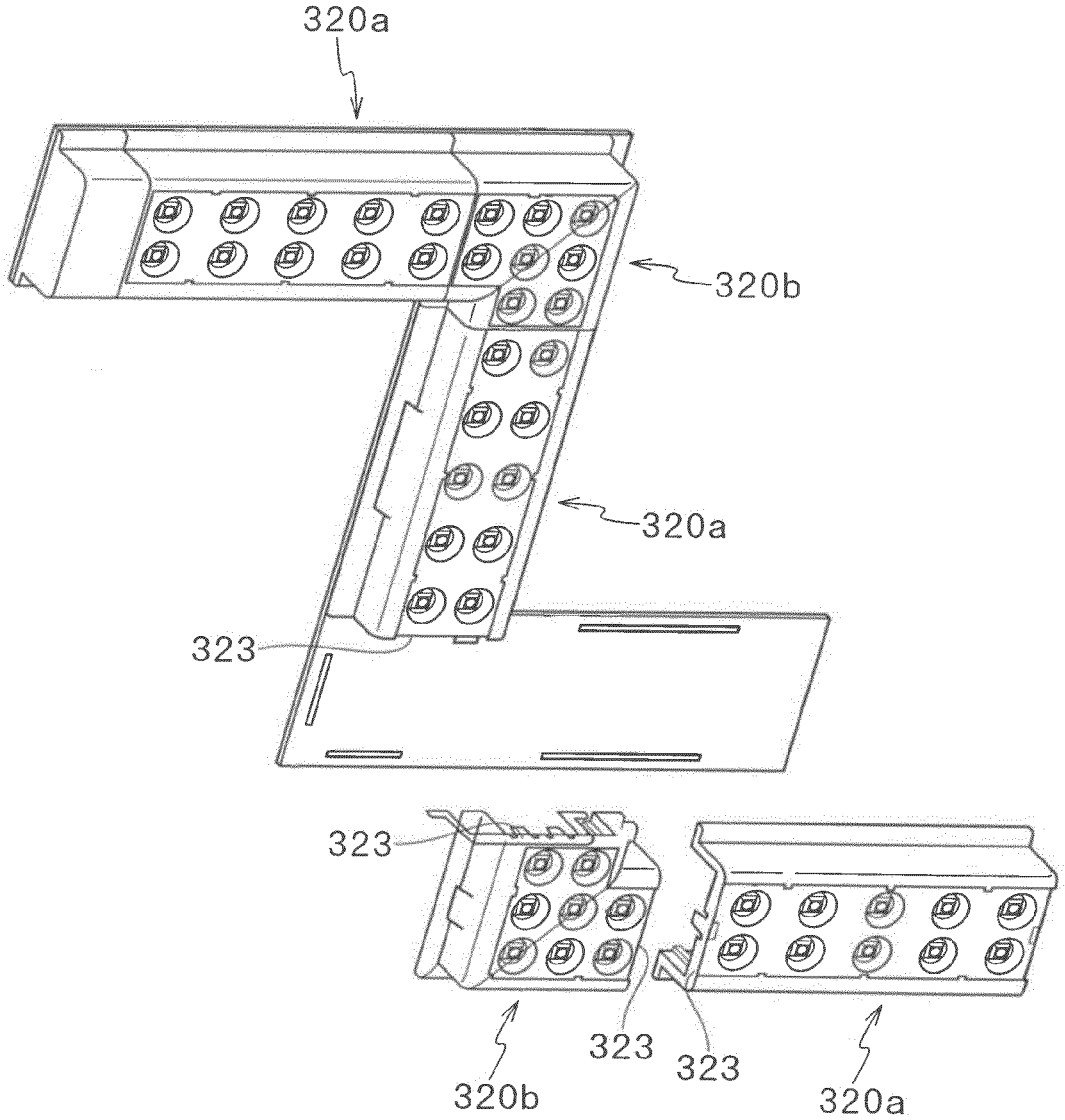
FIG. 31 is an explanatory diagram concerning a path defined by the luminescent display devices of luminescent display units.

In the luminescent display unit 320, the luminescent display devices 310 define a path 327, as shown in FIG. 26. The end surfaces 323 formed on the housing 314*a* of the luminescent display unit 320 may be adjoined to connect the paths 327 of the luminescent display devices 310, as shown in FIG. 31.

In the present embodiment, the cover member 315*a* covers all the apertures 313 of the housing 314*a*. The invention is not limited to this arrangement, however. For example, as shown in FIG. 29, two cover members 315*b* may be used to cover the apertures 313 of the housing 314*a*. Further, the same number of cover members 315 may be provided as the number of apertures 313 in the housing 314*a*, and the apertures 313 may be individually covered by these cover members 315. In this way, by varying the characteristics of the cover members 315, the brightness, wavelength, and other characteristics of the light emitted through the aperture 313 can be varied in each luminescent display device 310, even when the light emitting portions 311 provided in the luminescent display unit 320 have the same characteristics.

As described, the luminescent display unit 320 includes at least one luminescent display device 310, and a path 327 defined by the luminescent display devices 310. By using more than one luminescent display unit 320, the paths 327 defined by the luminescent display devices 310 can be connected to each other to form paths 327 of various shapes. Further, because the luminescent display unit 320 includes at least one luminescent display device 310, the number of steps required to mount the luminescent display device 310 to the gaming machine 1 can be reduced.

The cover member 315*a* is detachably provided for the housing 314*a*. In this way, the brightness, illumination area, wavelength, and other characteristics of the light emitted from the luminescent display device 310 can be appropriately adjusted when more than one cover member 315*a* is used that differs in characteristics such as attenuations for the transmitting light, the lens shape, and the amount of fluorescent material used.

(Forth Embodiment)

In the following, description is made as to a gaming machine provided with luminescent display devices, and a playing method thereof, according to one embodiment of the present invention.

Figure 32:
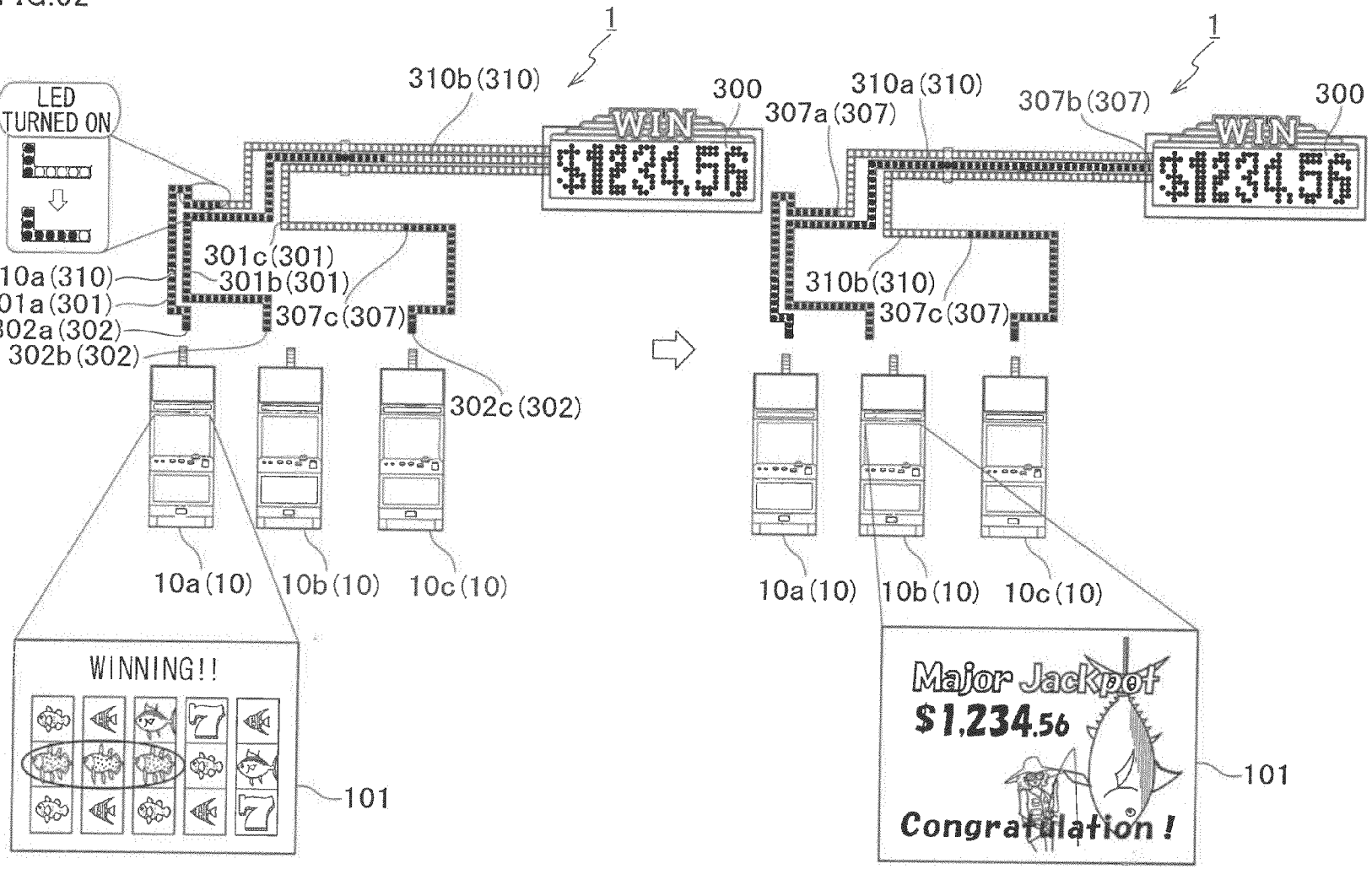
FIG. 32 is an explanatory diagram illustrating a gaming machine provided with luminescent display devices, and a playing method thereof, according to an embodiment of the present invention.

As illustrated in FIG. 32, a gaming machine 1 performs a playing method that includes the steps of: running a base game in which a payout according to a predetermined winning is awarded, independently in each gaming terminal 10, and awarding the payout according to a predetermined winning; running a bonus game, which awards a bonus payout more rewarding than the payout in the base game, based on a predetermined condition; causing light emitting portions 311 in luminescent display devices 310 to undergo state changes toward a bonus payout indicator 300, when a predetermined winning is met in any of the gaming terminals 10; instructing a terminal controller 100 of a gaming terminal 10, corresponding to a path 301 in which the light emitting portions 311 of the luminescent display devices 310 underwent state changes up to the bonus payout indicator 300, to award the bonus payout; and awarding the bonus payout based on the instruction from the center controller 200.

Figure 33:
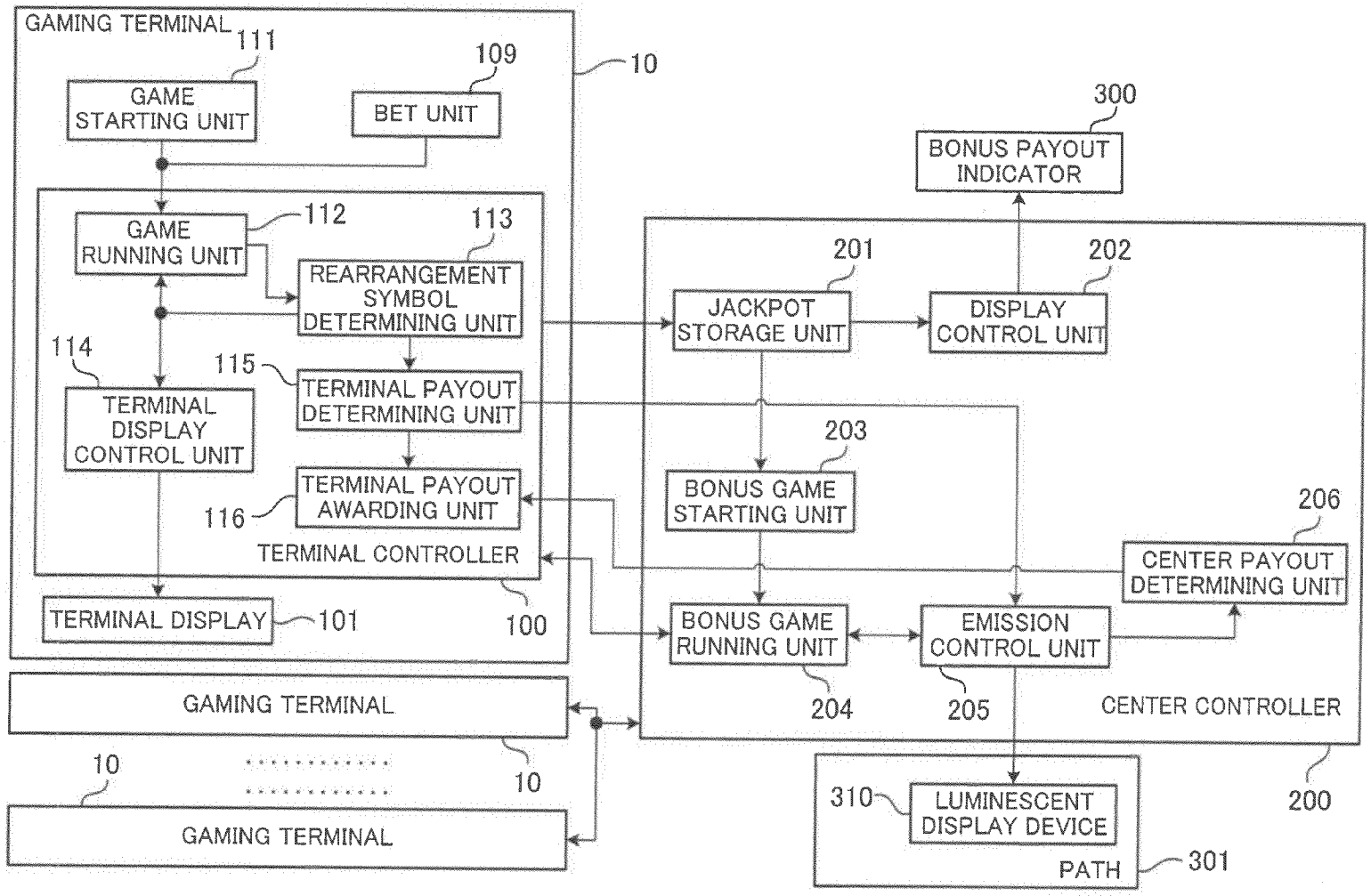
FIG. 33 is a block diagram of the gaming machine.

As illustrated in FIG. 33, the gaming machine 1 which executes the playing method has a bonus payout indicator 300, a center controller 200, gaming terminals 10, and a path 301. The path 301 is defined by the luminescent display devices 310. Each of the gaming terminals 10 includes a terminal display 101 and a terminal controller 100.

Figure 34:
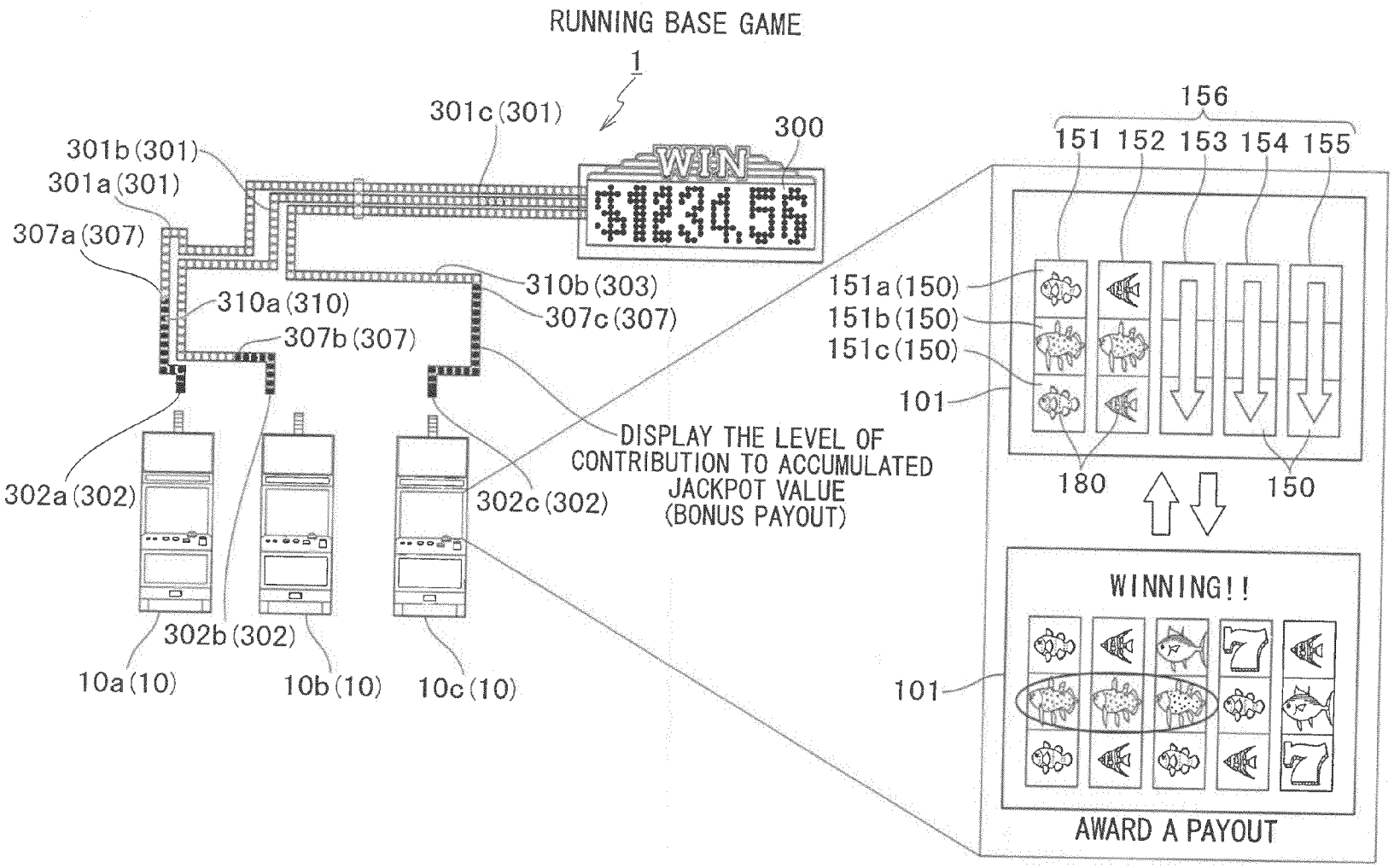
FIG. 34 is an explanatory diagram concerning a base game.

As illustrated in FIG. 34, the terminal display 101 has the arrangement areas 150, and symbols 180 are arranged in the arrangement areas 150.

The "arranging" in this specification means a state where the symbols 180 can be visually observed by a player. That is, the wording means a state where the symbols 180 are displayed in the arrangement areas 150, in FIG. 34. Arranging the symbols 180 again after dismissing the symbols 180 is referred to as "rearranging".

The terminal display 101 may have a mechanical structure adopting a reel device which rotates a reel to arrange the symbols 180. Alternatively, the terminal display 101 may have an electrical structure in which a video reel is displayed as an image and symbols 180 on a video reel are arranged in the form of an image. Further, the terminal display 101 may adopt a combination of the mechanical structure (reel) and the electrical structure (video reel) Examples of the electrical structure include a liquid crystal display device, a CRT (cathode-ray tube), a plasma display device, or the like. Further, the number of arrangement areas 150 is not limited. A specific structure of the terminal display 101 will be detailed later.

The bonus payout indicator 300 displays the amount of bonus payout awarded in a bonus game. In the example shown in FIG. 34, the bonus payout is displayed as a progressive jackpot amounting $1234.56. In this embodiment, the bonus payout indicator 300 is structured to include arrays of LEDs provided as light emitting portions. However, the bonus payout indicator 300 may be structured as a single liquid crystal display. Note that, the light emitting portions are not limited to LEDs as long as light is emitted.

The path 301 is formed by the array of luminescent display devices 310 connecting each gaming terminal 10 to the bonus payout indicator 300. As illustrated in FIG. 34, a path 301*a* extends from a position 302*a*, corresponding to a gaming terminal 10*a*, to the bonus payout indicator 300. Other paths 301*c* to 301*j* are formed in the same manner. In this manner, the paths 301 are provided to correspond to the gaming terminals 10. Note that, the path 301 may be defined by the luminescent display units 320 including the luminescent display devices 310.

The luminescent display device 310 includes a light emitting portion 311 for emitting light, a housing 314, provided with a circular aperture 313 formed in a predetermined portion within a path of emergent light from the light emitting portion 311, housing the light emitting portion 311, and a cover member 315, detachably provided to cover the aperture 313 of the housing 314, to attenuate the quantity of transmitting light emitted by the light emitting portion 311.

Here, the luminescent display device in which the light emitting portion 311 has undergone a state change from a non-lighting state to a lighting state is a luminescent display device 310*a*, and the luminescent display device in which the light emitting portion 311 has not undergone a state change is a luminescent display device 310*b*. The light emitting portions 311 provided in the luminescent display devices 310 are controlled to change states one after another, from the position 302 of each gaming terminal 10 to the bonus payout indicator 300. The light emitting portions 311 provided in the luminescent display devices 310 are not limited to LEDs as long as light is emitted. A state change in the luminescent display device 310 is not limited to from non-lighting to lighting, but may be from non-flashing to flashing, or may be a change to any color or different level of brightness. The luminescent display device 310 may be adapted to emit only one color; however, it is preferable that the luminescent display device 310 be capable of emitting more than one color to provide a wide variety of effects.

A current-position displaying luminescent display device 307 is one of the luminescent display devices 310*a* in which the light emitting members 311 have undergone a state change in each path, closest to the bonus payout indicator 300. The current-position displaying luminescent display device 307 indicates the progress of a game played by each player during a bonus game. The current-position displaying luminescent display device 307 may also indicate the contribution of each player to a jackpot in a base game.

[Terminal Controller 100]

A terminal controller 100 is configured to perform a first process and a second process. In the first process, a base game that awards a payout according to a predetermined winning is run in each gaming terminal 10, independently from the other gaming terminals 10, and the payout according to a predetermined winning is awarded. In the second process, a bonus payout is awarded according to an instruction from the center controller 200. In other words, the terminal controller 100 has a first processing unit and a second processing unit.

The terminal controller 100 is connected to the center controller 200 and is in communication with the center controller 200.

As illustrated in FIG. 33, the terminal controller 100 is connected to a game starting unit 111. The game starting unit 111 has a function of outputting a game start signal, in response to an operation by the player. The game start signal output is then input to a later-described game running unit 112.

Further, the terminal controller 100 is connected to a BET unit 109. The BET unit 109 has functions of receiving a bet entered through an operation by the player, and outputting a BET signal in response to the bet entered. The BET signal output is input to a later-described game running unit 112.

The terminal controller 100 includes: a game running unit 112, a rearrangement symbol determining unit 113, a terminal display control unit 114, a payout determining unit 115, and a payout awarding unit 116. The game running unit 112 runs a base game, triggered by a game start signal from the game starting unit 111. In the base game, symbols 180 are rearranged in the arrangement areas 150 of the terminal display 101. Further, the terminal controller 100 outputs a progressive signal, triggered by the game start signal. The progressive signal is a signal indicating a game value.

The rearrangement symbol determining unit 113 determines, based on the state of game run by the game running unit 112, a plurality of symbols 180 to be rearranged in the arrangement areas 150.

The terminal display control unit 114 displays the symbols 180 on the terminal display 101 under control of the game running unit 112 and on the basis of a determination of the rearrangement symbol determining unit 113. A detailed display state will be detailed later.

Further, the terminal controller 100 includes a terminal payout award determining unit 115 and a terminal payout awarding unit 116. The terminal payout award determining unit 115 determines whether to award a payout, based on a relation among the symbols 180 rearranged in the arrangement areas 150 of the terminal display 101. That is, the terminal payout award determining unit 115 determines whether a predetermined winning has been met. The terminal payout awarding unit 116 awards a payout based on the determination by the terminal payout award determining unit 115. The terminal payout awarding unit 116 also awards a payout based on an instruction from the center controller 200.

Meanwhile, each block of the terminal controller 100 may be realized with hardware, or with software as needed.

[Operation of Terminal Controller 100]

The following describes an operation of the terminal controller 100 in the above structure. First, the BET unit 109 accepts a BET entered through an operation by a player. Then, in response to the operation, the game starting unit 111 outputs a game start signal to cause the game running unit 112 to start a base game. When the base game is started, the rearrangement symbol determining unit 113 determines symbols 180 to be rearranged in the arrangement areas 150. The symbols 180 to be rearranged are determined at every base game. The symbols 180 determined by the rearrangement symbol determining unit 113 undergo an image processing in the terminal display control unit 114, and are displayed on the terminal display 101. The terminal display control unit 114 rearranges the symbols 180 in the arrangement areas 150, according to the arrangement determined.

The terminal payout award determining unit 115 determines whether a predetermined winning has been met, based on the relation between the symbols 180 rearranged in the arrangement areas 150. If it is determined that a predetermined winning has been met, the terminal payout awarding unit 116 awards a payout. In this manner, the terminal controller 100 in each gaming terminal 10 executes the first process, in which a base game that awards a payout according to a predetermined winning is run independently from the other gaming terminals 10, and in which the payout according to a predetermined winning is awarded.

Further, when a predetermined winning has been met, the terminal controller 100 transmits s winning signal, indicating that a predetermined winning has been met, to the center controller 200, based on a predetermined condition such as running of a bonus game as a shared game.

The terminal payout awarding unit 116 awards a bonus payout when instructed by the center controller 200 to award a bonus payout. In this manner, the terminal controller 100 executes the second process, in which a bonus payout is awarded based on an instruction from the center controller 200.

[Center Controller 200]

The center controller 200 is configured to perform a third process, a fourth process, and a fifth process. In the third process, a bonus game is run in which a bonus payout more rewarding than a base game payout is awarded, based on a predetermined condition. In the fourth process, the light emitting portions 311 provided in the luminescent display devices 310 are caused to undergo state changes toward the bonus payout indicator 300, when a predetermined winning is met in the gaming terminal 10. In the fifth process, an instruction to award a bonus payout is sent to the terminal controller 100 of the gaming terminal 10 corresponding to the path 301 in which the light emitting portions 311 of the luminescent display devices 310 have undergone state changes all the way up to the bonus payout indicator 300. In other words, the center controller 200 includes a third process unit, a fourth process unit, and a fifth process unit.

As illustrated in FIG. 33, the center controller 200 is connected to the terminal controller 100 and is in communication with the terminal controller 100.

The center controller 200 includes a jackpot storage unit 201, a display control unit 202, a bonus game starting unit 203, a bonus game running unit 204, an emission control unit 205, and a center payout determining unit 206.

The jackpot storage unit 201 stores and sums up a game value indicated by a progressive signal received from the terminal controller 100. The bonus game starting unit 203 outputs a bonus game start signal, when a predetermined condition is met. The bonus game start signal output is then input to a later-described bonus game running unit 204. For example, meeting the predetermined condition means a situation where a game value stored in the jackpot storage unit 201 sums up to a predetermined value or greater.

Triggered by a bonus game start signal received from the bonus game starting unit 203, the bonus game running unit 204 runs a bonus game, in which two or more players compete against one another for a jackpot through the gaming terminals.

The display control unit 202 causes the bonus payout indicator 300 to display the sum of jackpot values stored in the jackpot storage unit 201.

When a predetermined winning is met in a bonus game, the emission control unit 205 causes the light emitting portions 311 in the luminescent display devices 310 to under state changes toward the bonus payout indicator. The emission control unit 205 may control the luminescent display devices 310 such that the contribution of each gaming terminal 10 to the jackpot values summed in the jackpot storage unit 201 is displayed in the form of the state changes of the light emitting portions 311.

The center payout determining unit 206 determines whether the light emitting portions 311 provided in the luminescent display devices 310 of each path 301 have undergone state changes all the way up to the bonus payout indicator 300. The center payout determining unit 206, when it is determined that the light emitting portions 311 have undergone state changes all the way up to the bonus payout indicator 300, sends an instruction to award a bonus payout, to the terminal controller 100 of the gaming terminal 10 corresponding to the path 301 in which the state changes have occurred up to the bonus payout indicator 300.

Meanwhile, each block of the center controller 200 may be realized with hardware, or with software as needed.

[Operation of Center Controller 200]

The following describes an operation of the center controller 200 in the above structure. First, the game value is accumulatively stored in the jackpot storage unit 201. A bonus game starts when the stored game value sums up to a predetermined value or greater. In this manner, based on a predetermined condition, the center controller 200 executes the third process that runs a bonus game in which a bonus payout more rewarding than a base game payout is awarded.

The center controller 200 receives a winning signal from the terminal controller 100, every time a predetermined winning is met in the gaming terminal 10. Upon receipt of the winning signal, the fourth process is performed in which the light emitting portions 311 of the luminescent display devices 310 are caused to undergo state changes toward the bonus payout indicator 300.

When the state changes have occurred in the light emitting portions 311 of the luminescent display devices 310 all the way up to the bonus payout indicator 300, the center payout determining unit 206 sends an instruction to award a bonus payout, to the terminal controller 100 of the gaming terminal 10 corresponding to the path 301 in which the state changes have occurred up to the bonus payout indicator 300. In this manner, the center controller 200 performs the fifth process, in which an instruction to award a bonus payout is sent to the terminal controller 100 of the gaming terminal 10 corresponding to the path 301 in which the light emitting portions 311 of the luminescent display devices 310 have undergone state changes all the way up to the bonus payout indicator 300.

As is clear from the description of the foregoing operations, the gaming machine 1 realizes a playing method including: a step in which a base game that awards a payout according to a predetermined winning is run in each gaming terminal 10, independently from the other gaming terminals 10, and in which the payout according to a predetermined winning is awarded; a step in which bonus game is run that awards a bonus payout more rewarding than a base game payout, based on a predetermined condition; a step in which, when a predetermined winning is met in the gaming terminal 10, the light emitting portions 311 provided in the luminescent display devices 310 are caused to undergo state changes toward the bonus payout indicator 300; a step in which an instruction to award a bonus payout is sent to the terminal controller 100 of the gaming terminal 10 corresponding to the path 301 in which the light emitting portions 311 in the luminescent display devices 310 have undergone state changes all the way up to the bonus payout indicator 300; and a step in which a bonus payout is awarded based on the instruction from the center controller 200.

According to this playing method, the base game is run in each gaming terminal 10, independently from the other gaming terminals 10, and the payout according to a predetermined winning is awarded. Based on a predetermined condition, a bonus game is run that awards a bonus payout more rewarding than the payout awarded in the base game. When a predetermined winning is met, the light emitting portions 311 provided in the luminescent display devices 310 are caused to undergo state changes toward the bonus payout indicator 300. A bonus payout is awarded in the gaming terminal 10 corresponding to the path 301 including the light emitting portions 311 that have undergone state changes all the way up to the bonus payout indicator 300.

(Running Base Game)

The following specifically describes an example of a base game in the gaming machine 1 and the playing method. Note that the following example deals with a case where the terminal display 101 adopts a video reel and arranges symbols on a video reel, as illustrated in FIG. 34.

As illustrated in FIG. 34, a matrix 156 is in the center of the terminal display 101. The matrix 156 includes symbols 180, which are scroll displayed. The display windows 151 to 155 are respectively divided into upper stages 151*a* to 155*a*, central stages 151*b* to 155*b*, and lower stages 151*c* to 155*c*. The symbols 180 are stopped (arranged) in the stages 151*a* to 155*a*, 151*b* to 155*b*, and 151*c* to 155*c*, respectively. The matrix 156 is a symbol matrix including five columns/three rows. The matrix 156 however is not limited to the one with the five-columns/three-rows.

As illustrated in FIG. 34, the terminal display 101 variably displays symbols 180 when a base game is started in the gaming terminal 10. When this variable-displaying of symbols 180 stops, symbols 180 are rearranged in the arrangement areas 150. Then, when a winning is met according to a relation among the rearranged symbols 180, a payout according to this winning is awarded.

Note that, part of the bet made by the player is accumulated in the form of a jackpot value, every time a base game is started. The jackpot value so accumulated is displayed in the bonus payout indicator 300, as illustrated in FIG. 34. As also shown in FIG. 34, the accumulation of jackpot values may be displayed, for example, by changing the state of the light emitting portions 311 in the luminescent display devices 310 of each path 301 according to the level of contribution to the accumulated jackpot value, so that the players can visually observe the extent of their contribution.

(Running Bonus Game)

The following specifically describes an example of a bonus game in the gaming machine 1 and the playing method.

A bonus game is started when the accumulated jackpot value exceeds a certain value. In a bonus game, the symbols 180 are rearranged in the matrix 156 in each gaming terminal 10. When a predetermined winning is met by the rearrangement of the symbols 180, the state of the light emitting portions 311 in the luminescent display devices 310 is changed one after another, from the position 302 corresponding to the gaming terminal 10 in which the winning has occurred, toward the bonus payout indicator 300. This operation is repeated until the light emitting portions 311 of the luminescent display devices 310 in any of the paths 301 complete the state changes all the way up to the bonus payout indicator 300.

When the light emitting portions 311 complete state changes all the way up to the bonus payout indicator 300 as shown in FIG. 32, a jackpot is awarded as a bonus payout in the gaming terminal 10 corresponding to the path 301 in which the state changes have completed. In the example shown in FIG. 32, the light emitting portions 311 in the path 301*b* (301) have undergone state changes up to the bonus payout indicator 300. As such, the jackpot is awarded in the gaming terminal 10*b* (10) corresponding to the path 301*b* (301).

In an embodiment of the present invention, the state of the light emitting portions 311 is changed every time a predetermined winning is met, from the position 302 corresponding to each gaming terminal 10 toward the bonus payout indicator 300. As such, the difficulty of hitting a jackpot (winning percentage of a bonus game) is the same for all paths 301. However, the invention is not limited to this particular example. For example, a bonus game may be started in a state where the light emitting portions 311 reflect the contribution to a jackpot in a base game. More specifically, a bonus game may be started in a state where the current-position displaying luminescent display device 307 has approached the bonus payout indicator 300, i.e., a state more advantageous to hit a jackpot. In this way, a player making more bets in a base game is able to start a game from the position more advantageous to hit a jackpot, which is awarded as a bonus payout in a bonus game. Thus, the players play a base game with the bonus game in mind, and therefore can sustain their interest.

[Symbol, Combination, or the Like]

A terminal display 101 has a matrix 156 including symbol columns each having twenty two symbols 180 as illustrated in FIG. 35. To each of the symbols constituting the columns is given one of code numbers 0 to 21. Each symbol column is made from a combination of "Angelfish", "Clownfish", "7", "Tuna", "Coelacanth", and "Bonus".

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five columns and three rows. When a BET button and a start button are sequentially pressed in this order to start a game, symbols constituting the symbol matrix start to scroll. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages include: a state where coins corresponding to the scatter symbols are paid out, a state where the number of coins to be paid out is added to a credit, a state where a bonus game is started.

Here, a bonus game is a gaming state which provides a larger advantage than a base game. In this embodiment, the bonus game is a jackpot game. No particular limitation is put on the bonus game, as long as it is a gaming state advantageous to the player, that is, it is more advantageous than the base game. For example, the bonus game may include a state where more game media are obtainable than in the base game, a state where a game medium is obtainable with higher probability than in the base game, a state where a game medium is less consumed than in the base game, and the like. Specifically, a free game, a second game, a feature game, and the like may be mentioned as examples of the bonus game.

[Mechanical Structure of Gaming Machine 1]

Next, the following describes a specific example of mechanical and electrical structures of the gaming machine 1 thus structured.

A gaming machine 1 is placed in a gaming facility such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 36:
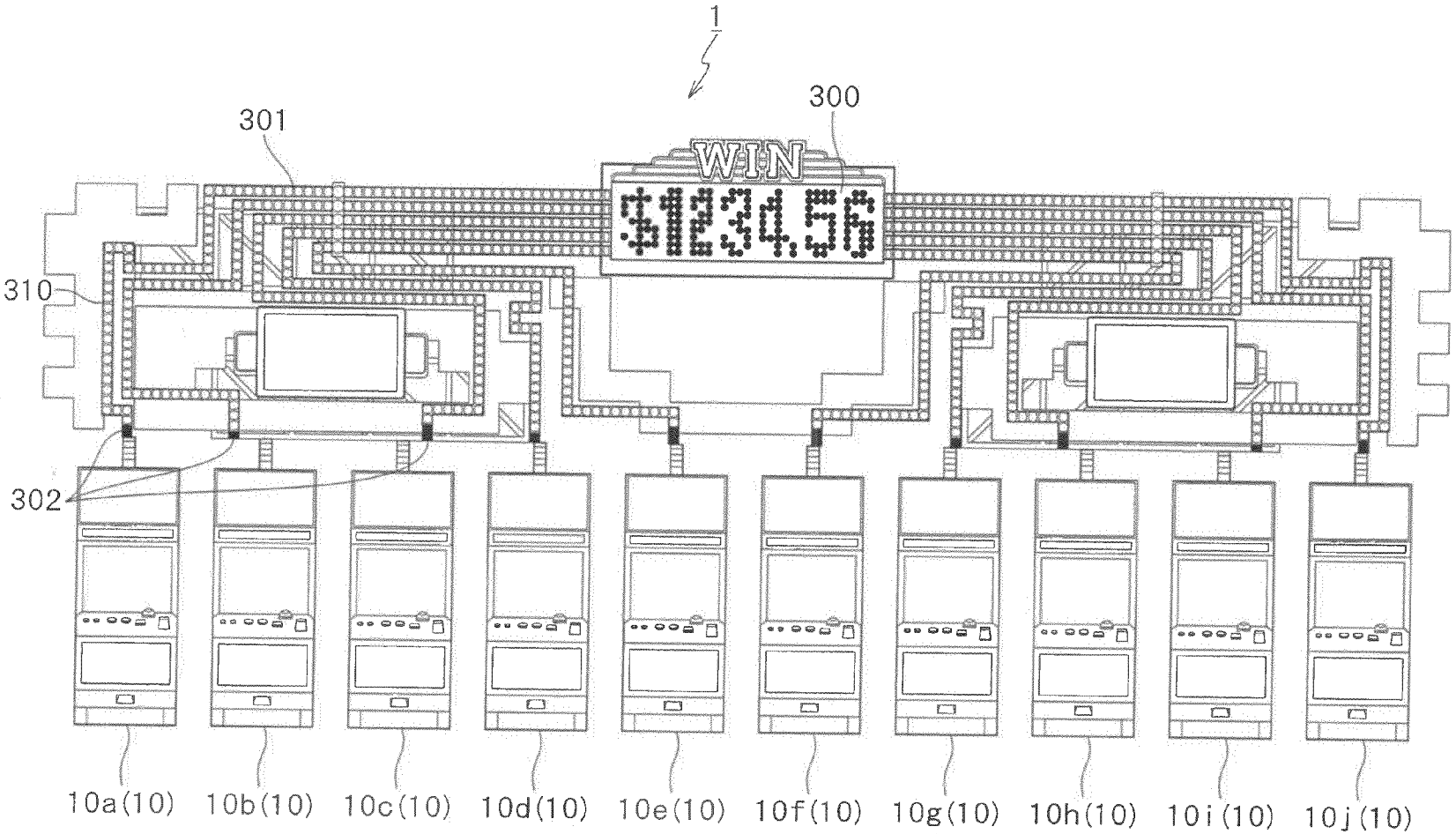
FIG. 36 is a front view illustrating an external appearance of the gaming machine.

As illustrated in FIG. 36, the gaming machine 1 includes: a gaming terminal 10 that independently runs a base game; a center controller 200, connected to and in communication with the gaming terminal 10, that runs a bonus game; a bonus payout indicator 300 that displays the amount of a bonus payout awarded in a bonus game; and paths 301 including luminescent display devices 310 connecting each gaming terminal 10 to the bonus payout indicator 300.

Figure 37:
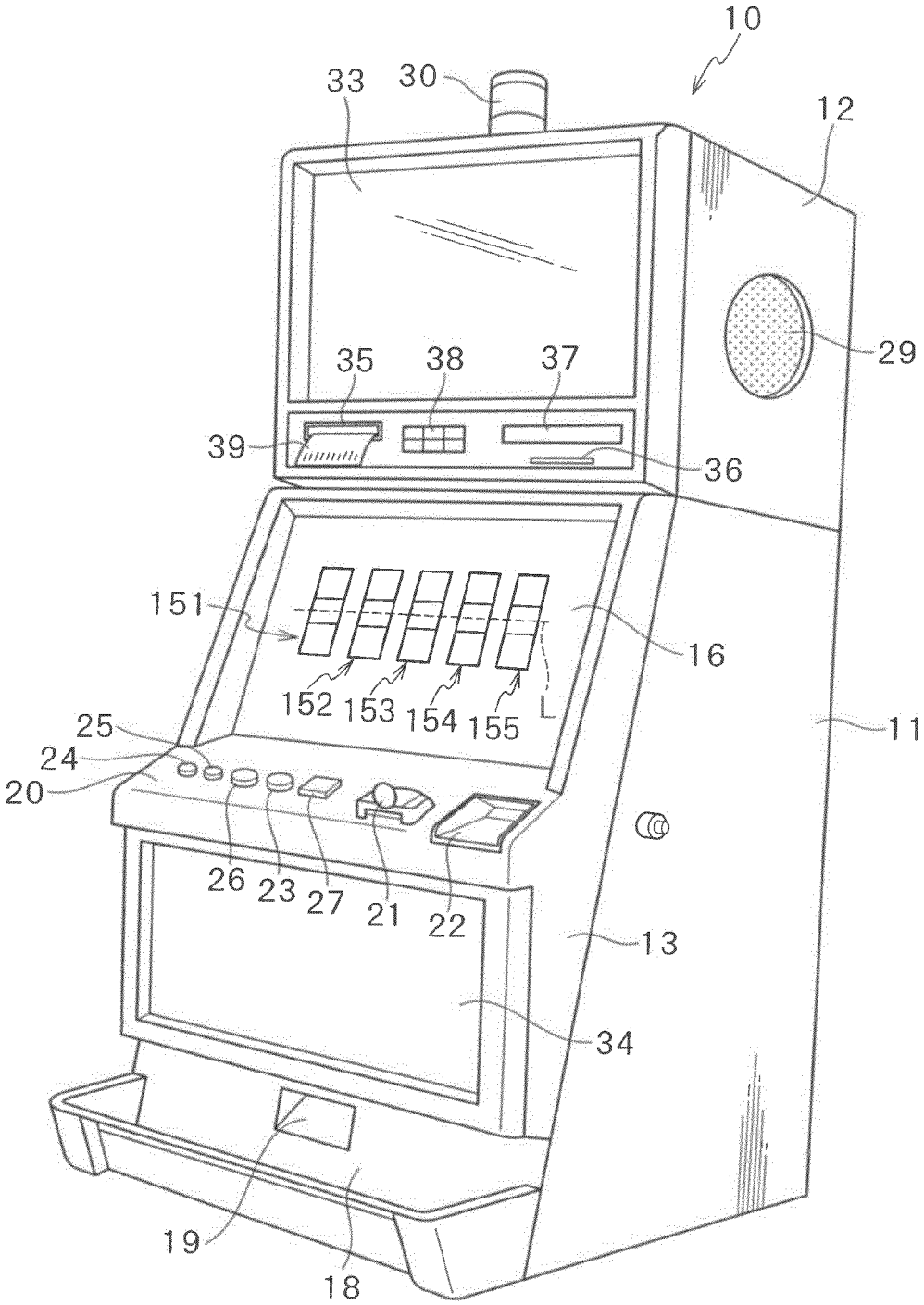
FIG. 37 is a perspective view illustrating an external appearance of a gaming terminal.

As illustrated in FIG. 37, the gaming terminal 10 has a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various information. The lower image display panel 16 displays display windows 151 to 155 (matrix 156) for arranging therein symbols 180. Further, the lower image display panel 16 displays as needed various information and effect images related to a game.

The present embodiment deals with a case where the lower image display panel 16 electrically displays symbols 180 arranged in five rows/three columns. However, the present invention is not limited to this.

The lower image display panel 16 displays a single activated payline L. Note that the number of pay lines L may be two or more. When the number of pay lines L is two or more, the number of pay lines L activated may be determined according to a predetermined condition, such as the number of coins placed as a BET.

Note that the lower image display panel 16 may have a credit value indicator and a payout value indicator. The credit value indicator displays a total value (hereinafter also referred to as total credit value) which a gaming terminal 10 can pay out to a player. When symbols stopped along a pay line L form a winning combination, the payout value indicator displays the number of coins to be paid out.

Further, scatter symbols may be adopted, and the number of coins to be paid out may be determined, according to the number of scatter symbols displayed on the matrix 156. Note that the pay line L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 includes: a spin button 23, a change button 24, a cashout button 25, a 1-BET button 26, and a maximum BET button 27. The spin button 23 is for inputting an instruction to start symbol scrolling. The change button 24 is used to ask a staff person in the gaming facility for exchange of money. The cashout button 25 is for inputting an instruction to pay out coins corresponding to the total credit-value into the coin tray 18.

The 1-BET button 26 is used for betting one coin out of those corresponding to the total credit value. The maximum BET button 27 is used for betting, out of those corresponding to the total credit value, a maximum number of coins (e.g., fifty coins) which can be bet in one game.

The bill validator 22 validates whether bill is genuine or not and receives the genuine bill into the cabinet 11. Note that the bill validator 22 is capable of reading a barcode attached to a later-mentioned ticket 39 having a barcode (hereinafter simply referred to as ticket 39). When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the top box 12 has a speaker 29 for performing an audio output. Below the upper image display panel 33 are provided a ticket printer 35, a card reader 36, a data displayer 37, and a keypad 38. The ticket printer 35 prints, onto a ticket, a barcode having encoded data containing credit-value, date and time, identification number of a gaming terminal 10 or the like, thereby issuing a ticket 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38, for example. The keypad 38 is for entering instructions or data relating to issuing of a ticket or the like.

[Electrical Structure of Gaming Machine 1]

Figure 38:
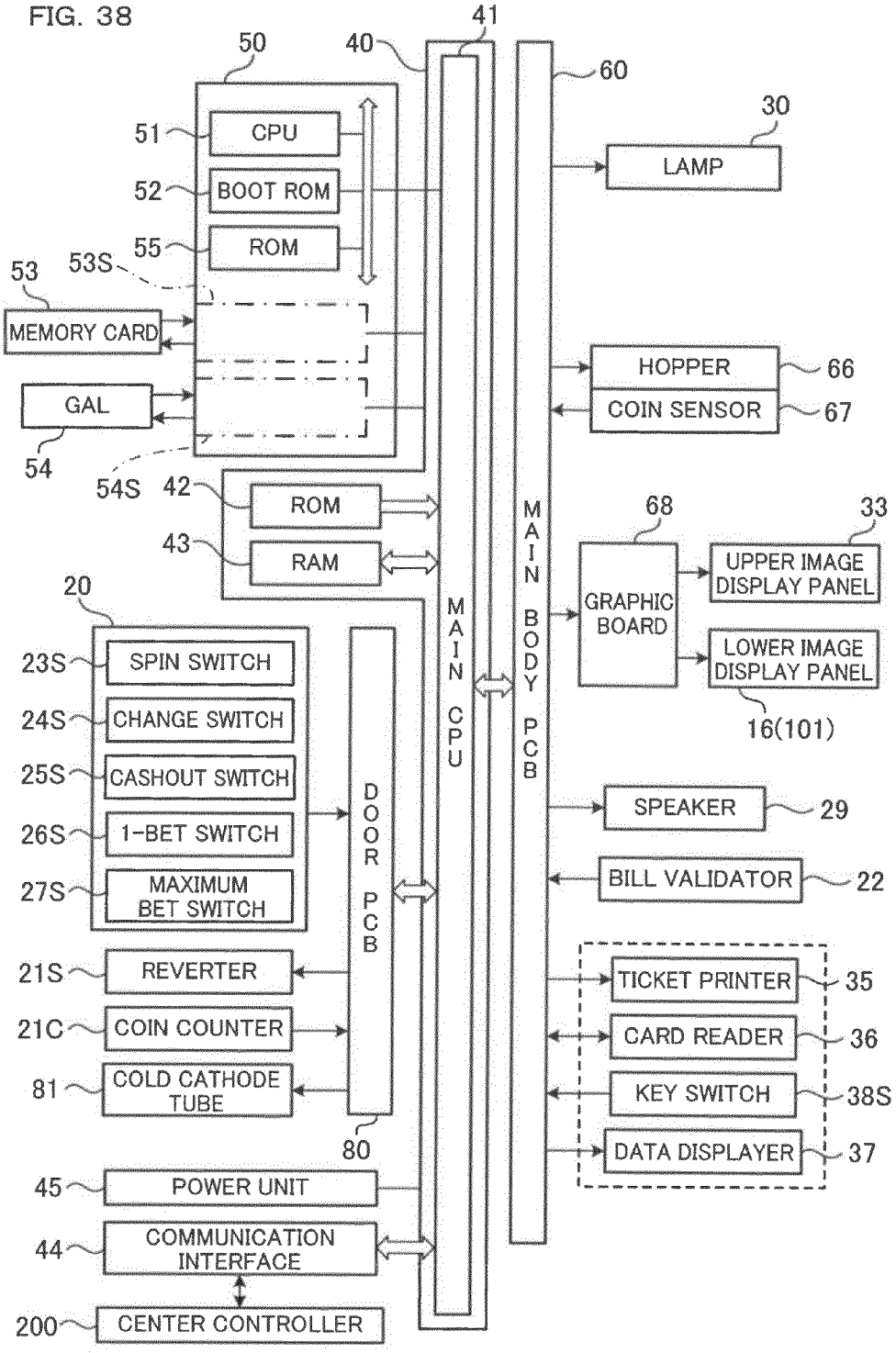
FIG. 38 is a block diagram illustrating an electrical structure of the gaming terminal.
Figure 39:
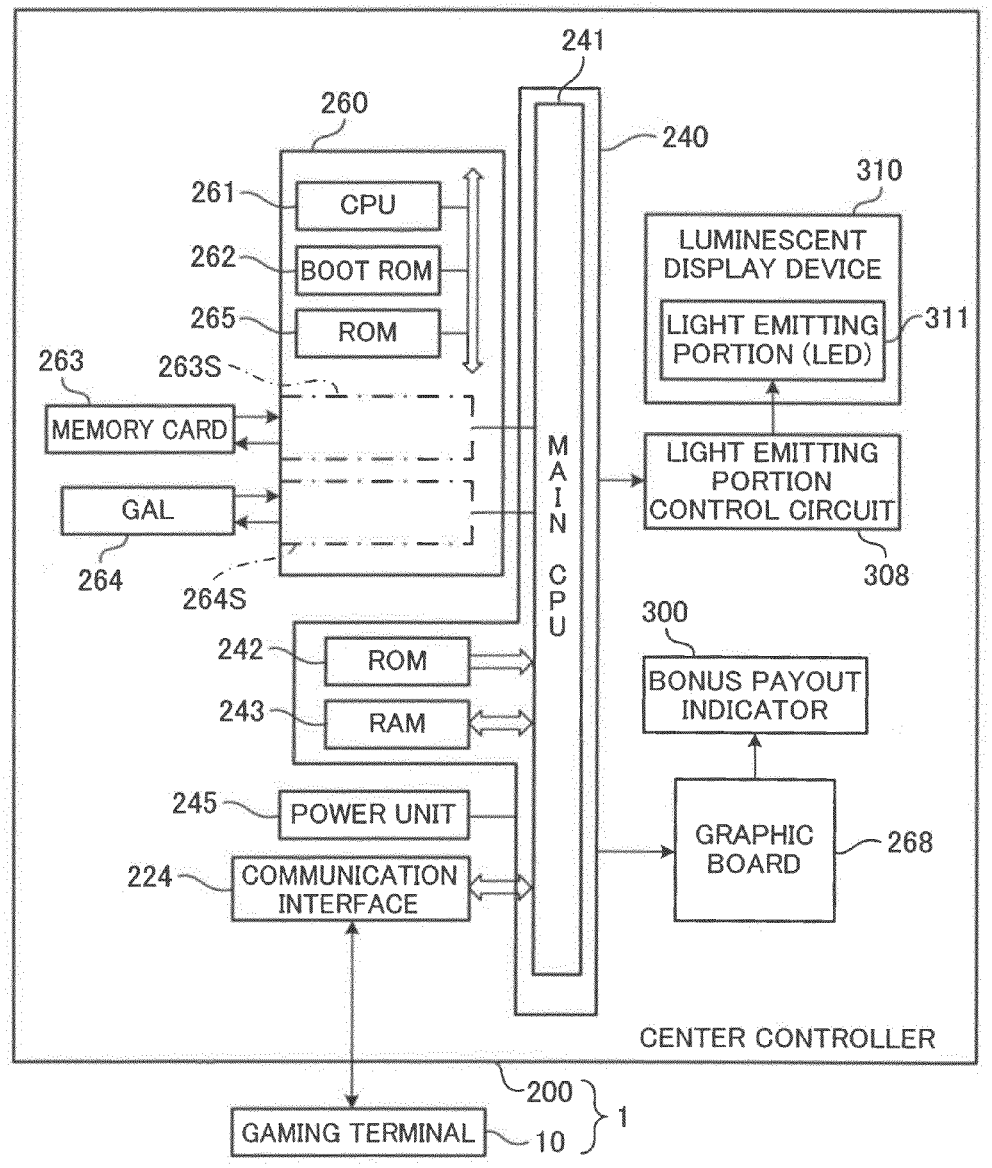
FIG. 39 is a block diagram illustrating an electrical structure of a center controller.

FIGS. 38 and 39 are block diagrams each illustrating an electrical structure of the entire gaming machine 1.

[Electrical structure of Gaming Terminal 10]

FIG. 38 is a block diagram showing an electrical structure of the gaming terminal 10. As illustrated in FIG. 38, the cabinet 11 includes a control unit having a terminal controller 100. As illustrated in FIG. 38, the control unit includes a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random numerical value allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 34 and an associated range of random numerical values. This data is transferred to the RAM 43 of the motherboard 40, at the time of running a game programs.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via the input port, it outputs data corresponding to the input data from its output port. This data from the output port is the payout rate setting data described above.

IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display window 151 to 155.

In other words, the main CPU 41 serves as an arrangement controller which arranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer and the like equipped in the gaming facility, through the network (communication line). The communication interface 44 is also for communicating with the center controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores the result of the arithmetic process in the RAM 43, or transmits a control signal to the various devices and units to control them based on the result.

The main body PCB 60 is connected with a lamp 30, a hopper 66, a coin sensor 67, a graphic board 68, the speaker 29, a bill validator 22, a ticket printer 35, a card reader 36, a key switch 38S, and a data displayer 37.

The lamp 30 is turned on/off on the basis of a control signal from the main CPU 41.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on the bill and takes only those recognized as to be genuine into the cabinet 11. When taking in a genuine bill, the bill validator 22 outputs an input signal indicating the value of the bill to the main CPU 41. The main CPU 41 stores into the RAM 43 a credit-value corresponding to the value of the bill indicated by the signal.

The ticket printer 35 prints a barcode onto a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the key pad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a maximum BET switch 27S associated with the maximum BET button 27. Each of the switches 23S to 27S outputs a signal to the main CPU 41, when a player presses the associated button.

The coin counter 21C is provided within the coin insertion slot 21, and identifies whether the coin inserted into the coin insertion slot 12 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full with the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

[Electrical Structure of Center Controller 200]

FIG. 39 is a block diagram illustrating an electrical structure of the center controller 200. The center controller 200 is provided therein with a control unit. As illustrated in FIG. 39, the control unit includes a motherboard 240, a gaming board 260, an actuator, or the like.

The gaming board 260 has the same structure as that of the gaming board 50. The motherboard 240 has the same structure as that of the motherboard 40. The communication interface 244 communicates with the terminal controller 100 through a communication line.

The graphic board 268 has the same structure as that of the graphic board 68, except that the graphic board 268 controls displaying of the bonus payout indicator 300 based on a control signal from the main CPU 241.

A light emitting portion control circuit 308 controls the operation of the LEDs provided as the light emitting portions 311 in the luminescent display devices 310, and changes the state of the light emitting portions 311 based on the control signal output from the main CPU 241.

[Operation of Gaming Machine 1: Boot Process]

The following describes a boot process routine which takes place in the gaming machine 1. Upon powering on the gaming machine 1, a boot process routine shown in FIG. 40 starts in: the mother board 240 and gaming board 260 in the center controller 200, and in the mother board 40 and the gaming board 50 in the terminal controller 100. The memory cards 53 and 263 are assumed to be inserted into the card slots 53S and 263S of the gaming boards 50 and 260, respectively. Further, the GALs 54 and 264 are assumed to be attached to the IC sockets 54S and 264S, respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262, respectively. Then, preliminary authentication is performed according to the read out programs so as to confirm and authenticate that no modification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derive a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each check what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the CPUs 41 and 241 each read out four bytes of data constituting the game program and the game system program at one time. Next, according to the authentication programs stored in the RAMs 43 and 243, the CPUs 41 and 241 authenticate the game program and the game system program read out to confirm and prove that these programs are not modified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 264 attached to the IC socket 54S * 264S, and read out payout rate setting data from the GALs 54 and 264, respectively. The payout rate setting data read out is then written and stored in the RAMs 43 and 243 (S7).

Next, the main CPUs 41 and 241 read out, via the PCI buses, country identification information stored in the ROMs 55 and 265 of the gaming boards 50 and 265, respectively. The country identification information read out is then stored in the RAMs 43 and 243 (S8).

Figure 41:
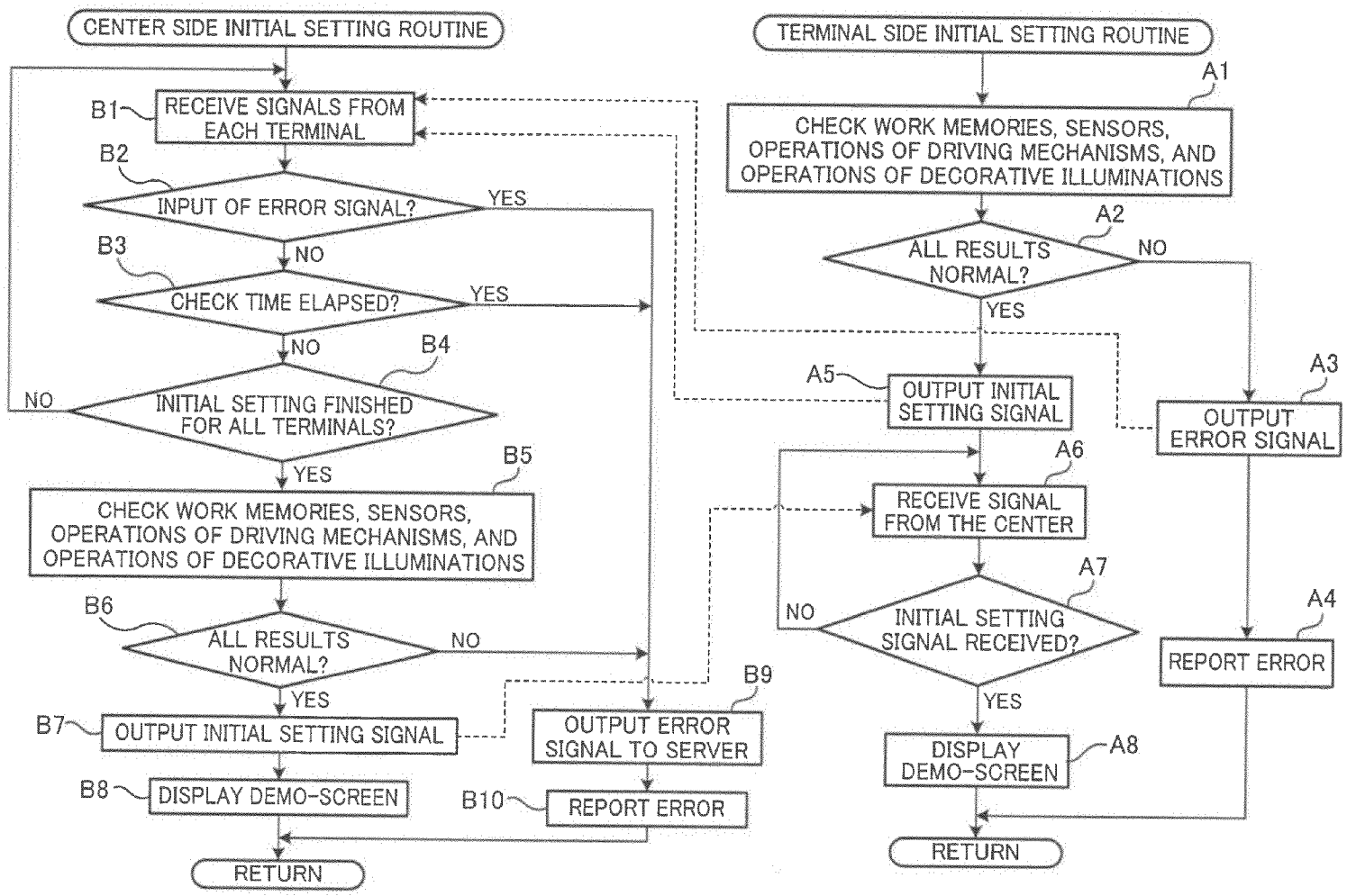
FIG. 41 is a flowchart illustrating an initial process executed by the gaming terminal and the center controller.

After this, the main CPUs 41 and 241 each perform an initial process of FIG. 41.

[Operation of Gaming Machine 1: Initial Process]

Figure 40:
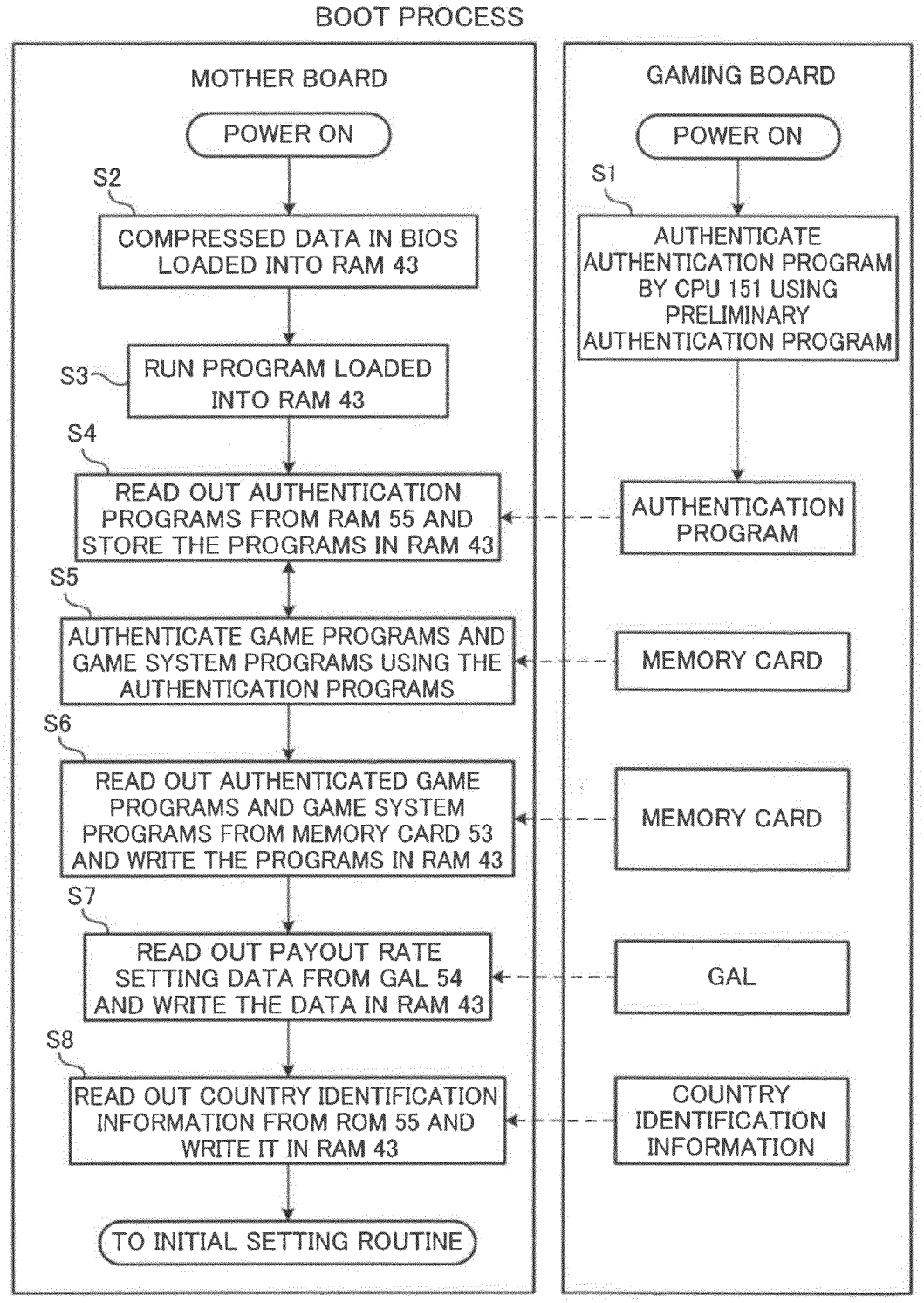
FIG. 40 is a flowchart illustrating a boot process executed by the gaming terminal and the center controller.

The following describes an initial process which takes place in the gaming machine 1. When the boot process of FIG. 40 is completed, the center controller 200 reads out from the RAM 243 a center side initial setting routine illustrated in FIG. 41 and executes the routine. Meanwhile, the gaming terminal 10 reads out from the RAM 43 a terminal side initial setting routine illustrated in FIG. 41 and executes the routine. The center side and terminal side initial setting routines are executed in parallel.

First, the main CPU 41 of each of the gaming terminals 10 checks operations of work memories such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2: NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal is received from each of the gaming terminals 10 (B4). If the main CPU 241 determines that an initial setting signal from any one of the gaming terminals 10 is not received (B4: NO), the process returns to B1. On the other hand, if it is determined that initial setting signals from all the gaming terminals 10 are received (B4: YES), the main CPU 241 checks operations of work memories such as RAM 243, various sensors, various driving mechanisms, and various decorative illuminations (B5). Then, the main CPU 241 determines whether all the check results are normal (B6).

If the main CPU 241 determines the check results contain an error (B6: NO), the main CPU 241 executes B9.

On the other hand in B6, if the main CPU 241 determines that all the check results are normal (B6: YES), the main CPU 241 outputs an initial setting signal to all the gaming terminals 10 (B7), and causes the shared display 102 to display a demo-screen (B8). Then, the main CPU 241 ends the routine.

In A7, the main CPU 41 of each of the gaming terminals 10 determines that an initial setting signal is received from the center controller 200 (A7: YES), and causes the terminal display 101 to display a demo-screen (A7). The main CPU 41 then ends the routine.

[Operation of Gaming Terminal 10: Terminal Process Routine]

Figure 42:
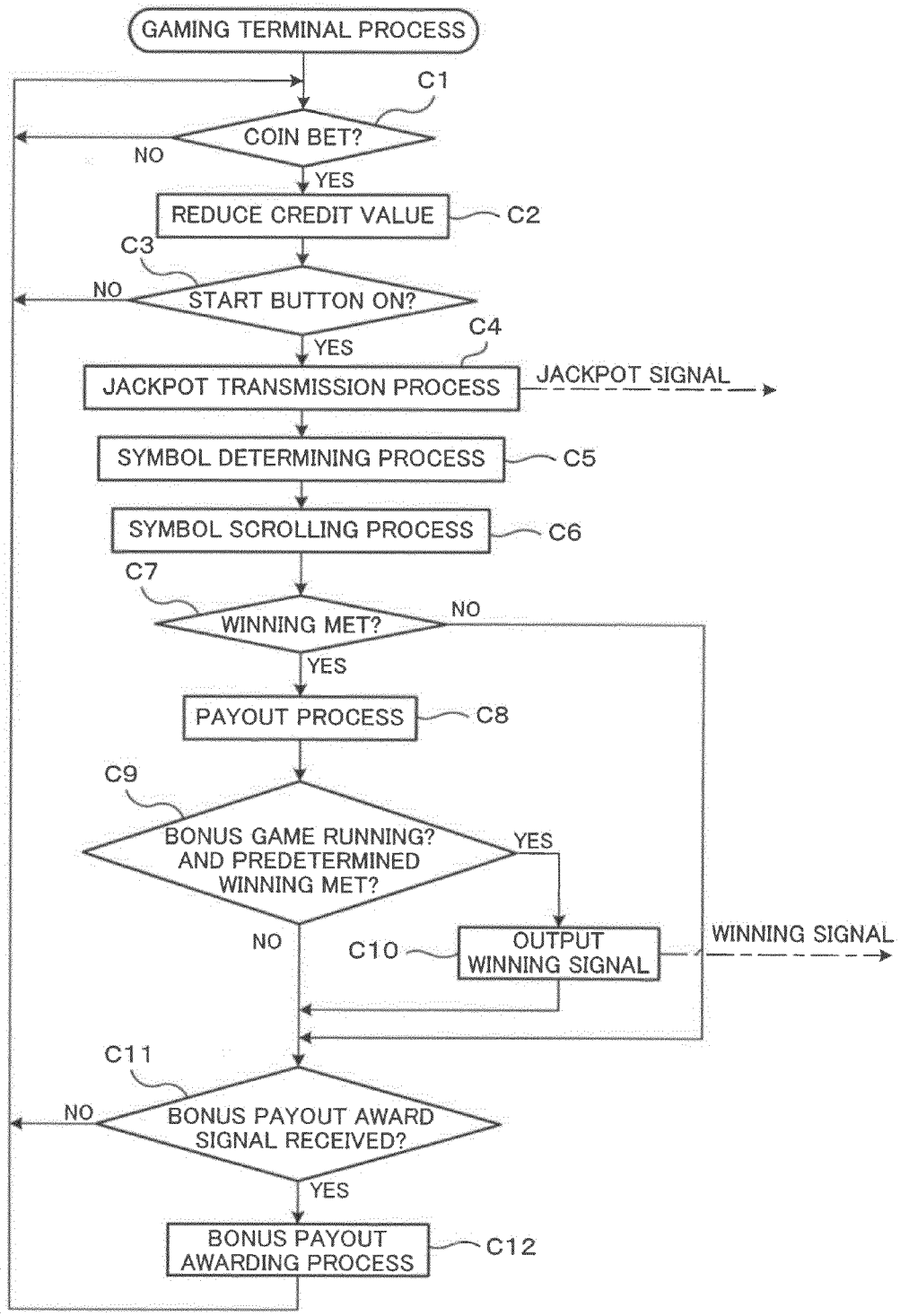
FIG. 42 is a flowchart illustrating a terminal process routine executed in the gaming terminal.

After the terminal side initial setting routine of FIG. 41, the main CPU 41 of the gaming terminal 10 performs a terminal process routine of FIG. 42. Through this terminal process routine, a game is run.

As illustrated in FIG. 42, in the terminal process routine, it is determined whether a coin is bet (C1). In this step, it is determined whether a signal from the 1-BET switch 26S entered by pressing of the 1-BET button 26 is received. Meanwhile, it is determined whether a signal from the maximum BET switch 27S entered by pressing of the maximum BET button 27 is received. If no coin is BET (C1: NO), C1 is repeated until a coin is bet.

On the other hand, if a coin is bet (C1: YES), the credit value stored in the RAM 43 is reduced according to the number of coins bet (C2). When the number of coins bet surpasses the number of coins equivalent to the credit value stored in the RAM 43, C2 is repeated without the reduction of the credit value. When the number of coins bet exceeds the maximum number of coins bettable one game (50 pieces in this embodiment), the process goes to a later-described step C3 without the reduction of the credit value.

Then, it is determined whether a spin button 23 is pressed (C3). If the spin button 23 is not pressed (C3: NO), the process returns to C1. Here, if the spin button 23 is not pressed (for example, the spin button 23 is not pressed but a command to end the game is input), the reduction of the credit value in C2 is canceled.

On the other hand, if the spin button 23 is pressed (C3: YES), a jackpot transmission process is executed (C4). In other words, a jackpot signal indicating a part of the game value bet is transmitted to the center controller 200.

Next executed is a symbol determining process (C5). That is, the stop symbol determining program stored in the RAM 43 is run to determine symbols 180 to be arranged in the matrix 156. Through this, a symbol combination to be formed along the payline L is determined.

Then, the scrolling process is executed to scroll symbols 180 on the terminal display 101 (C6). The scrolling process is a process in which the symbols 180 determined in C5 are stopped (rearranged) in the matrix 156 after scrolling of symbols 180 in a direction indicated by an arrow symbol.

Next, it is determined whether symbols 180 rearranged in the matrix 156 form a winning combination (C7). If the symbols 180 form a winning combination (C7: YES), a payout process is executed (C8). More specifically, when a winning combination is formed, the number of coins according to the combination is calculated. On the other hand in C7, if it is determined that no winning combination is formed (C7: NO), C11 is executed.

After the execution of the payout process in C8, the main CPU 41 determines whether a bonus game is running and whether a predetermined winning is met (C9). If a bonus game start signal is received from the center controller 200, the main CPU 41 determines that the bonus game is running. If it is determined that the bonus game is running and a predetermined winning is met (C9: YES), a winning signal is output to the center controller 200 (C10) and the process of C11 is executed. On the other hand, if it is determined that the bonus game is not running or a predetermined winning is not met (C9: NO), the process of C11 is executed.

Next, the main CPU 41 determines whether a bonus award signal is received from the center controller 200 (C11). If the main CPU 41 determines that a bonus award signal is received (C11: YES), a payout is awarded according to the bonus award signal (C12). The process then returns to C1. On the other hand in C11, if the main CPU 41 determines that no bonus award signal is received (C11: NO), the process returns to C1.

[Operation of Center Controller 200: Center Process Routine]

Figure 43:
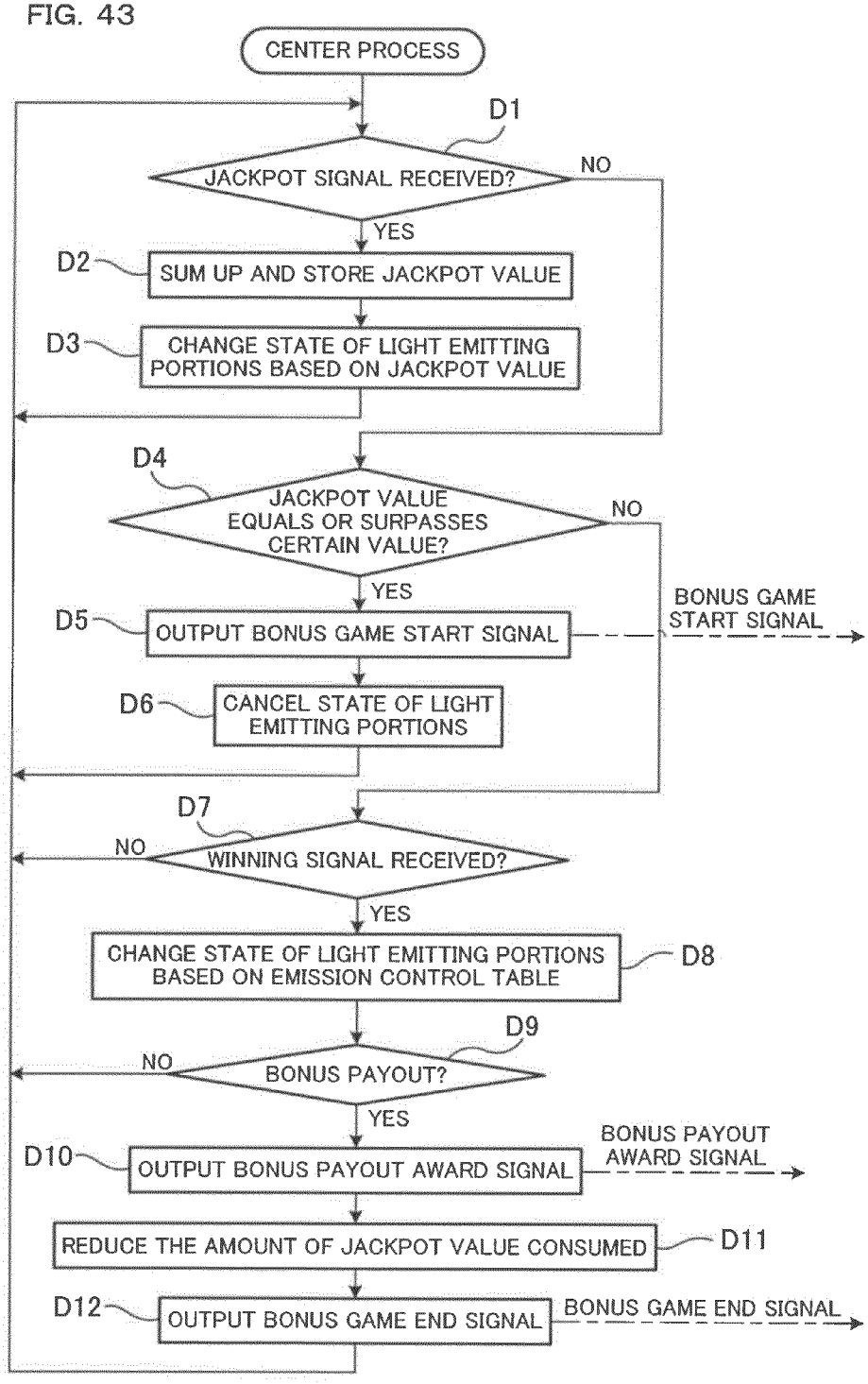
FIG. 43 is a flowchart illustrating a center process routine executed in the center controller.

After the center side initial setting routine of FIG. 41, the main CPU 241 of the center controller 200 executes a center process routine of FIG. 43. The main CPU 241 performs the center process routine to run a bonus game.

As illustrated in FIG. 43, in the center process routine, the main CPU 241 determines whether a jackpot signal is received from a gaming terminal 10 (D1). If it is determined that a jackpot signal is received (D1: YES), the game value indicated by the jackpot signal is stored cumulatively (D2), and the state of the light emitting portions 311 in the luminescent display devices 310 is changed according to the contribution of each gaming terminal 10 to the jackpot value accumulated in the jackpot storage unit 201 (D3). The process then returns to D1.

On the other hand in D1, if the main CPU 241 determines no jackpot signal is received (D1: NO), the main CPU 241 determines if the jackpot value equals or surpasses a predetermined value (D4). If it is determined that the jackpot value equals or surpasses a predetermined value (D4: YES), a bonus game start signal is output to each gaming terminal 10 (D5), and the state change in the light emitting portions 311 is cancelled (D6). Then, the process of D1 is executed.

If it is determined that the jackpot value does not equal or surpass a predetermined value (D4: NO), the main CPU 241 determines whether a winning signal is received from the terminal controller 100 (D7). If the main CPU 241 determines that a winning signal is not received (D7: NO), the process returns to D1. On the other hand, if it is determined that a winning signal has been received (D7: YES), the light emitting portions 311 in the luminescent display devices 310 are caused to undergo state changes toward the bonus payout indicator 300, based on the emission control table (D8).

Then, it is determined whether a path 301 exists in which the light emitting portions 311 in the luminescent display devices 310 have undergone state changes up to the bonus payout indicator 300, so as to determine whether conditions are met for awarding a bonus payout (D9). If it is determined that conditions for awarding a bonus payout are not met (D9: NO), the process returns to D1. On the other hand, when it is determined that a bonus payout is to be awarded (D9, YES), a bonus award process is run to award a bonus payout, and a bonus award signal is output to a gaming terminal 10 through which a bonus payout is awarded (D10). Then, the amount of jackpot value consumed is reduced from the RAM 243 (D11), and a bonus game end signal is output to each gaming terminal 10 (D12). The process then returns to D1.

As described above, the light emitted by the light emitting portion 311 enters the aperture 313 provided in a predetermined portion of the housing 314 within a path of emergent light from the light emitting portion 311. The light entering the aperture 313 is attenuated as it passes through the cover member 315 provided to cover the aperture 313. Accordingly, the brightness of the light is reduced as the light passes through the cover member 315. By reducing the brightness of the light through the cover member 315, luminescent effects can be provided at the brightness suitable to the players, even when the light emitted by the light emitting portion 311 is too bright.

Further, the cover member 315 is detachably provided for the housing 314. By providing more than one cover member 315 having different attenuations for the transmitting light, the brightness of the emitted light from the luminescent display device 310 can be appropriately adjusted. By the provision of the cover member 315 covering the aperture 313 of the housing 314, the players are prevented from directly touching the light emitting portion 311 through the aperture 313 of the housing 314. This reduces the risk of the light emitting portion 311 being damaged by the players.

By the housing 314, the light emitted by the light emitting portion 311 does not emerge outside except through the aperture 313. In this way, the light emitted by the light emitting portion 311 emerges only through the aperture 313, making it possible for the players to recognize the luminescent display device 310 emitting light. The players are therefore able to easily grasp the progress of a game, represented by the state of the light emitting portions 311 of the luminescent display devices 310.

In the detailed description provided above, characteristic parts have mainly been described in order that the present invention can be understood more easily. However, the present invention is not limited to the embodiment shown in the detailed description provided above, and may be applied to other embodiments. The scope of application of the present invention should be construed as broadly as possible. Terms and phraseologies adopted in the present specification are for correctly illustrating the present invention, not for limiting. It would be easy for those skilled in the art to derive, from the spirit of the invention described in the present specification, other structures, systems, methods and the like which are included in the spirit of the invention. Accordingly, it should be considered that claims cover equivalent structures, too, without departing from the technical idea of the present invention. An object of the abstract is to enable an intellectual property office, general public institutions, persons belonging to the art but not familiar with patent, legal terms, or technical terms to quickly understand technical contents and essences of the present invention through a simple research. Therefore, the abstract is not intended to limit the scope of the invention that should be evaluated by the claims. In addition, it is desirable to sufficiently refer to already-disclosed documents and the like, in order to fully understand the objects and effects of the present invention.

The detailed description provided above includes a processing which is executed on a computer or a computer network. The descriptions and expressions provided above are given for the purpose of allowing those skilled in the art to understand the invention most effectively. In the specification, respective steps used to induce one result, or blocks having a predetermined processing function should be understood as a processing having no self-contradiction. In addition, in each step or block, an electrical or magnetic signal is transmitted/received, recorded, and the like. In a processing in each step or block, such a signal is embodied in the form of a bit, a value, a symbol, a character, a term, a number, and the like. However, it should be noted that they have been used simply because they are convenient for explanations. A processing in each step or block has sometimes been described using an expression which is common to a human behavior. However, in principle, the processing described in the specification is executed by various devices. In addition, other structures necessary for each step or block are apparent from the above description.

What is claimed is:

1. A lighting device, comprising:

a light-emitting diode which emits light;

a cover which is positioned so as to receive light emitted from the light-emitting diode, and has a hemispherical shape and translucency; and a metal layer which is vapor-deposited onto the cover, and transmits a predetermined amount of light emitted from the light-emitting diode.

2. The lighting device according to claim 1, wherein the metal layer is vapor-deposited so that the deposited layer is thickest at a most outward portion of the cover.

3. The lighting device according to claim 2, wherein the metal layer vapor-deposited onto the cover is aluminum.

4. The lighting device according to claim 2, wherein the cover is made of polycarbonate.

5. The lighting device according to claim 2, further comprising a reflector which is positioned so as to receive reflected light of light emitted from the light-emitting diode, the reflector reflecting, toward the cover, light reflected by the metal layer.

6. The lighting device according to claim 5, wherein the reflector curves inward to form a recess shape and a reflection face of the reflector is constituted by a plurality of areas each having a reflection angle different from one another.

7. The lighting device according to claim 5, further comprising:

a housing which has an opening, and contains therein the light-emitting diode and the reflector; and a sealing member which seals the opening and holds the cover.

8. The lighting device according to claim 7, wherein the housing has a connecting portion provided at a side of the housing, through which portion the housing is connected to another housing by engagement.

9. A gaming machine, comprising:

a plurality of terminal devices in each of which a base game is executed with a game value being bet; a common display which displays predetermined content, and a lighting device, the lighting device including:

a light-emitting diode (LED) which emits light;

a cover which is positioned so as to receive light emitted from the light-emitting diode, and has a hemispherical shape and translucency; and a metal layer which is vapor-deposited onto the cover, and transmits a predetermined amount of light emitted from the light-emitting diode.

10. The gaming machine according to claim 9, wherein the metal layer is vapor-deposited onto the cover of the lighting device so that the deposited layer is thickest at a most outward portion of the cover.

11. The gaming machine according to claim 10, wherein the metal layer vapor-deposited onto the cover of the lighting device is aluminum.

12. The gaming machine according to claim 10, wherein the cover of the lighting device is made of polycarbonate.

13. The gaming machine according to claim 10, wherein the lighting device further includes a reflector which is positioned so as to receive reflected light of light emitted from the light-emitting diode, the reflector reflecting, toward the cover, light reflected by the metal layer.

14. The gaming machine according to claim 13, wherein the reflector of the lighting device curves inward to form a recess shape and a reflection face of the reflector is constituted by a plurality of areas each having a reflection angle different from one another.

15. The gaming machine according to claim 13, wherein the lighting device further includes:

a housing which has an opening, and contains therein the light-emitting diode and the reflector; and a sealing member which seals the opening and holds the cover.

16. The gaming machine according to claim 15, wherein the housing of the lighting device has a connecting portion provided at a side of the housing, through which portion the housing is connected to another housing by engagement.

17. A gaming machine including a luminescent display device to provide luminescent effects, the luminescent display device comprising:

a light emitting portion to emit light;

a housing, having an aperture formed in a predetermined portion within a path of emergent light from the light emitting portion, housing the light emitting portion; and a cover member detachably provided to cover the aperture of the housing to attenuate a quantity of transmitting light emitted by the light emitting portion, the cover member having a metal layer which is vapor-deposited thereon and which transmits a predetermined amount of light emitted from the light emitting portion.

18. The gaming machine according to claim 17, wherein the cover member in the luminescent display device includes a raised portion protruding in a direction of emergent light from the light emitting portion.

19. The gaming machine according to claim 17, wherein the cover member in the luminescent display device includes a lens that varies a direction of emergent light from the light emitting portion.

20. The gaming machine according to claim 17, wherein the housing has a reflecting surface to reflect light emitted by the light emitting portion.

21. The gaming machine according to claim 20, wherein the reflecting surface of the housing is partially inclined, parabolic, or ellipsoidal, with an increasing diameter toward the aperture.

22. The gaming machine according to claim 17, wherein the cover member in the luminescent display device includes a half mirror.

23. The gaming machine according to claim 22, wherein the housing has a reflecting surface to reflect light emitted by the light emitting portion.

24. A gaming machine including a luminescent display unit provided with a luminescent display device to provide luminescent effects, the luminescent display device comprising:

a light emitting portion to emit light;

a housing, having an aperture formed in a predetermined portion within a path of emergent light from the light emitting portion, housing the light emitting portion; and a cover member detachably provided to cover the aperture of the housing to attenuate a quantity of transmitting light emitted by the light emitting portion, the cover member having a metal layer which is vapor-deposited thereon and which transmits a predetermined amount of light emitted from the light emitting portion, the luminescent display device being one of luminescent display devices provided in the luminescent display unit.

* * * * *